US005161393A

United States Patent [19]

Payne et al.

[11] Patent Number: 5,161,393

[45] Date of Patent: Nov. 10, 1992

[54] ELECTRONIC WASHER CONTROL INCLUDING AUTOMATIC LOAD SIZE DETERMINATION, FABRIC BLEND DETERMINATION AND ADJUSTABLE WASHER MEANS

[75] Inventors: Thomas R. Payne; Steven A. Rice; Douglas A. Able; Donald R. Dickerson, Jr., all of Louisville, Ky.

[73] Assignee: General Electric Company, Louisville, Ky.

[21] Appl. No.: 723,277

[22] Filed: Jun. 28, 1991

[51] Int. Cl.[5] ..... D06F 33/02

[52] U.S. Cl. ..... 68/12.04; 68/12.05; 68/12.14

[58] Field of Search ..... 68/12.01, 12.04, 12.05, 68/12.14, 23.7

[56] References Cited

U.S. PATENT DOCUMENTS

| | | | |
|---|---|---|---|
| 4,235,085 | 11/1980 | Torita | 68/12.04 |
| 4,303,406 | 12/1981 | Ross | 8/158 |
| 4,400,838 | 8/1983 | Steers et al. | 8/158 |
| 4,503,575 | 3/1985 | Knoop et al. | 8/158 |
| 4,607,408 | 8/1986 | Didier et al. | 8/159 |
| 4,697,293 | 10/1987 | Knoop | 8/158 |
| 4,779,430 | 10/1988 | Thuruta et al. | 68/12.04 |
| 4,862,710 | 9/1989 | Torita et al. | 68/12.01 |

FOREIGN PATENT DOCUMENTS

| | | | |
|---|---|---|---|
| 0345120 | 12/1989 | European Pat. Off. | 68/12.04 |
| 2559796 | 8/1985 | France | 68/12.01 |
| 0164996 | 7/1988 | Japan | 68/12.01 |
| 2286197 | 11/1990 | Japan | 68/12.04 |

*Primary Examiner*—Philip R. Coe

*Attorney, Agent, or Firm*—Radford M. Reams; H. Neil Houser

[57] ABSTRACT

A fabric washing machine has a container for fabrics and fluid to wash the fabrics. A switched reluctance motor is connected to the container. The motor is operated at a constant torque and the time needed to accelerate the container and a load of fabrics from one speed to a higher speed is measured. The measurement may be repeated with a different torque input. The inertia of the system, and thus the size of the fabric load, is calculated from the time measurement. The load size information, whether calculated or inputted, is used to calculate the blend of fabrics in the load. Water is added to the container in predetermined increments, and the container is oscillated a predetermined number of strokes and the required torque is measured after each addition of water. The required torque is used to calculate the blend of fabrics as the torque value varies with load size (already known) and the percentage of cotton in the load. An operation control includes a memory storing a number of set of values representing motor velocities and corresponding to particular load sizes and blends. The control calls up values from the set corresponding to the size and blend of the fabric load in the machine.

59 Claims, 35 Drawing Sheets

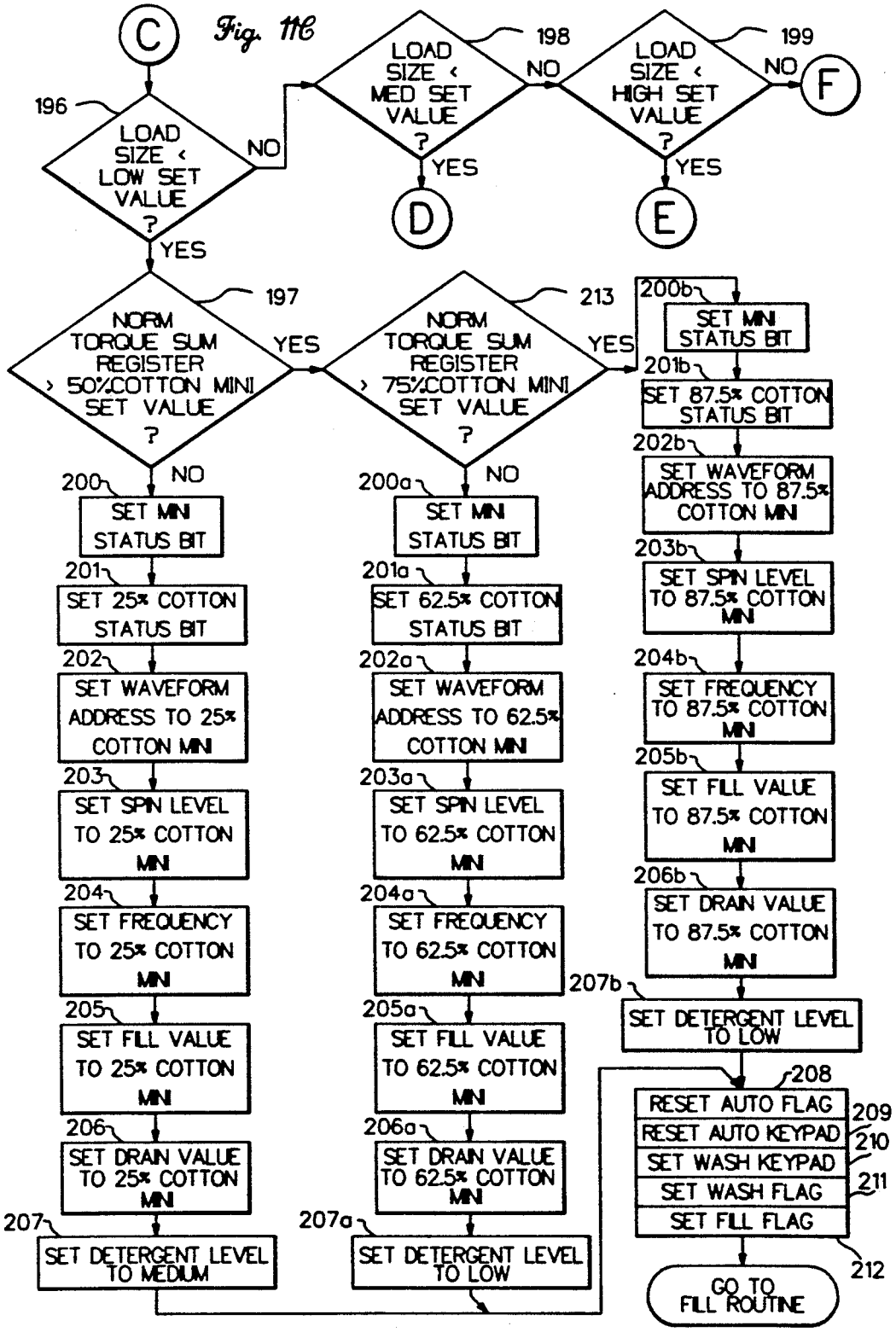
Fig. 11C
C
196
LOAD SIZE < LOW SET VALUE ?
NO
YES
198
LOAD SIZE < MED SET VALUE ?
NO
YES
D
199
LOAD SIZE < HIGH SET VALUE ?
NO
YES
E
F
197
NORM TORQUE SUM REGISTER > 50%COTTON MINI SET VALUE ?
YES
NO
213
NORM TORQUE SUM REGISTER > 75%COTTON MINI SET VALUE ?
YES
NO
200 SET MINI STATUS BIT
201 SET 25% COTTON STATUS BIT
202 SET WAVEFORM ADDRESS TO 25% COTTON MINI
203 SET SPIN LEVEL TO 25% COTTON MINI
204 SET FREQUENCY TO 25% COTTON MINI
205 SET FILL VALUE TO 25% COTTON MINI
206 SET DRAIN VALUE TO 25% COTTON MINI
207 SET DETERGENT LEVEL TO MEDIUM
200a SET MINI STATUS BIT
201a SET 62.5% COTTON STATUS BIT
202a SET WAVEFORM ADDRESS TO 62.5% COTTON MINI
203a SET SPIN LEVEL TO 62.5% COTTON MINI
204a SET FREQUENCY TO 62.5% COTTON MINI
205a SET FILL VALUE TO 62.5% COTTON MINI
206a SET DRAIN VALUE TO 62.5% COTTON MINI
207a SET DETERGENT LEVEL TO LOW
200b SET MINI STATUS BIT
201b SET 87.5% COTTON STATUS BIT
202b SET WAVEFORM ADDRESS TO 87.5% COTTON MINI
203b SET SPIN LEVEL TO 87.5% COTTON MINI
204b SET FREQUENCY TO 87.5% COTTON MINI
205b SET FILL VALUE TO 87.5% COTTON MINI
206b SET DRAIN VALUE TO 87.5% COTTON MINI
207b SET DETERGENT LEVEL TO LOW
208 RESET AUTO FLAG
209 RESET AUTO KEYPAD
210 SET WASH KEYPAD
211 SET WASH FLAG
SET FILL FLAG
212
GO TO FILL ROUTINE

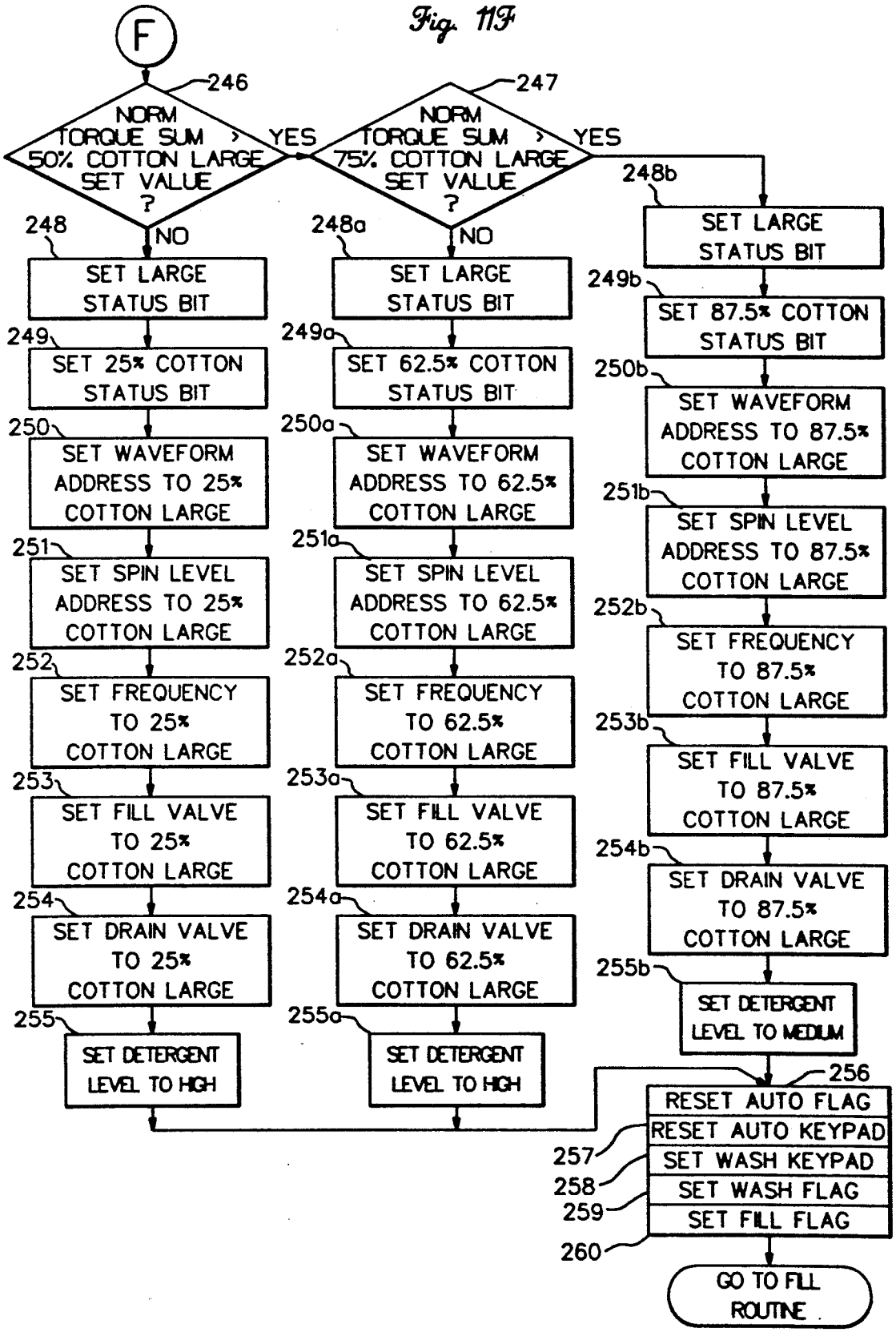
Fig. 11F
F
246
NORM TORQUE SUM > 50% COTTON LARGE SET VALUE ?
YES
NO
247
NORM TORQUE SUM > 75% COTTON LARGE SET VALUE ?
YES
NO
248
SET LARGE STATUS BIT
249
SET 25% COTTON STATUS BIT
250
SET WAVEFORM ADDRESS TO 25% COTTON LARGE
251
SET SPIN LEVEL ADDRESS TO 25% COTTON LARGE
252
SET FREQUENCY TO 25% COTTON LARGE
253
SET FILL VALVE TO 25% COTTON LARGE
254
SET DRAIN VALVE TO 25% COTTON LARGE
255
SET DETERGENT LEVEL TO HIGH
248a
SET LARGE STATUS BIT
249a
SET 62.5% COTTON STATUS BIT
250a
SET WAVEFORM ADDRESS TO 62.5% COTTON LARGE
251a
SET SPIN LEVEL ADDRESS TO 62.5% COTTON LARGE
252a
SET FREQUENCY TO 62.5% COTTON LARGE
253a
SET FILL VALVE TO 62.5% COTTON LARGE
254a
SET DRAIN VALVE TO 62.5% COTTON LARGE
255a
SET DETERGENT LEVEL TO HIGH
248b
SET LARGE STATUS BIT
249b
SET 87.5% COTTON STATUS BIT
250b
SET WAVEFORM ADDRESS TO 87.5% COTTON LARGE
251b
SET SPIN LEVEL ADDRESS TO 87.5% COTTON LARGE
252b
SET FREQUENCY TO 87.5% COTTON LARGE
253b
SET FILL VALVE TO 87.5% COTTON LARGE
254b
SET DRAIN VALVE TO 87.5% COTTON LARGE
255b
SET DETERGENT LEVEL TO MEDIUM
256
RESET AUTO FLAG
257
RESET AUTO KEYPAD
258
SET WASH KEYPAD
259
SET WASH FLAG
260
SET FILL FLAG
GO TO FILL ROUTINE

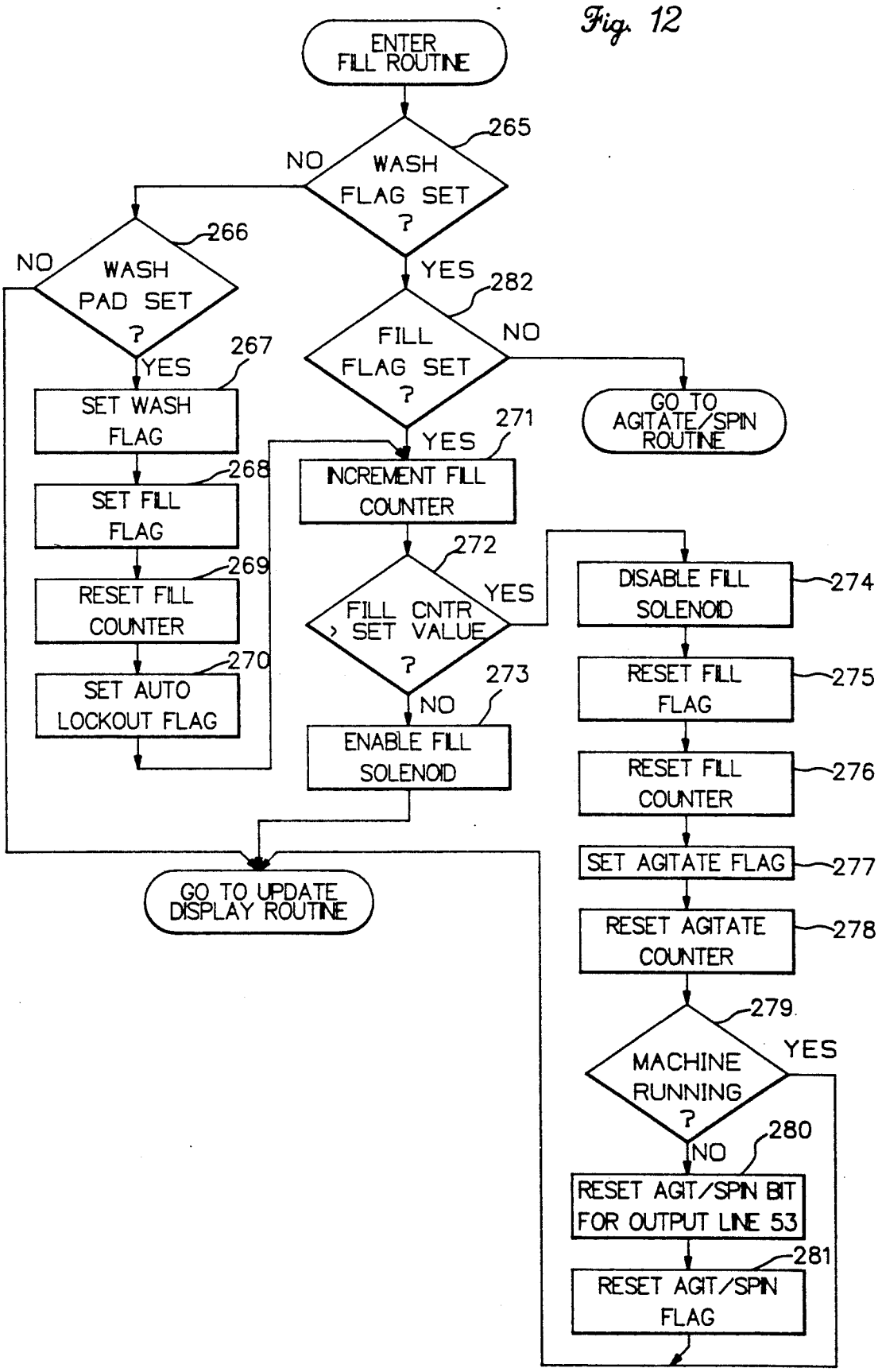
Fig. 12
ENTER FILL ROUTINE
265
WASH FLAG SET ?
NO
YES
266
WASH PAD SET ?
NO
YES
267
SET WASH FLAG
268
SET FILL FLAG
269
RESET FILL COUNTER
270
SET AUTO LOCKOUT FLAG
282
FILL FLAG SET ?
NO
YES
GO TO AGITATE/SPIN ROUTINE
271
INCREMENT FILL COUNTER
272
FILL CNTR > SET VALUE ?
YES
NO
273
ENABLE FILL SOLENOID
GO TO UPDATE DISPLAY ROUTINE
274
DISABLE FILL SOLENOID
275
RESET FILL FLAG
276
RESET FILL COUNTER
277
SET AGITATE FLAG
278
RESET AGITATE COUNTER
279
MACHINE RUNNING ?
YES
NO
280
RESET AGIT/SPIN BIT FOR OUTPUT LINE 53
281
RESET AGIT/SPIN FLAG

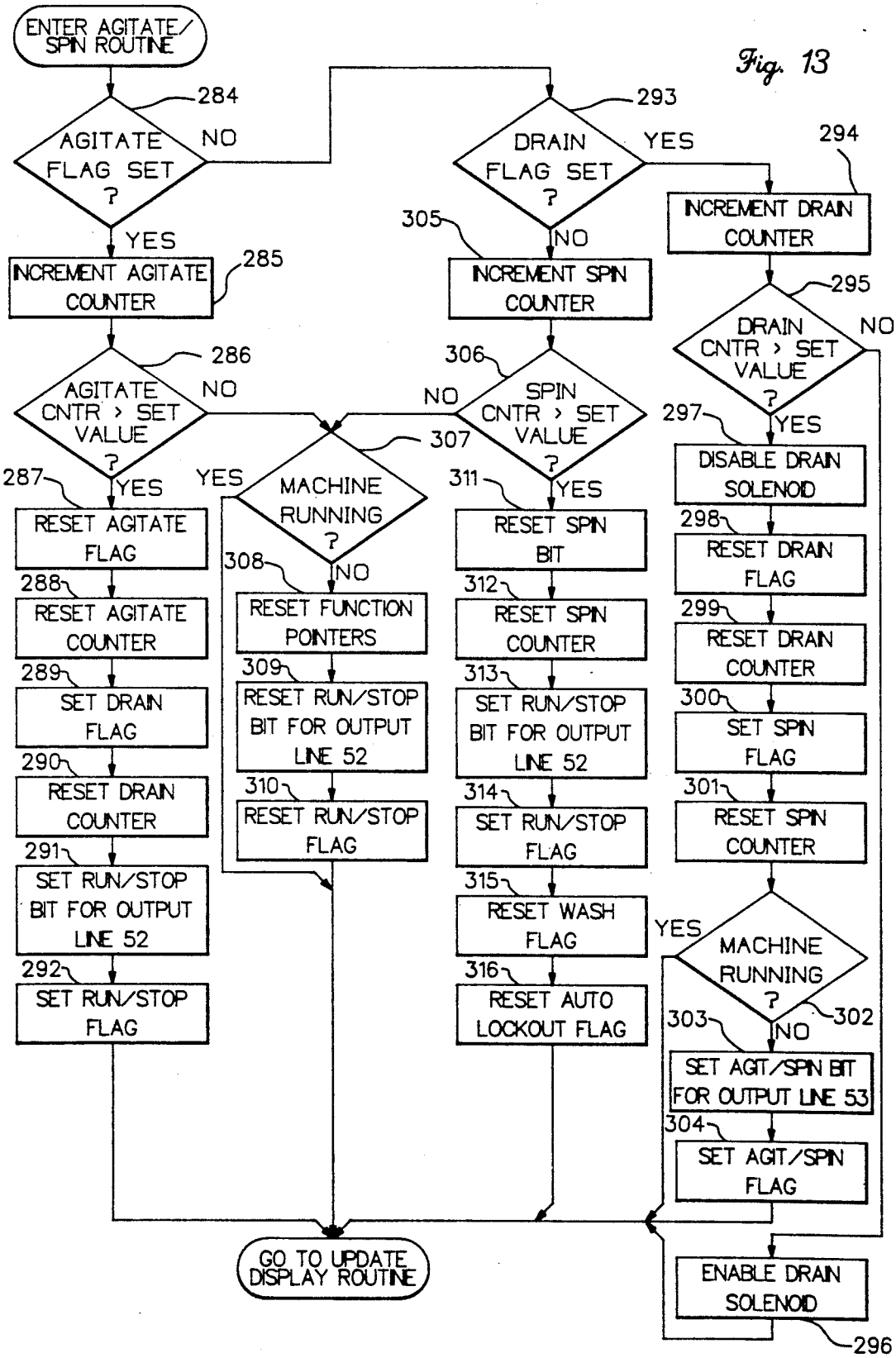
Fig. 13
ENTER AGITATE/SPIN ROUTINE
284
AGITATE FLAG SET ?
NO
YES
285
INCREMENT AGITATE COUNTER
286
AGITATE CNTR > SET VALUE ?
NO
YES
287
RESET AGITATE FLAG
288
RESET AGITATE COUNTER
289
SET DRAIN FLAG
290
RESET DRAIN COUNTER
291
SET RUN/STOP BIT FOR OUTPUT LINE 52
292
SET RUN/STOP FLAG
307
MACHINE RUNNING ?
YES
NO
308
RESET FUNCTION POINTERS
309
RESET RUN/STOP BIT FOR OUTPUT LINE 52
310
RESET RUN/STOP FLAG
293
DRAIN FLAG SET ?
YES
NO
294
INCREMENT DRAIN COUNTER
305
INCREMENT SPIN COUNTER
306
SPIN CNTR > SET VALUE ?
NO
YES
311
RESET SPIN BIT
312
RESET SPIN COUNTER
313
SET RUN/STOP BIT FOR OUTPUT LINE 52
314
SET RUN/STOP FLAG
315
RESET WASH FLAG
316
RESET AUTO LOCKOUT FLAG
295
DRAIN CNTR > SET VALUE ?
NO
YES
297
DISABLE DRAIN SOLENOID
298
RESET DRAIN FLAG
299
RESET DRAIN COUNTER
300
SET SPIN FLAG
301
RESET SPIN COUNTER
302
MACHINE RUNNING ?
YES
NO
303
SET AGIT/SPIN BIT FOR OUTPUT LINE 53
304
SET AGIT/SPIN FLAG
ENABLE DRAIN SOLENOID
296
GO TO UPDATE DISPLAY ROUTINE Work Summation as Function of Load Size

ELECTRONIC WASHER CONTROL INCLUDING AUTOMATIC LOAD SIZE DETERMINATION, FABRIC BLEND DETERMINATION AND ADJUSTABLE WASHER MEANS

FIELD OF THE INVENTION

This invention relates to laundry apparatus or automatic washing machines and more particularly to a washing machine control which operates the machine to automatically determine the size (weight) of the load of fabrics to be washed, automatically determines the blend of fabrics (the relative amounts of cotton and synthetic fibers) in the load, and operates the machine in accordance with predetermined parameters corresponding to the load size and blend.

BACKGROUND OF THE INVENTION

All washing machines operate better (greater washability, less stress on the machine, etc.) if the velocity/-torque waveforms of the agitation means are optimized for various size loads. If a small load is washed with a waveform designed for a larger load, the clothes will be washed; however, the clothes will be subjected to additional wear. Conversely, a large load will not be as effectively washed with a waveform developed for a smaller load. U.S. Pat. No. 5,076,076 titled "Direct Drive Oscillating Basket Washing Machine and Control for an Automatic Washing Machine," for Thomas R. Payne, filed Apr. 2, 1990 and assigned to General Electric Company, assignee of the present application, is incorporated herein by reference. That application discloses a control which tailors the agitation waveform in accordance with a load size input of the user.

The operation of washing machines can be further optimized by tailoring the agitation waveform to the type of fiber being washed. There is a direct correlation between the amount of wear and the overall soil removal when dealing with cotton fibers. When washing cotton fabrics, a trade-off is made between the removal of soil from the clothing and the wear of the fibers resulting from the wash action. The advent of synthetic fibers has altered this washing-wear relationship for many articles of clothing. Synthetic fibers wash primarily as a result of the chemical reactions between the soil and the detergent. Extra agitation does not appreciably improve soil removal. However, it results in superfluous wear that shortens the overall life of the garment. Thus, the washing or agitation action also should be adjusted to account for the blend of fibers or materials in the fabrics being washed.

SUMMARY OF THE INVENTION

In accordance with certain embodiments of this invention, the optimal agitation waveform, water level, and centrifugal extraction (spin) speed are determined automatically. The agitation waveform, water level and spin speed are chosen from empirically predetermined values based on the size and the blend of fiber types of the fabric load to be washed.

In accordance with one aspect of the invention, the load size is indirectly determined by calculating the moment of inertia for the fabric load. In accordance with another aspect of the invention, the size of the load is determined by calculating the amount of work required to move the load of fabrics a fixed distance.

In well designed, built and maintained machines the effects of friction are substantially linear for the load sizes washed and the speeds used in determining the size of a particular load. Thus, generally the difference in the effect of friction from load to load can be ignored. However, as some users may desire greater accuracy over the life of their machine, one embodiment actively eliminates the effects of friction from the load size determination. In that embodiment, the motor is operated with a constant torque and the time required for the motor to accelerate the clothes basket and fabrics from a first predetermined speed to a second, higher predetermined speed is measured. The acceleration operation then is repeated with the motor operated at a different torque and the time to accelerate between the same speeds is measured. The moment of inertia of the system, and thus the size (weight or mass) of the load of fabrics, can be represented by the product of the two acceleration times divided by the difference in the same two times. Since the system is essentially linear in the speed range used, this approach cancels the effect of friction from the calculation and thus compensates for manufacturing tolerances, machine wear and similar factors.

The load size information, whether determined by the moment of inertia method or by the required work method, then is used to select the agitation action, water level and spin speed of the clothes washer.

In another aspect of this invention the known size of the fabric load is used in determining the blend of fibers or materials in the fabric load. The difference in absorbency between cotton and synthetic fibers is a fundamental building block for automatic blend determination. After the dry weight of the fabrics has been calculated or otherwise measured or estimated by the user, water is added to the container in small predetermined amounts. In the illustrative embodiments three gallon increments are used. The load is agitated between water increment additions and the average torque required during each agitation is recorded. As water is added to the fabric load, the fabric load becomes less viscous, and the inertial component of the torque decreases while the shear component of the torque increases. The inertial and shear components do not decrease and increase at identical rates or water levels. This results in a noticeable rise in the plot of the total torque requirement as a function of water level. The magnitude of this increase varies as a function of two variables. The first variable is the dry weight of the fabric load. This data has already been determined, as by the load size calculations. The second and unknown variable is percentage of cotton fiber. By comparing the magnitude of the increase in total torque requirements against empirically determined data for the appropriate load size, an accurate estimate of the percentage of cotton fibers in the fabric load is obtained. This information, along with the load size information, then is utilized in setting the fabric load dependent parameters (such as agitation waveform, water level and spin speed) for the clothes washing machine.

An operation control, operatively connected to the motor driving the machine, includes a memory which stores a number of sets of wash values representative of desired rotor velocities. Each set corresponds to a particular fabric load size and blend and is used to control the motor for a particular machine cycle such as agitation or spin speed for example. The control calls up the values in a predetermined timed sequence from the set which corresponds to the load size and blend in the machine and operates the motor in accordance with the then called up value to provide an agitation stroke or spin operation.

BRIEF DESCRIPTION OF THE DRAWINGS

FIGS. 11A–11F collectively are a simplified flow diagram of the Auto routine incorporated in the control program of FIG. 4;

FIG. 12 is a simplified flow diagram of the Fill routine incorporated in the control program of FIG. 4;

FIG. 13 is a simplified flow diagram of the Agitate/-Spin routine incorporated in the control program of FIG. 4;

FIG. 30 is a graph depicting a family of different blend regions based upon mass of clothes and average normalized torque;

GENERAL OVERVIEW

Modern day washing machines are intended to wash fabric loads of various sizes and various blends. In accordance with one embodiment of the present invention, the machine control operates the machine to generate a signal representative of the size (weight) of the fabric load to be washed and compares that signal to predetermined values representative of known load sizes to determine the size of the particular load. Also, once the load size is known, the control operates the machine to generate a signal representative of the blend of fibers or materials in the load and compares that to predetermined values corresponding to known blends to determine the blend of the particular load. It will be understood that the various predetermined values conveniently can be obtained in the same manner as described hereafter for generating the signals representative of the particular load of fabrics to be washed.

A washing machine and control incorporating one embodiment of the present invention determines the weight of a fabric load and the cotton/polyester or other synthetic fiber ratio of the fabric load without human intervention. In addition, the illustrative embodiment involves no additional hardware to the electronic oscillating basket washer of the Co-pending application Ser. No. 07/502,790.

In accordance with one aspect of this invention the signal representative of the load size is generated by calculating the moment of inertia of the clothes load. Since different fabrics exhibit different absorbency characteristics, the load size calculation is performed prior to the addition of water to the fabric load. With this approach the motor control operates in a torque driven mode and supplies speed feedback information. To determine the moment of inertia, the motor control is given a low torque spin command and the time required to accelerate the motor rotor and clothes container from one set speed to another higher set speed is recorded. A suitable command signal is chosen to provide a low level torque command that will prevent the machine from stalling. Since the torque is fixed, the moment of inertia is proportional to the time required to accelerate from a set speed to another higher set speed. The recorded time is compared against empirically determined threshold values to determine the size (weight) of the fabric load.

Figure 1:
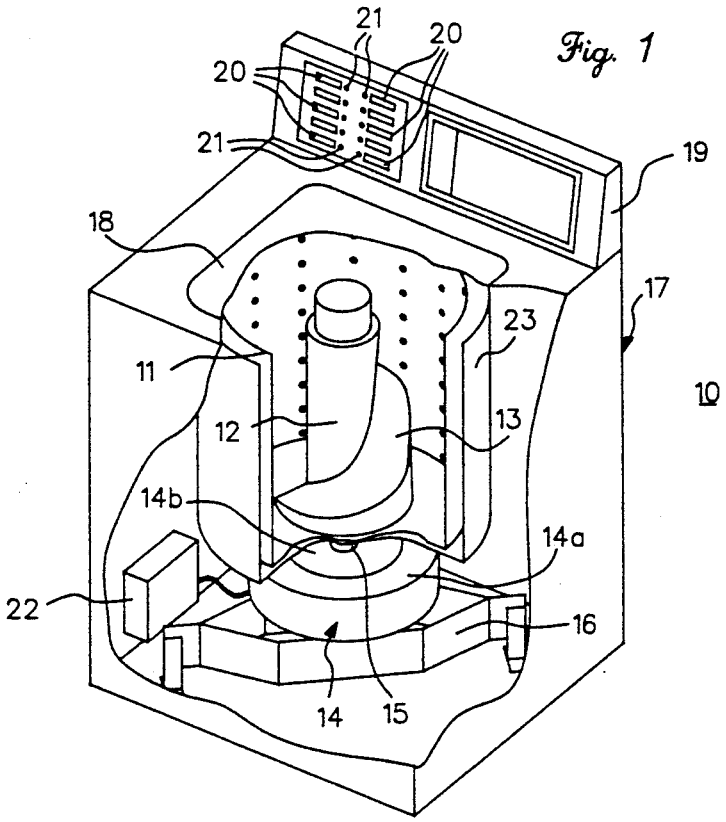
FIG. 1 is a schematic perspective view of a fabric washing machine incorporating one embodiment of the present invention, the view being partly broken away, partly in section and with some components omitted for the sake of simplicity.

The summation of the moments about an axis in a rotating system is equal to the product of the moment of inertia and the angular acceleration. The inertia of the motor and the frictional and electrical losses in the system affect each load size in substantially the same manner, and therefore can be set to zero. The moment of inertia can be considered to be broken into three terms: 1) the bottom of the basket, 2) the sides of the basket and 3) the clothes in the basket. The bottom of the basket is modeled as a flat disc with a moment of inertia equal to one half the product of the mass of the disc and the square of the radius. The sides of the basket are represented by a thin walled hollow cylinder with a moment of inertia equal to the mass times the square of the radius. The clothes are modeled as a solid cylinder with a moment of inertia equal to one half the product of the mass and the square of the radius. The three components for the moment of inertia for an illustrative machine are summed for each case. Representative values are shown in Table 1 for a washing machine as shown in FIG. 1 with representative 0, 2, 4, 8 and 12 pound fabric loads.

TABLE 1

| | | Load Size (Pounds) | | | |
|---|---|---|---|---|---|
| | | 0 | 4 | 8 | 12 |
| I (sides of basket) | ($Mr^2$ kg $m^2$) | 0.2020 | 0.2020 | 0.2020 | 0.2020 |
| I (bottom of basket) | ($0.5Mr^2$ kg $m^2$) | 0.0319 | 0.0319 | 0.0319 | 0.0319 |
| I (clothes) | ($0.5Mr^2$ kg $m^2$) | 0.0000 | 0.0585 | 0.1170 | 0.1755 |
| I (total) | | 0.2339 | 0.2924 | 0.3509 | 0.4094 |

Once the torque level has been determined, the ideal angular acceleration is found by dividing the moments of the system (the applied torque) by the total moment of inertia. Dividing the result by pi yields an angular acceleration in terms of revolutions/seconds$^2$. Since the losses in the system can be ignored, the accelerations can be treated as ratios with the acceleration for the 12 lb load being the base number for the ratios. The ignored terms will act in a multiplicative manner to increase the overall differences between the load sizes, but the ratios remain the same. The ratios are detailed in Table 2.

TABLE 2

| | Load Size (Pounds) | | | |
|---|---|---|---|---|
| | 0 | 4 | 8 | 12 |
| Angular Accel. (radians/sec$^2$) | 47.0100 | 37.6100 | 31.3400 | 26.8300 |
| Angular Accel. (revolutions/sec$^2$) | 14.9637 | 11.9716 | 9.9758 | 8.5403 |
| Normalized Angular Accel. | 1.7521 | 1.4018 | 1.1681 | 1.0000 |

Fabric loads of various predetermined sizes were spun at a predetermined torque level and the acceleration curves plotted. Exemplary curves for an illustrative machine as shown in FIG. 1, are set out in FIG. 26. They all share a linear region from 24 rpm to 120 rpm. Below 24 rpm, the curves may be unpredictable due to the uncertainty of the rotor and stator pole alignment during startup. Above 120 rpm, the curves will deviate as a result of load distribution (imbalance). Between 24 and 120 rpm, the speed feedback represents the inertia or mass of the load and is immune to both load imbalance and misalignment between rotor and stator poles. For other machine designs the regions and values may vary from the illustration.

The time to complete this change in angular velocity for the reference loads is then calculated. A change in angular velocity from 24 rpm to 120 rpm translates to a total change of 1.6 revolutions/second. Dividing this change in angular velocity by the normalized angular accelerations yields a set of time values. These values are then normalized with respect to the twelve pound load time to produce a set of ratios that may be compared to observed data. Table 3 lists the time ratios for each of the four exemplary reference load sizes.

TABLE 3

| | Load Size (Pounds) | | | |
|---|---|---|---|---|
| | 0 | 4 | 8 | 12 |
| Normalized Angular Accel. | 1.7521 | 1.4018 | 1.1681 | 1.0000 |
| Time Value from 24 rpm to 120 rpm using normalized angular accel. | 0.9132 | 1.1414 | 1.3698 | 1.6000 |
| Time Ratio | 0.57 | 0.71 | 0.86 | 1.00 |

Figure 26:
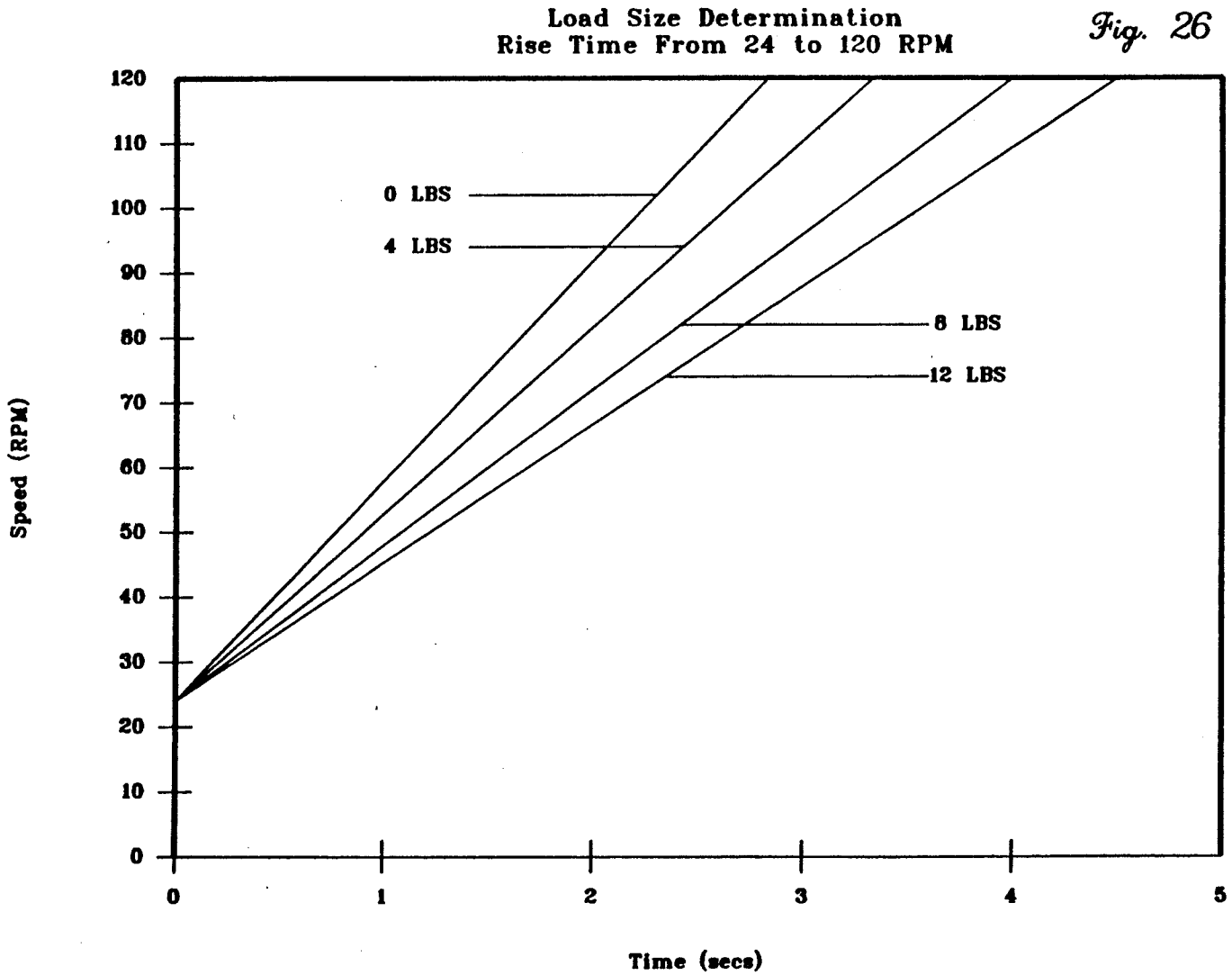
FIG. 26 is a graph depicting the speed profile for different loads.

FIG. 26 details the observed data for the four reference loads. The angular acceleration (the slope of the angular velocity curve) for each case is linear in this region. The data shown in FIG. 26 is used to separate the time required to increase from 24 rpm to 120 rpm into four distinct regions, that is 0–2 pounds, 2–6 pounds, 6–10 pounds and over 10 pounds. The times needed for the angular velocity of the reference loads to increase from 24 rpm to 120 rpm is tabulated in Table 4. The times are normalized with respect to the 12 lb load so that they may be compared to the calculated ratios.

TABLE 4

| | Load Size (Pounds) | | | |
|---|---|---|---|---|
| | 0 | 4 | 8 | 12 |
| Time Ratio | 0.57 | 0.71 | 0.86 | 1.00 |
| Observed Time | 2.80 | 3.35 | 4.00 | 4.50 |
| Normalized Observed Time | 0.62 | 0.74 | 0.89 | 1.00 |

In a rotating system like a washing machine, the applied torque equals the moment of inertia multiplied by the angular acceleration plus the angular velocity multiplied by the frictional coefficient. The frictional load of the machine results from mechanical losses in the motor bearings and other bearing surfaces. A load determination which determines these factors enables the operator to eliminate them and obtain an even more exact approximation of the load size.

Figure 32:
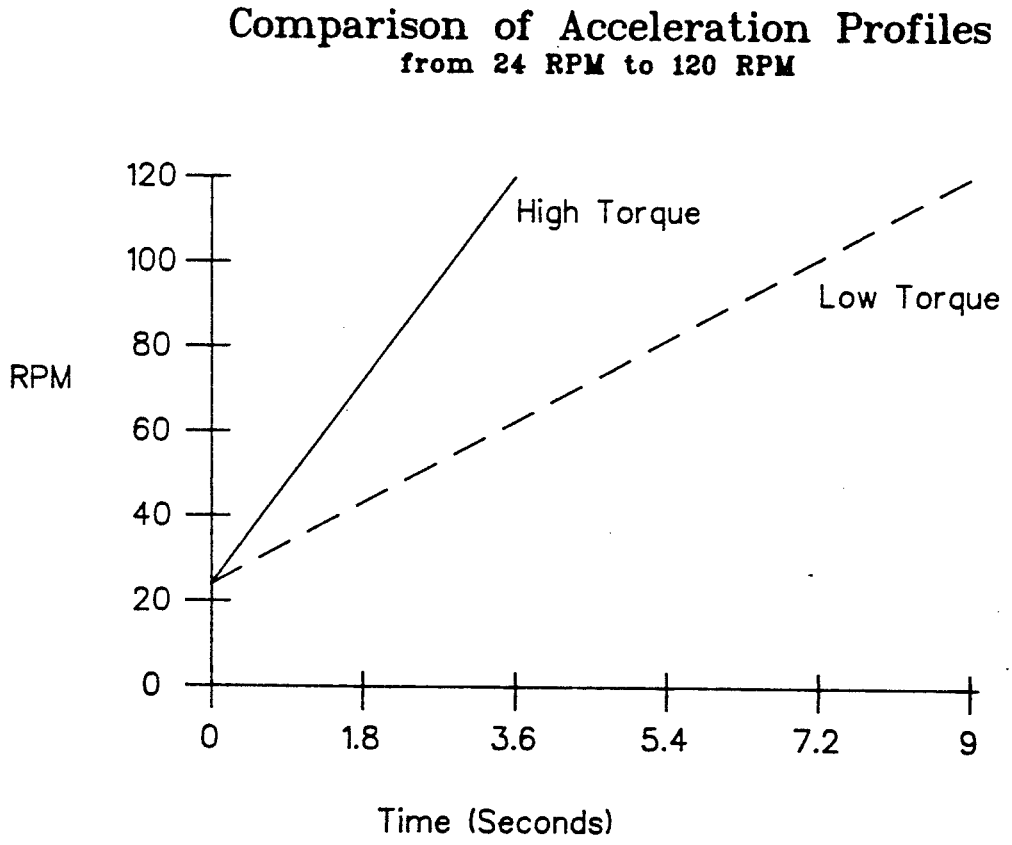
FIG. 32 is a graph depicting the speed profile of a machine as illustrated in FIG. 1 with different torque input signals to the motor.

FIG. 32 sets forth illustrative acceleration curves for an illustrative machine as show in FIG. 1, with each of two constant torque commands. The curve with the greater slope represents the higher torque input and the curve with the lesser slope results from the lower torque input. It has been empirically determined that these curves are linear over the range of speeds used to determine the load size. Since the torque is a constant and the product of the moment of inertia and the angular acceleration is a constant, the product of the friction coefficient and angular velocity also is a constant. Therefore, the friction coefficient can be removed from the calculation. In this regard it should be remembered that the load determination uses comparative values and it is not necessary to determine the absolute value associated with a particular load of fabrics.

The torque driven or acceleration based load size determination procedure is performed twice. The difference in the torques is equal to the moment of inertia multiplied by the difference in acceleration for the separate runs. Thus the moment of inertia is equal to the difference in torque divided by the difference in acceleration. The torque input is the control variable and time is the measured variable. Acceleration is constant between the limit speeds and is equal to the difference in set speeds divided by the measured time. Therefore, the moment of inertia is equal to the product of the measured times divided by the difference in these times, quantity multiplied by a constant representative of the torque and speed threshold data. Since only a relative moment of inertia is needed, the multiplicative constant can be omitted.

In another approach, a signal corresponding to the load size or weight of the fabric load is calculated by determining the work required to rotate the container or basket of fabrics a fixed angular distance.

The motor control in this approach operates the motor with a constant low speed spin or rotation command and the work required for the rotor and fabric container to travel a fixed rotational distance is recorded. The rotational distance is obtained by summing the speed feedback. The work is calculated by integrating the product of the torque and the differential rotational distance. Differential rotational distance is not directly measured, rather it is calculated. The rotational distance is equal to the integral of the rotational velocity (speed feedback) with respect to time. The differential rotational distance is equal to the product of the rotational velocity times the differential time element. Utilizing this information, work is calculated by integrating the product of torque and rotational velocity with respect to time. Since the variable of the integration is time rather than distance, the limits of integration are transformed from angular positions to times. The lower limit of integration is now t (time)=0 seconds and the upper limit of integration is the time required to travel the predetermined fixed distance. Since the speed and torque feedback signals are neither continuous or easily integratable, the work integral is approximated with a summation of the product of the torque feedback and the speed feedback. This summation is taken over the same interval as the work integral. Once the work integral is calculated, it is compared against a series of empirically determined threshold values to determine the size of the fabric load under test.

Figure 27:
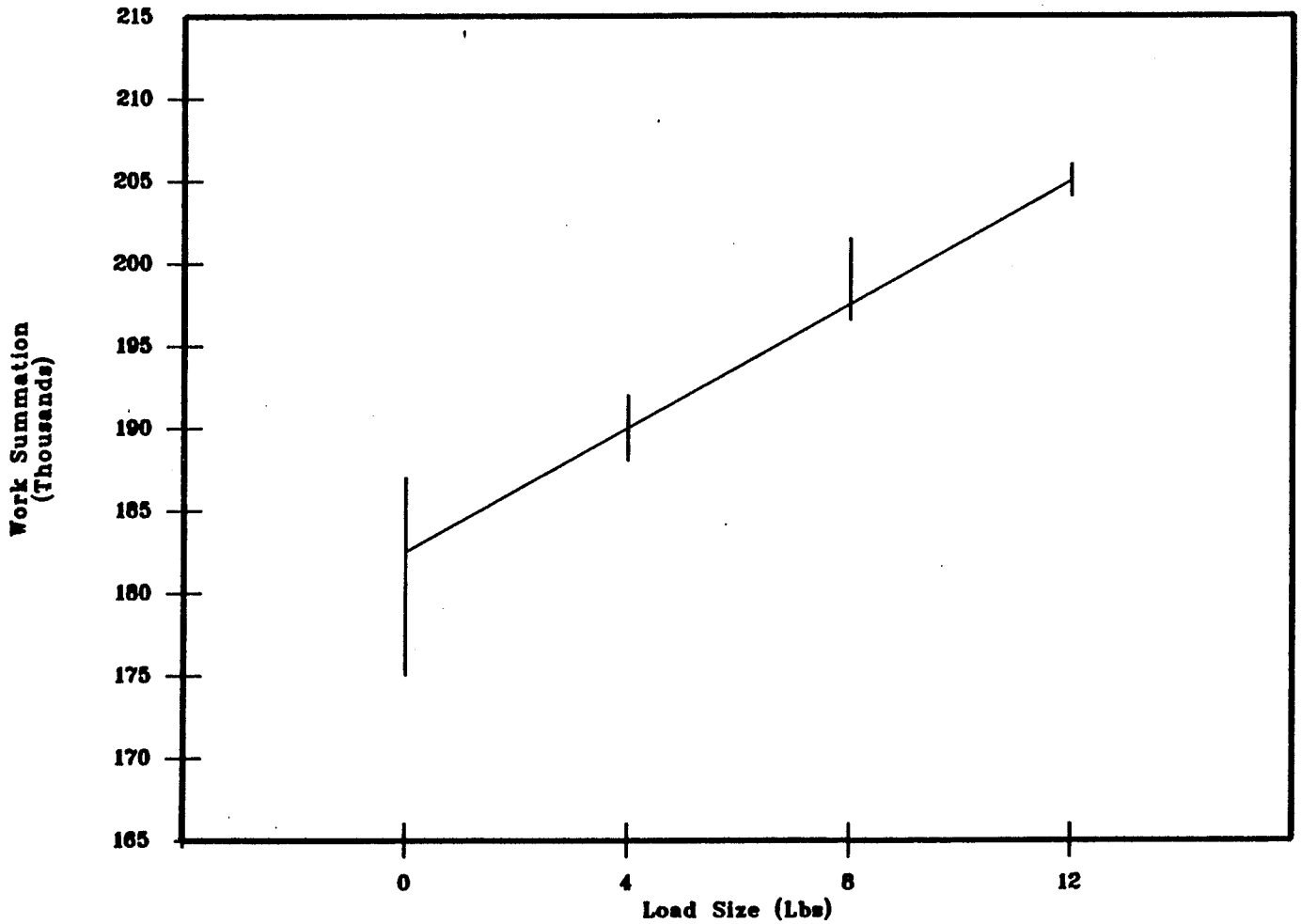
FIG. 27 is a graph depicting the work required to rotate the basket a fixed distance.

Values for the work summation were obtained from runs with predetermined reference loads and used to develop FIG. 27. When a curve is drawn between average values for the 0, 4, 8 and 12 lb reference cases, the relationship between total work and load size is seen to be linear.

Figure 28:
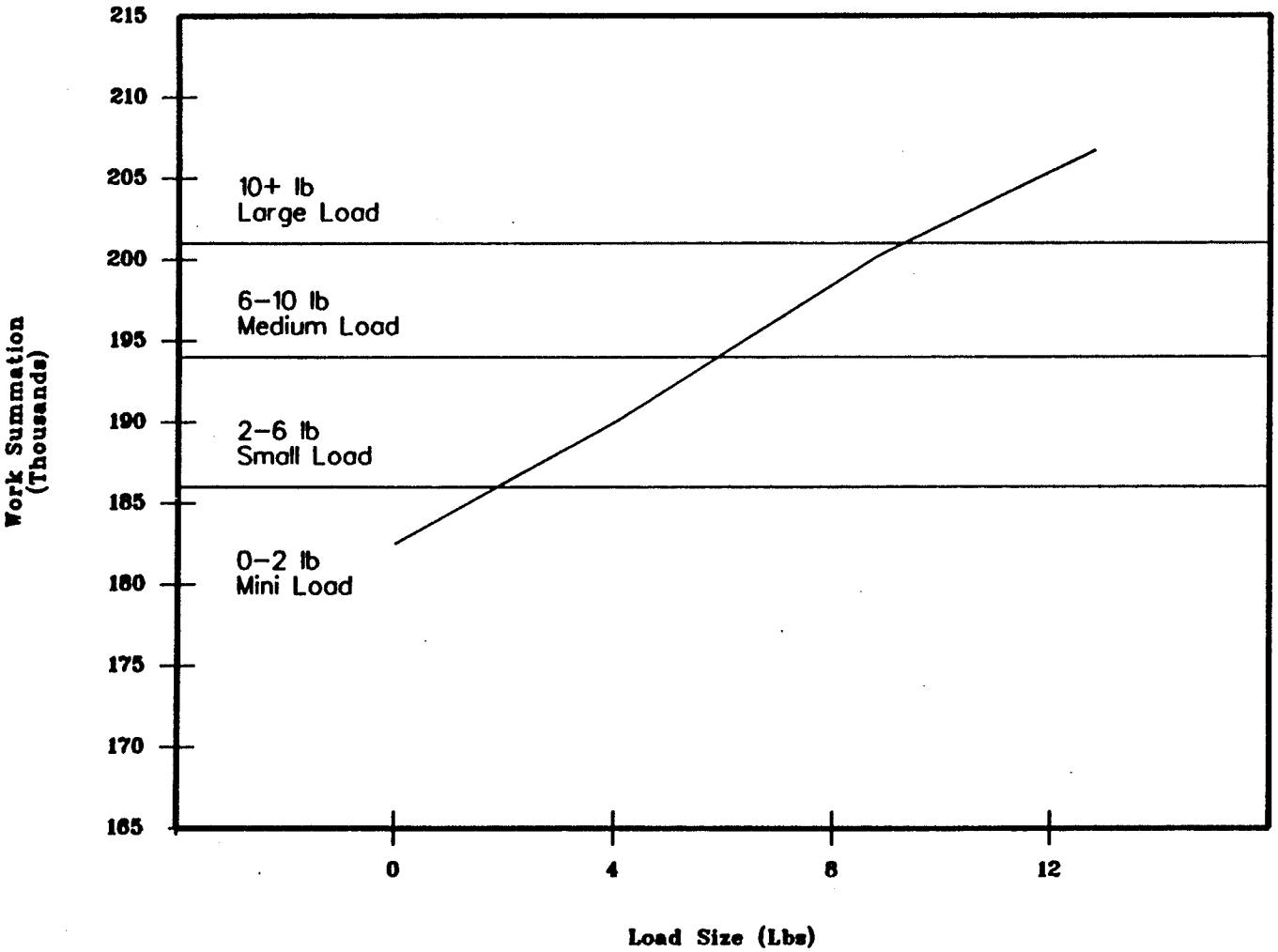
FIG. 28 is a graph depicting the work regions for different sized loads in the logic control.

FIG. 28 details the cutoff points used to determine the size of a load of fabrics in a machine as shown in FIG. 1. The curve in FIG. 28 is divided into 4 distinct regions. These regions correspond to load sizes of 0–2 lbs (mini), 2–6 lbs (small), 6–10 lbs (medium), and 10+ lbs (large). When the work summation falls into a particular range, the load is classified as belonging to that range.

The blend determination begins by measuring the torque needed to agitate the load of clothes in the basket under fixed conditions. More particularly, the load is agitated without any water being added, then predetermined small amounts of water are added to the basket and the basket is oscillated after each addition. As water is added, the torque begins to increase as a function of water level, dry mass and blend of fibers. For a given dry mass and water level, this increase of torque varies in accordance with the percentages of cotton and synthetic fibers in the load. In the illustrative embodiment the water level in the tub is increased three gallons at a time, and a quantity representative to the average torque required during the subsequent agitation is calculated using torque feedback. Since the load size has been previously determined and the water level is being controlled, the independent variable affecting the torque is the percentage of cotton and synthetic fibers present in the load. Therefore, knowing the dry mass and the required torque, the ratio of cotton to synthetic fiber can be calculated and used to select a waveform appropriate to the load size and blend.

The blend determination begins by measuring the torque needed to agitate the load of dry fabrics. This provides a reference point that is independent of the blend of materials present. An amount of water tailored to the mass of fabrics (based upon the dry mass torque measurement) is added to the container and the agitation operation is repeated. Then an additional amount of water is added to the container and the agitation operation is repeated. Finally, a further amount of water is added an a final agitation operation is carried out. The torque requirement of the motor is measured for each agitation operation. The control sums the torque measurements for the agitation operations with water and divides that sum by the torque measurement for the dry agitation. This provides a torque signal which is normalized for the mass of dry fabrics in the machine. With the illustrative machine the torque measurement is suitably approximated by measuring a predetermined portion of the motor current each time the motor is commutated and summing the current measurements. With machines capable of washing widely varying load sizes it is advantageous to vary both the amount of water introduced and the length (number of strokes) of the agitation operations. A single water program may provide either too little water for a large load or too much water for a small load. With the exemplary machine the initial incremental volume of water varied between 2½ gallons for a mini load of 2 lbs. and 15 gallons for a large load of 12 lbs. The additional incremental volumes were 3 gallons each. Also the length of operation for either a large or a small load may not be best suited for the other. Since the dry mass of the fabrics is determined before the agitation operations, the number of agitation strikes can be varied and does not adversely effect individual determinations as the results are normalized for the size of the load. It will be understood that, for different machines the parameters may vary and can be empirically determined.

This Blend Determination scheme exploits the well understood difference in absorbency between cotton and synthetic fibers. The absorbency is a maximum with a pure cotton load, decreases steadily as the percentage of synthetic fibers increase and reaches a minimum when the load is comprised entirely of synthetic fibers. The difficulty in utilizing this difference to obtain meaningful information has been the absence of a simple way to measure the absorbency of a load. With this invention the absorbency of a load is indirectly determined.

Figure 29:
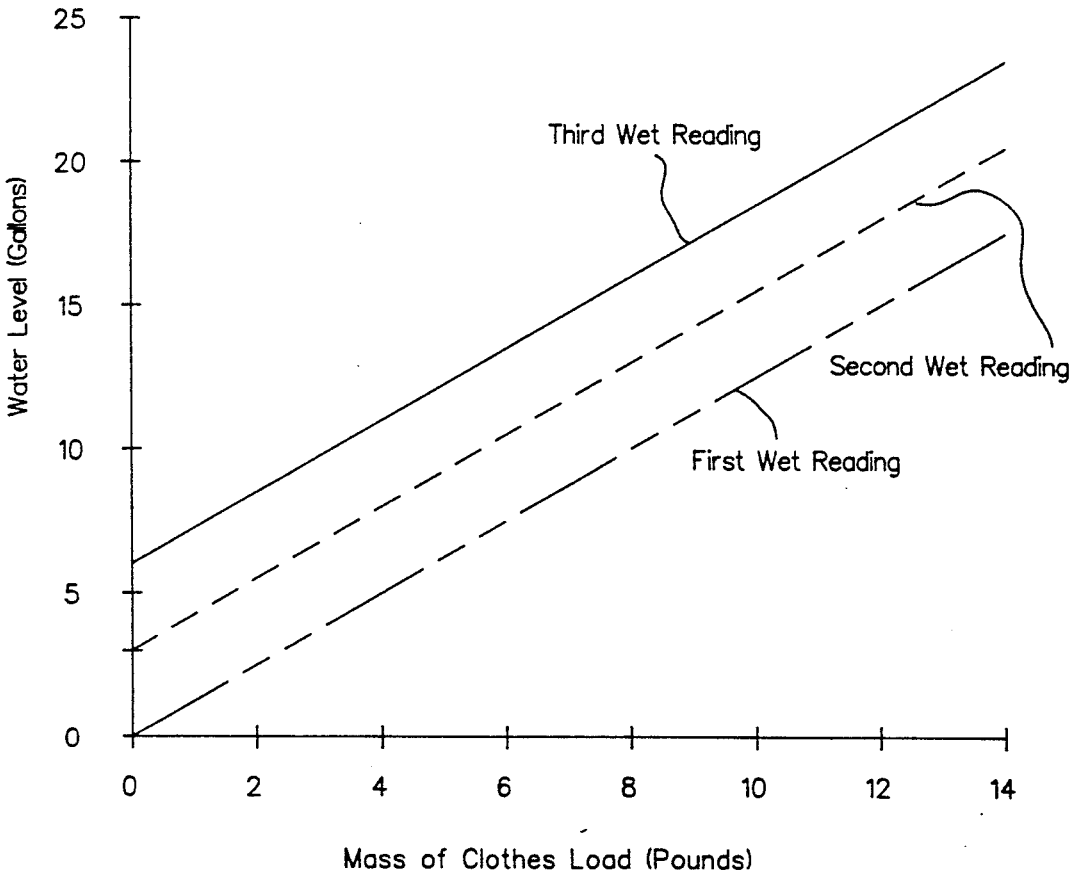
FIG. 29 is a graph depicting a family of curves for determining the water levels for torque readings for different load sizes.

Tests were run at empirically determined water levels detailed in FIG. 29. Tests results for 4, 8, and 12 lb load sizes for 100% cotton, 50% cotton-50% polyester, and 100% polyester loads are detailed in FIG. 30. The data in FIG. 30 illustrates the absorbancy relationship between cotton and polyester fibers. Both types of fibers absorb some base amount of water, but as the percentage of cotton fibers increases, the amount of water absorbed by the fibers increases. As more water is trapped in the fibers, more water may be trapped in the spaces between the fibers. This results in the nonlinear absorption characteristics of the data shown in FIG. 30. The nonlinear absorbancy feature approximates the relationship between the required agitation action and the percentage of cotton fibers in the clothes load. As the percentage of cotton fibers increases, a more energetic agitation action is required for proper cleaning. The reduction of chemical cleaning effectiveness as the cotton fiber percentage increases also mandates an increase in the power requirements for the agitation action as the cotton fiber percentage increases. The net result is the need for greater agitation in the higher cotton percentage blends than in the low cotton percentage blends.

In order to determine the approximate blend of a particular load of fabrics with appropriate accuracy, the exemplification control scheme divides the data of FIG. 30 into three regions for each load size range. The first region is between 100% cotton and 75% cotton-25% polyester; the second region is 75% cotton-25% polyester and 50% cotton-50% polyester; and the third is between 50% cotton-50% polyester and 100% polyester.

The generated signals for any particular laundry load are compared to a group of predetermined values which have been determined to be representative of known reference loads. The number of predetermined values used in the comparison is a matter of choice, taking into account a number of criteria. For example, the greater the number of separate values employed, the closer the machine operation will match the ideal for the particular load size and blend. On the other hand, using more values will use more processor memory and processor time. For purposes of illustration, the exemplification control uses four load size regions; that is, mini (0–2 Lbs), small (2–6 Lbs) medium (6–10 Lbs) and large (10–14 Lbs). The values subsequently used for a load falling in a particular region correspond to the values for the midpoint of that region. That is 1 Lb values for the mini region, 4 Lb values for the small region, 8 Lb values for the medium region and 12 Lb values for the large region. Similarly three regions were chosen for various blend ratios; that is, 0–50% cotton, 50–75% cotton and 75–100% cotton. The values used for each region are the midpoint values; that is, 25% cotton, 62.5% cotton and 87.5% cotton. It will be understood that other ranges and values can be used if desired.

DESCRIPTION OF PREFERRED EMBODIMENTS

Referring now to FIG. 1 there is illustrated a laundry machine or automatic washing machine 10 incorporating one form of the present invention. The washer 10 includes a perforated wash container or clothes basket 11 which has an integral center post 12 and agitation ramp 13. The basket 11 is received in a imperforate tub 23. In operation clothes or other fabrics to be washed and detergent are placed in the basket 11 and water is added to the tub 23. As result of the perforations in the basket 11 the water fills the tub and basket to substantially the same height. The basket is oscillated back and forth about the vertical axis of the center post 12 and the ramp 13 causes the fluid and fabrics to move back and forth within the basket to clean the fabrics. At the end of the agitation operation the standing water in the tub 23 is drained and the basket 11 then is rotated at high speed to centrifugally extract the remaining water from the fabrics. The operation is then repeated without detergent to rinse the fabrics. It will be understood that the ramp 13 is illustrative only and any number of other basket configurations can be used to enhance the agitation of the fabrics. For instance vanes can be formed on the side or bottom walls of the wash container 11, as is well known in the art.

The basket or container 11 is oscillated and rotated by means of an electronically commutated motor (ECM) 14 which includes a stator 14*a* and a rotor 14*b*. The rotor 14*b* is directly and drivingly connected to the basket 11 by suitable means such as shaft 15. To this end, one end of the shaft 15 is connected to the rotor 14*b* and the other end of the shaft is connected to the interior of the center post 12. The basket, tub and motor are supported by a vibration dampening suspension schematically illustrated at 16. The operating components of the washer are contained within a housing generally indicated at 17, which has a top opening selectively closed by a door or lid 18. The housing 17 includes an escutcheon or backsplash 19 which encloses various control components and mounts user input means such as key pads 20 and user output or condition indicating means such as signal lights 21. A portion of the control for the washer may be mounted within the main part of the housing 17 as illustrated by the small box or housing 22 which conveniently can mount drivers and power switch means, such as a transistor bridge, for the ECM 14.

Figure 2:
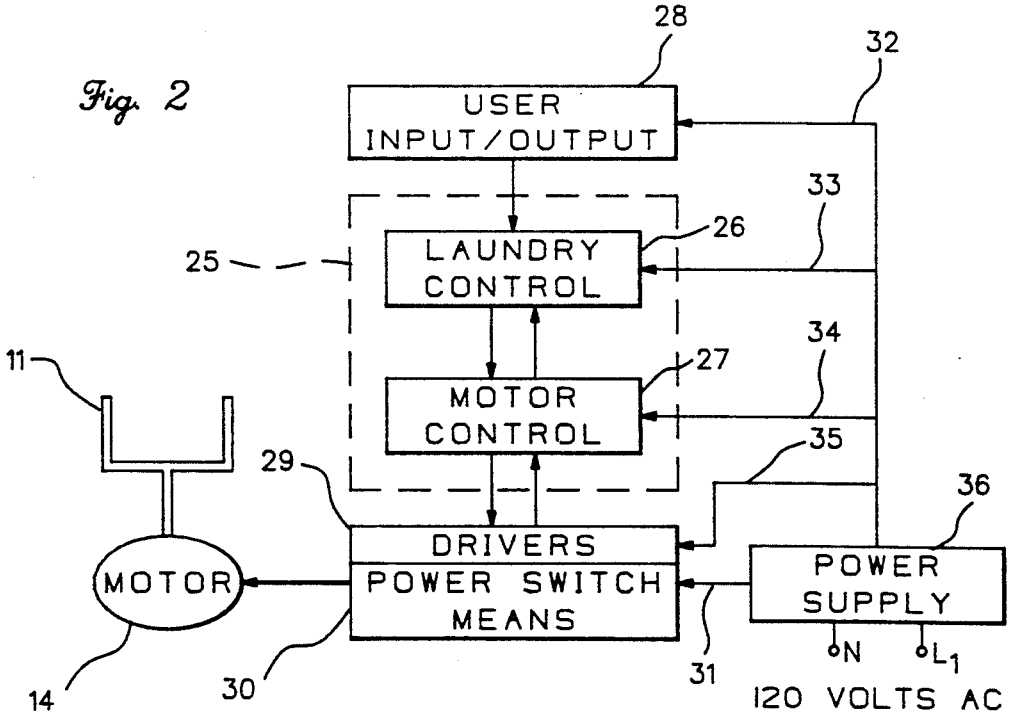
FIG. 2 is a block diagram of an electronic control for the machine of FIG. 1 and incorporating one form of the present invention.

FIG. 2 illustrates, in simplified schematic block diagram form, a washer control incorporating one embodiment of the present invention. An operation control 25 includes a laundry control 26 and a motor control 27. The laundry control 26, as well as its interface with other components such as the user input/outputs 28 and the motor control 27, will be described in more detail hereinafter. A motor control suitable for use with the laundry control 26 is illustrated and described in U.S. Pat. No. 4,959,596 of S. R. MacMinn assigned to General Electric Company assignee of the present invention, which patent is incorporated herein by reference. That patent also illustrates and describes in some detail an appropriate ECM which in this example is of the switched reluctance motor (SRM) variety.

An operation control stores a number of sets of empirically determined wash values which represent instantaneous angular velocities of the rotor of the ECM and thus of the basket 11. The sets of numbers are stored as look up tables in the memory of microprocessor 40 (see FIG. 3). The control calls up the values in a predetermined timed sequence and controls the motor in accordance with the then current or latest called up value to provide a wash stroke of the basket 11. One wash stroke of the basket 11 is one complete oscillation. For example assuming the basket is at a momentary stationary position, one wash stroke includes movement of the basket in a first direction and then return of the basket in the second direction to essentially its original position. A wash cycle or wash operation includes a number of repetitions of the wash stroke to complete the washing or agitation of the fabrics in the detergent solution. A rinse stroke and rinse cycle merely are forms of a wash stroke and wash cycle in which the basket is oscillated about its vertical axis with a load of fabrics and water but with no detergent in order to remove residual detergent left from a previous wash cycle. Each set of values or look up table is tailored to provide optimum operation for fabric loads in a predetermined range of load sizes (weights) and blend (proportion of cotton to synthetic fibers).

The operation control stores, as another look up table, a set of empirically determined spin values representative of instantaneous rotor speeds, calls up these values in a predetermined timed sequence and controls operation of the motor in accordance with the then currently called up value to provide a spin or centrifugal extraction operation of the basket 11. In a spin operation the basket is accelerated to a designated terminal speed and then operated at that terminal speed for a predetermined period of time in order to centrifugally extract fluid from the fabrics in the basket. The terminal speed of the rotor for various load size and blend combinations are stored in the memory and, perhaps except for the largest all cotton load, are less than the terminal speed provided by the spin look up table. The control compares each called up value with the appropriate terminal value and operates the motor in accordance with the value which represents the lower rotor speed. In order to save microprocessor memory space, the look up table may be structured so that its terminal speed is appropriate for the largest all cotton load terminal speed. The other terminal speeds are lower and the mini load, minimum cotton blend has the lowest speed.

In the preferred embodiment, information for the particular set of operations to be performed by the machine preferably is determined by a preliminary operation of the machine. First, the control operates the machine with a dry load of fabrics and takes measurements from which it generates a signal representative of the size (weight or mass) of the fabric load. The control compares this signal with values representative of predetermined ranges of load sizes and determines the load size range in which the load falls. Subsequently, the control operates the machine using the set of empirically determined values corresponding to that load size range. In order both to provide machine operations appropriate for each load size and to conserve microprocessor memory space and operating time, the exemplification control utilizes four load size regions; that is 0–2 lbs, 2–6 lbs, 6–10 lbs and 10–14 lbs. The individual values in the sets of empirically determined values are optimized for the mid-points of each region; that is, 1 lb, 4 lbs, 8 lbs and 12 lbs. Such values provide good results for any actual load size in the corresponding region.

The control then agitates the dry fabrics, causes water to be added to the machine in incremental amounts, agitates the fabrics and water after each addition of water and takes measurements from which it generates a signal representative of the blend of fibers in the load (that is, the percentage of cotton vis-a-vis the percentage of synthetic fiber fabrics). The control compares this signal with values representative of predetermined ranges of blends for the size of that particular load of fabrics. Subsequently, the control operates the machine using the set of empirically determined values (look up table) corresponding to a load of that size and that blend. In a manner similar to the load size ranges, the illustrative control uses three blend ranges, that is 0–50% cotton, 50–75% cotton and 75–100% cotton. The individual values in the sets of empirically determined values are optimized for the mid-points of each range; that is, 25% cotton, 62.5% cotton and 87.5% cotton. Such values provide good results for any actual blend in the corresponding region.

Thus, the illustrative control includes twelve separate sets of empirically determined values or look up tables; that is, a separate microprocessor commercially available from Intel Corporation. The microprocessor 40 has been customized by permanently configuring its read only memory (ROM) to implement the control scheme of the present invention. Microprocessor 40 is connected to a conventional decode logic circuit 41 which is interconnected with other components to provide the appropriate decode logic to such components, as illustrated by the thin lines and arrows. As indicated by the wide arrows labeled DATA, microprocessor 40 interfaces with various other components to transfer data back and forth. Microprocessor 40 controls washer functions such as valve solenoid operation and pump operation via the Washer Functions block 42.

The keypads 20 in the washer backsplash are in the form of a conventional tactile touch type entry keypad matrix and keypad encoder 43 which, in the illustrative control, are a 4×5 matrix keypad and a 20 key encoder respectively.

Figure 3:
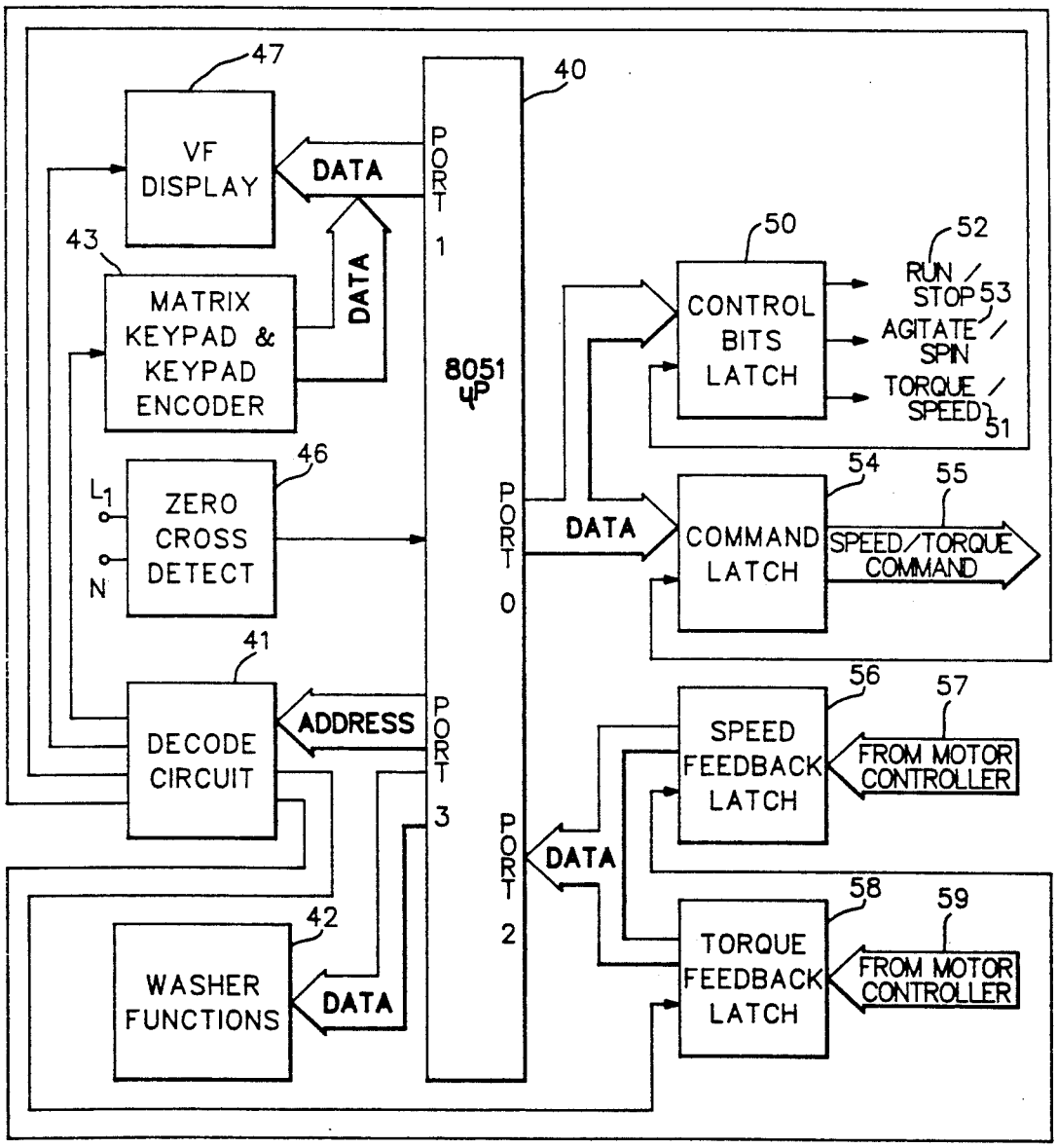
FIG. 3 is a simplified schematic diagram of a control circuit illustratively embodying a laundry control system in accordance with one form of the present invention as incorporated in the control illustrated in FIG. 2.

For purposes of illustration, the machine of FIG. 1 and control circuit of FIG. 3 have been illustrated with several user input keypads, as would be the case in a fully featured washer which provides the user the option of inputting data such as load size and blend or having the machine automatically determine these values. A machine which always automatically determines the load size and blend would need fewer keypads. Similarly, in the subsequent description of the program executed by the control, various references to the status of keypads use the term keypad in a general sense. When the machine is set to automatically determine the load size and blend, the value referenced by a particular keypad is automatically determined. If more manual input is involved, the value may be selected by the user operating the keypad.

As will be more fully described hereinafter, sequencing of the microprocessor is timed by sensing the zero crossings of the alternating current input power. To this end the input of a conventional zero table for each of the three blends for each of the four load sizes. It will be understood that other ranges and other numbers of ranges can be utilized. Also less fully featured fabric washing machines may incorporate a more limited array of the various aspects of this invention. For example, one such control could merely determine the load size and permit the user to input the blend data. On the other hand, another such control could permit the user to input the load size data and then determine the blend.

Any user information for the particular operation the machine is to perform is inputted by user input/output means indicated by box 28 (FIG. 2) and which conveniently may include touch pads or keypads 20 for input and signal lights 21 (FIG. 1) for output for example. Keypads 20 also can be used to select a water level (if it is desired to select the water level independent of the load size determination) and the water temperature, for example. The signal lights 21 are selectively activated by the control 25 so that the user is able to determine the operational condition of the machine. The output from the motor control 27 goes to drivers 29 and power switch means (such as a power transistor circuit) 30 which, in turn, supplies power to the motor 14. A conventional power supply generally indicated at 36 is connected to the normal 120 volt, 60 hertz domestic electric power. The power supply provides 155 volt rectified DC power to the power switch means through line 31 and 5 volt DC control power to the other components through lines 32, 33, 34 and 35, respectively.

FIG. 3 schematically illustrates an embodiment of a laundry control circuit 26 for the automatic washing machine of FIG. 1. The circuit in FIG. 3, and the related flow diagrams to be described hereinafter, have been somewhat simplified for ease of understanding. In the system of the present invention, control is provided electronically by a microprocessor 40 which, in the illustrative control, is an 8051 crossing detection circuit 46 is connected to the input power lines ($L_1$ and N) and the output of the circuit 46 is connected to the microprocessor 40. The particular zero cross detection circuit used in the exemplification embodiment provides a signal pulse for each positive going crossing and each negative going crossing of the input power. Thus the microprocessor receives a timing signal once each half cycle of alternating current or approximately once each 8.33 milliseconds with a 60 hertz power signal.

The display lights 22 are contained in a VF display 47. The decode logic for display 47 is provided from the decode circuit 41 and data is provided from Port 1 of the microprocessor 40. Thus individual ones of lights 21 will be illuminated as called for by the program executed by the microprocessor. A control bits latch 50 is connected to Port 0 of the microprocessor 40 and includes outlet ports connected to three output lines 51, 52 and 53. Thus, in accordance with the program executed by the microprocessor, the control bits latch provides run and stop signals to the motor control 27 through the output line 52, torque and speed signals to the motor control through output line 51 and agitation and spin control signals to the motor control through output line 53. A command latch 54 provides 8-bit digital speed and torque commands to the motor control through output bus 55. Data is written to the command latch via Port 0 of the microprocessor 40 and the decode signal is provided by the decode circuit 41. Feedback latches 56 and 58 are used to hold 8-bit digital speed and torque feedback data received via buses 57 and 59 from the motor controller. The outputs from the speed feedback latch 56 and the torque feedback latch 58 are controlled by the decode logic 41 and are connected to Port 2 of the microprocessor 40.

The speed feedback line 57 transmits 8 bit data from the motor control that is representative of the instantaneous angular velocity of rotor and thus the basket. The speed feedback data is calculated inside the motor control circuit 27 by measuring the time interval between stator commutations. This operation is described in the previously mentioned U.S. Pat. No. 4,959,596-McMinn.

The motor control is capable of energizing the motor so that both clockwise and counterclockwise motions are produced. During the agitation mode, the motor control is capable of energizing the motor to produce up to 150 rpm in each of the clockwise and counterclockwise directions. During the spin mode, the motor control is capable of energizing the motor to produce up to 600 rpm in both the clockwise and counterclockwise directions. The feedback from the motor control to the laundry control is comprised of 8 digital bits; the maximum range is from 00 hexadecimal to FF hexadecimal. The highest clockwise rotational velocity for both the agitate and spin modes has been assigned to the hexadecimal value FF. The highest counterclockwise rotational velocity for both the agitate and spin modes has been assigned to the hexadecimal value 00. The values between hexadecimal 00 and hexadecimal FF have been assigned in a linear fashion to the velocity values between 150 rpm counterclockwise and 150 rpm clockwise in the agitate mode and to the velocity values between 600 rpm counterclockwise and 600 rpm clockwise in the spin mode. In both the agitate and spin modes, the 0 rpm case occurs at hexadecimal 80.

The torque feedback bus 59 transmits 8 bit data from the motor control that is representative of the instantaneous motor torque. The torque feedback is calculated within the motor control circuit 27 by measuring the on time for the modulation circuit controlling the motor current. Since the motor torque is proportional to the current within the motor windings, measuring the on-time of the modulation circuit 27 provides a signal proportional to torque. As the percentage on time approaches 100%, the motor output approaches the maximum rated torque. This maximum rated torque is dependent upon which mode, agitate or spin, the motor control is operating, and the maximum allowed current. In the illustrative embodiment, the motor control permits a maximum of 55 Newton meters in agitate and 5 Newton meters in spin.

The motor control is capable of energizing the motor windings in a manner to produce either counterclockwise (CCW) or clockwise (CW) torque. The torque feedback is comprised of 8 bits with a combined value ranging from hexadecimal 00 (0) to hexadecimal FF (255). The torque values have been assigned in a linear fashion from highest CCW torque represented by hexadecimal 00 through 0 torque represented by hexadecimal 80 and to the highest CW torque represented by hexadecimal FF.

Figure 4:
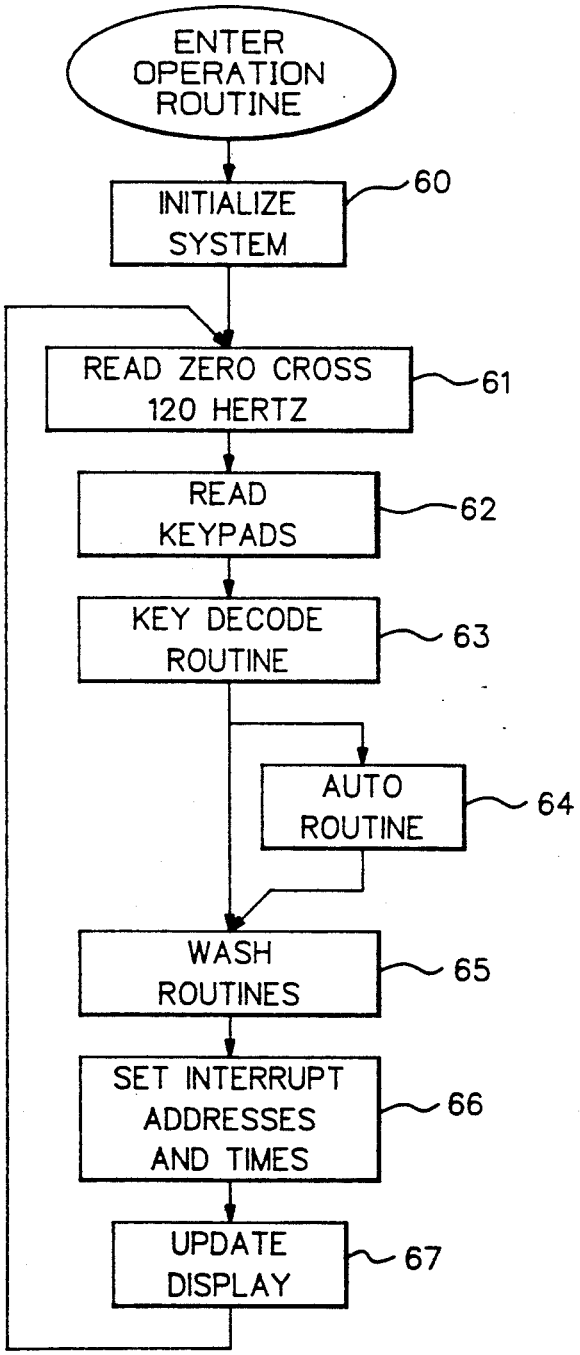
FIG. 4 is a simplified flow diagram of the Control program for the microprocessor in the circuit of FIG. 3.

FIGS. 4–20 illustrate various routines performed by the laundry control for a complete washing operation in accordance with one embodiment of the present invention and in which both the load size and blend are automatically determined by operation of the machine. FIG. 4 illustrates the overall operation of the control system generally as follows. When the control is first turned on, the system is initialized (block 60) as is well known with microprocessor controls. Then (block 61) the control reads the zero crossing of the 60 hertz power supply. That is, the control waits until the zero crossing detector 46 indicates that the power supply voltage has again crossed zero voltage. Thereafter, the control reads the keypads (block 62). That is, the internal flag and internal register of the keypad encoder are read. At block 63 the data from the keypad encoder is decoded to determine which keypads have been actuated. If the washer has been placed into the automatic mode, the control then branches to the Auto routine (block 64); otherwise, the control continues to the Wash routines (block 65). Upon completion of the Auto routine (block 64), the control continues to the Wash routines (block 65). At block 66 the addresses and the control times for laundry control 26 are set for the interrupt routine. At block 67 the VF display 47 is updated. Thereafter the control returns to block 61 and waits for the next zero crossing of the 60 hertz input power signal. When the signal again crosses zero, the operation routine is repeated.

As previously explained, laundry control 26 stores a number of sets of empirically determined values representative of particular angular speeds of the rotor **14*b* of ECM 14, calls up individual values from a selected set in a predetermined timed sequence and operates the motor in accordance with the then currently called up value to provide a wash stroke to the basket 11**. In the illustrative machine and control there are twelve sets of values or look up tables; which, for reference purposes are referred to as a 87.5% cotton mini load set, a 62.5% cotton mini load set, a 25% cotton mini load set; a 87.5% cotton small load set, a 62.5% cotton small load set, a 25% cotton small load set; a 87.5% cotton medium load set, a 62.5% cotton medium load set, a 25% cotton medium load set; a 87.5% cotton large load set, a 62.5% cotton medium load set, and a 25% cotton large load set. Each set of values is chosen to have 256 individual values for the sake of convenience and ease of operation as 256 ($2^8$) is a number easily manipulated by microprocessors.

In addition, the microprocessor memory storing the individual sets of values is addressed 256 times for a single stroke, as will be explained in more detail hereafter. As will be noted by reference to FIG. 24, the wash stroke for an exemplification 87.5% cotton large load wave form takes only approximately 1.2 seconds. Within that 1.2 seconds the memory in the microprocessor is interrogated and a corresponding speed control signal is sent to the motor control by the command latch 256 times. Thus it will be seen that the motor speed control signals are generated at a very high rate in comparison to the 8.33 millisecond period of the overall operation routine.

Figure 5:
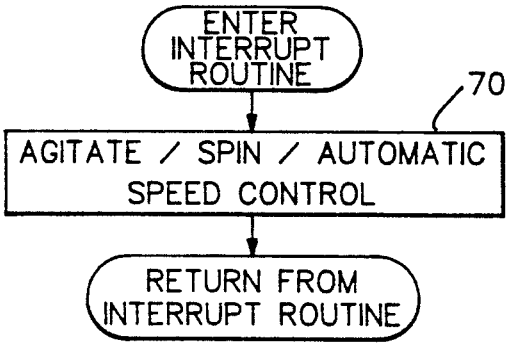
FIG. 5 is a simplified flow diagram of the Interrupt routine incorporated in the control program of FIG. 4.

As illustrated in FIG. 5, when it is time to send a new speed control signal to the motor control, an Interrupt routine interrupts the Operation routine, generates and transmits the speed control signal, as indicated at block 70, and then returns from the Interrupt routine back to the overall Operation routine. The time between successive entries of the Interrupt routine determines the frequency of call ups of numbers or values which define the frequency of the agitation stroke and the acceleration of the spin speed respectively. If the machine is in the wash (agitate) mode, the control selects the appropriate agitate look up table for the particular load size and blend combination, calls up the next successive value in that table and transmits that value to the command latch 54. If the machine is in the spin mode, the control selects the spin look up table, calls up the next successive value in that table, compares the called up value to the terminal speed value for that load and blend and transmits the appropriate value to the command latch 54. If the machine is in the automatic mode, the control executes the action dictated by the active phase of the automatic mode, which operation will be described in more detail hereinafter.

Figure 6:
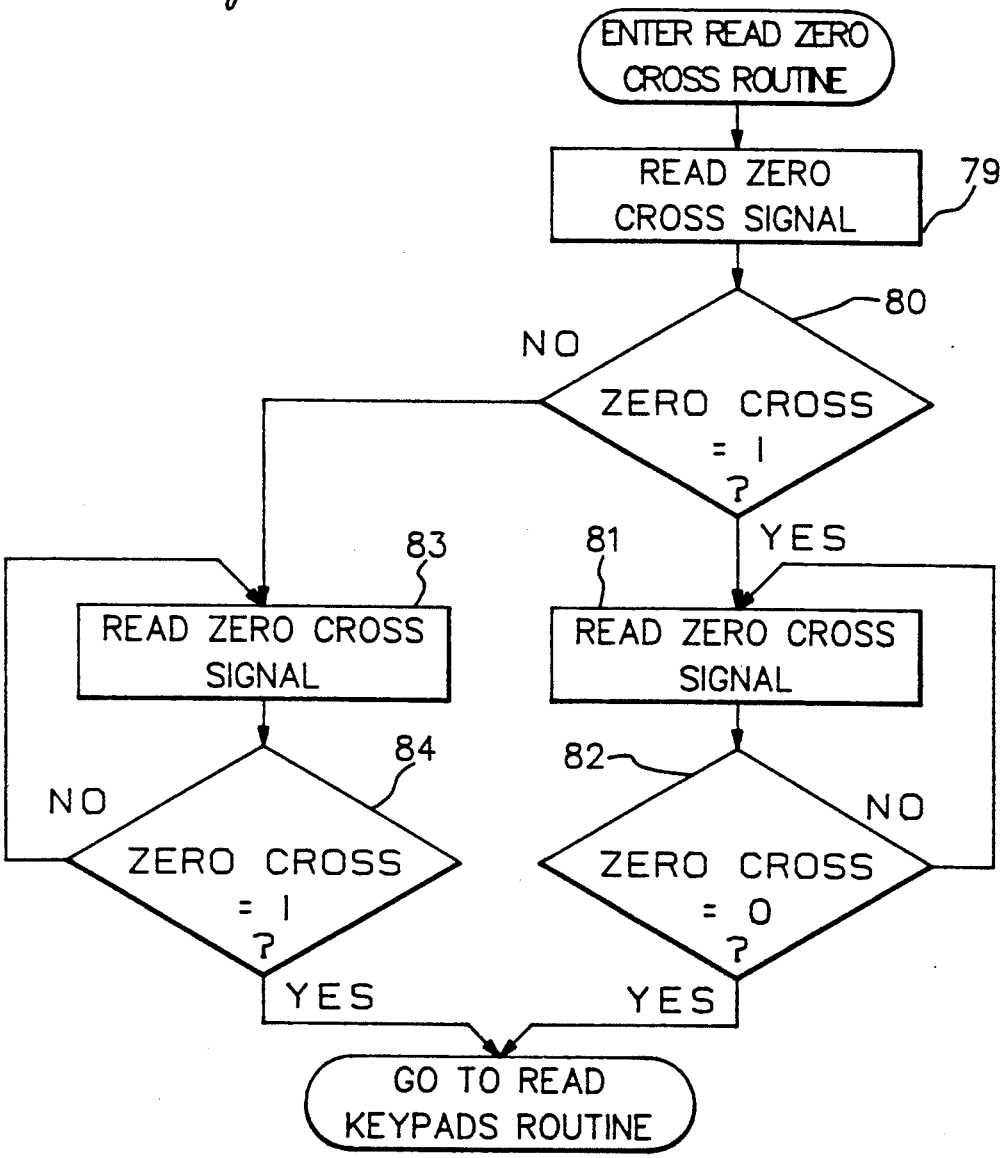
FIG. 6 is a simplified flow diagram of the Read Zero Cross routine incorporated in the control program of FIG. 4.

FIG. 6 illustrates the Read Zero Cross routine of block 61 (FIG. 4). When the Read Zero Cross routine is entered, the output of the zero cross detection circuit is read by the microprocessor 40 via Port 3. If the power line signal is in a positive phase of its waveform, the output of zero cross detector 46 (designated ZCROSS) is a logic 1. If the power line signal is in a negative phase, ZCROSS is a logic 0. After inputting the zero cross signal, the control reads the value of ZCROSS (block 79) and determines the logic state of ZCROSS (block 80). If ZCROSS is logic 1, the zero cross signal is continually read (block 81) until it is determined that ZCROSS equals logic 0 (block 82). The change from logic 1 to logic 0 signals that the power supply voltage has crossed zero and the control goes to the Read Keyboard routine. If, at block 80, it is determined that ZCROSS is logic 0, the control continuously reads the zero cross signal (block 83) until it determines that ZCROSS equals logic 1 (block 84). This also signals a zero crossing or transition of the input power, and the control goes to the Read Keyboard routine. The Read Zero Cross routine thus assures that the Read Keyboard routine begins in accordance with a zero crossing or transition of the input power signal on lines L and N, which synchronizes the timing of the entire control.

Figure 7:
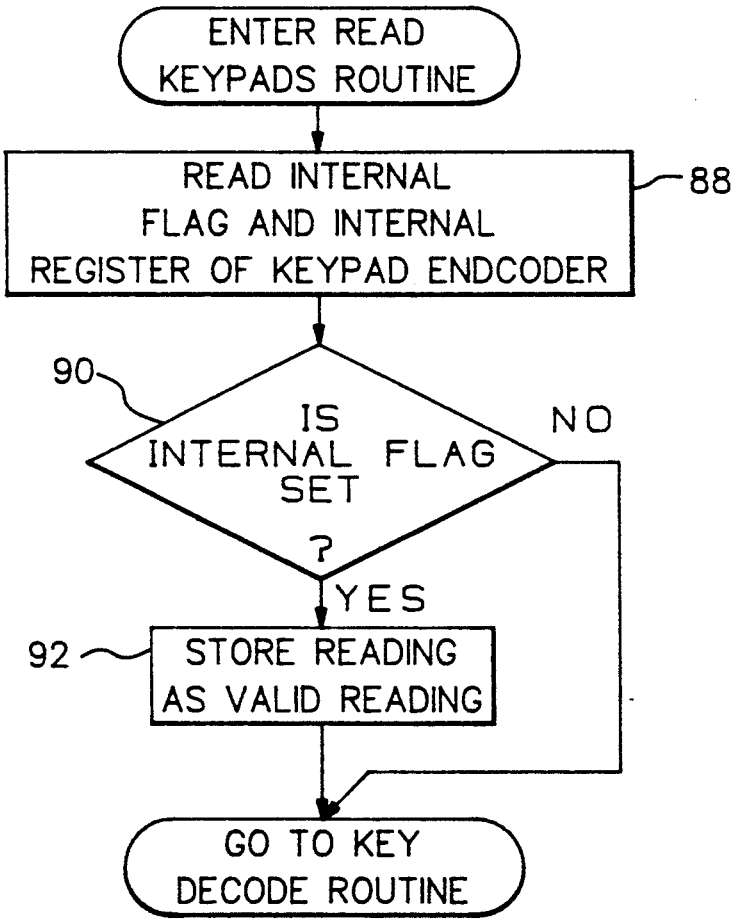
FIG. 7 is a simplified flow diagram of the Read Keypads routine incorporated in the control program of FIG. 4.

In the Read Keypads routine, illustrated in FIG. 7, the control determines the status of the keypad by reading (block 88) the internal flag and internal register of the keypad encoder. At block 90 the control determines if a key is being pressed by the status of the internal flag of the keypad encoder. If this flag is not set, there is no keypad pressed and control passes to the Key Decode routine. If the flag is set, the control stores the data obtained from the internal register of the keypad encoder as Valid Reading (block 92). The control then continues with the Key Decode routine. At the same time the keypads are read and as part of the same routine the automatically determined values are retrieved from memory.

Figure 8:
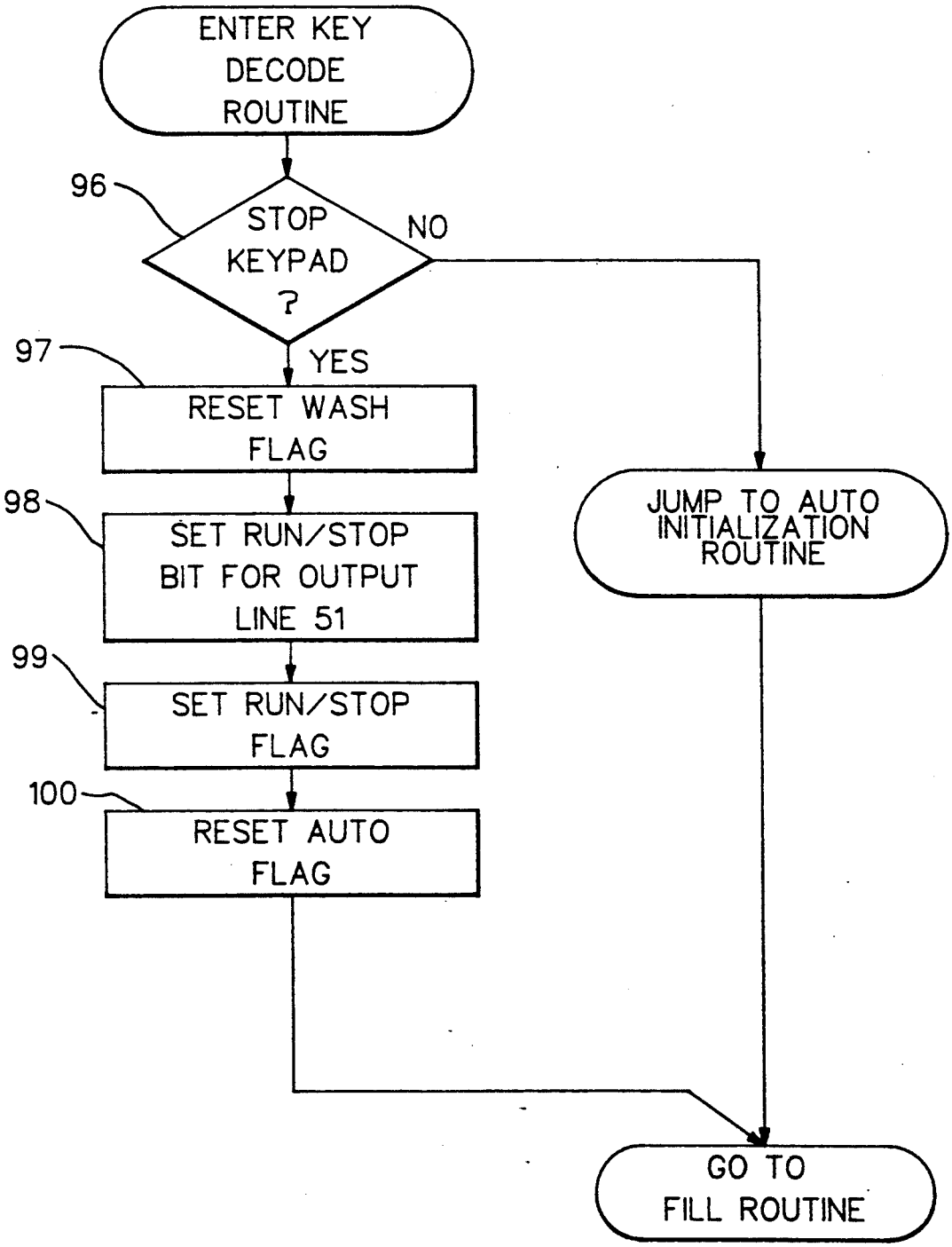
FIG. 8 is a simplified flow diagram of the Key Decode routine incorporated in the Control program of FIG. 4.
Figure 9:
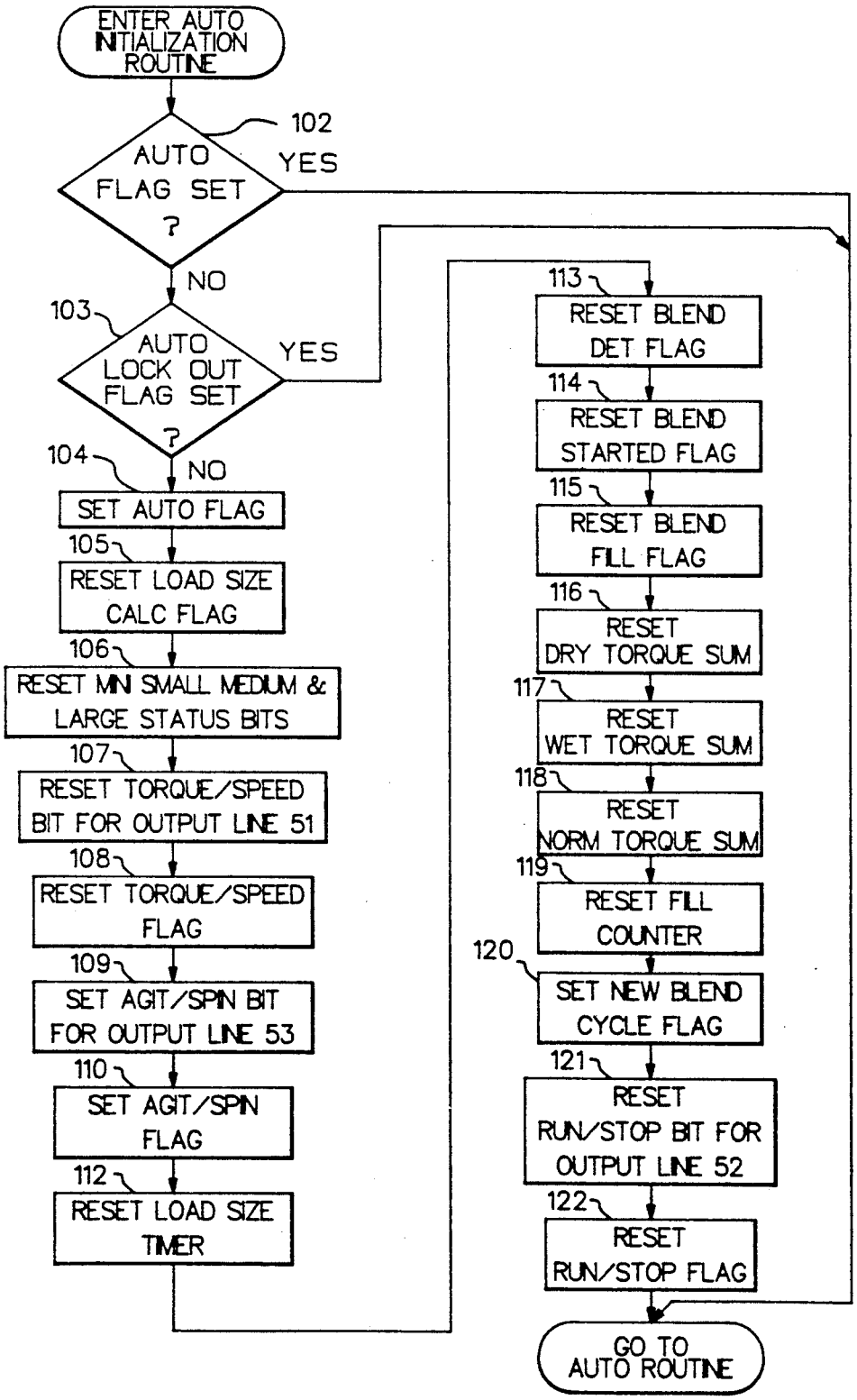
FIG. 9 is a simplified flow diagram of the Auto Key Decode routine for velocity based load size determination incorporated in the flow diagram of FIG. 8.

The Key Decode routine is illustrated in FIGS. 8, 9 (velocity based load size determination) and 10 (work based load size determination). The Key Decode routine is entered in FIG. 8 at inquiry 96 which determines whether the stop keypad is set. The stop keypad may be set in a number of ways. For example, a clock built into the microprocessor or a separate timer will set the stop flag when a cycle of operation has been completed. Many machines have switches which automatically de-energize the machine if the lid is lifted during a spin operation. Such a switch would set the stop keypad. Also if desired, one of the keypads 20 may be utilized as a stop keypad to provide the user with a manual means for stopping operation of the machine. In any event, when the stop keypad is set the machine is de energized. Therefore, when the answer to inquiry 96 is yes the wash flag is reset at block 97, the run/stop bit for output line 52 is set at block 98, the run/stop flag is set at block 99, the auto flag is reset at block 100 and the program proceeds to the Fill routine. Setting the run/stop bit at block 98 sends a signal from the laundry control 26 to the motor control 27 which de-energizes the motor 14.

It should be noted at this point that, in the various routines described herein, "set" corresponds to the related component being energized or activated and "reset" corresponds to the component being de-energized or de-activated. One exception is the run/stop bit for output line 52. When this bit is "set" the motor is de-energized and when it is "reset" the motor is energized for convenience in relating the present description to that of U.S. Pat. No. 4,959,596 which uses a protocol in which set means de-energized and reset means energized.

Figure 15:
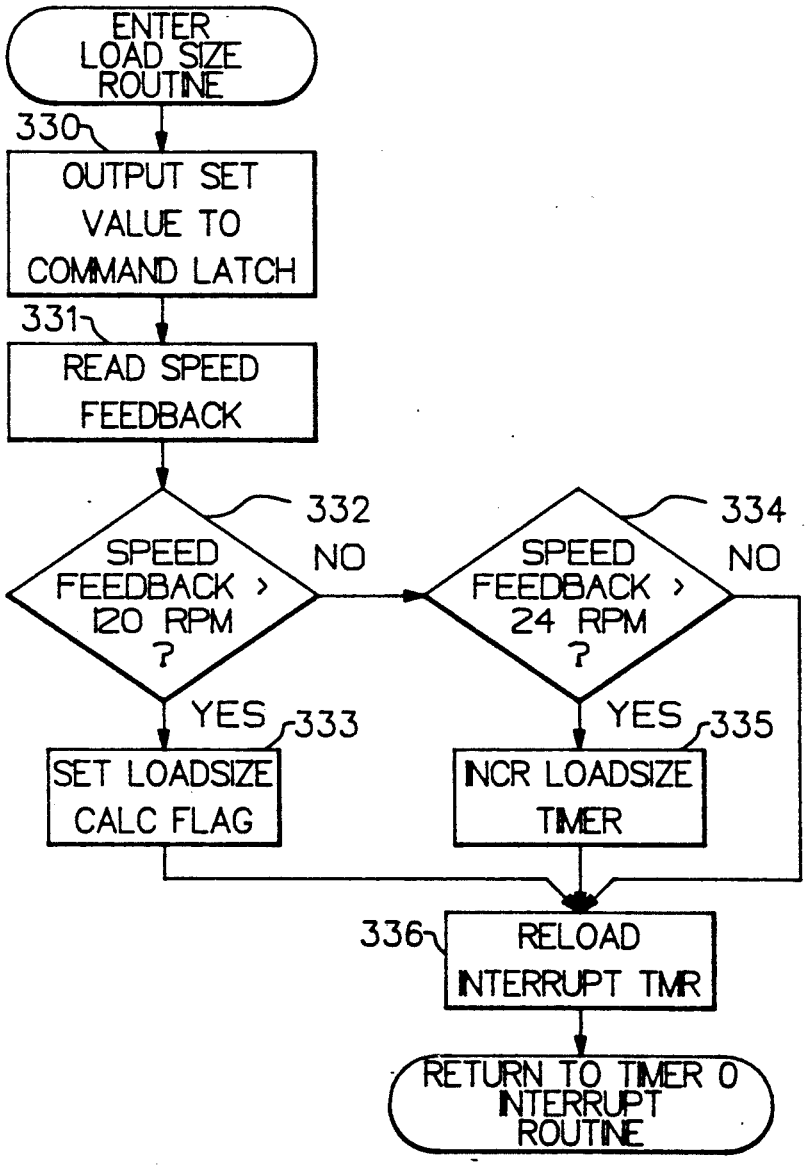
FIG. 15 is a simplified flow diagram of the Velocity Based Load Size routine incorporated in the control program of FIG. 4.

As previously discussed, in the preferred embodiments, the load size can be calculated using either a velocity based or a work based determination. It will be understood that a particular control will be programmed to carry out one or the other of the methods. FIGS. 9 and 15 relate to a velocity based determination while FIGS. 10 and 17 relate to a work based determination. Assuming for the purpose of illustration that the control has been programmed to use a velocity based determination, the Auto Initialization routine is entered in FIG. 9.

Figure 11A:
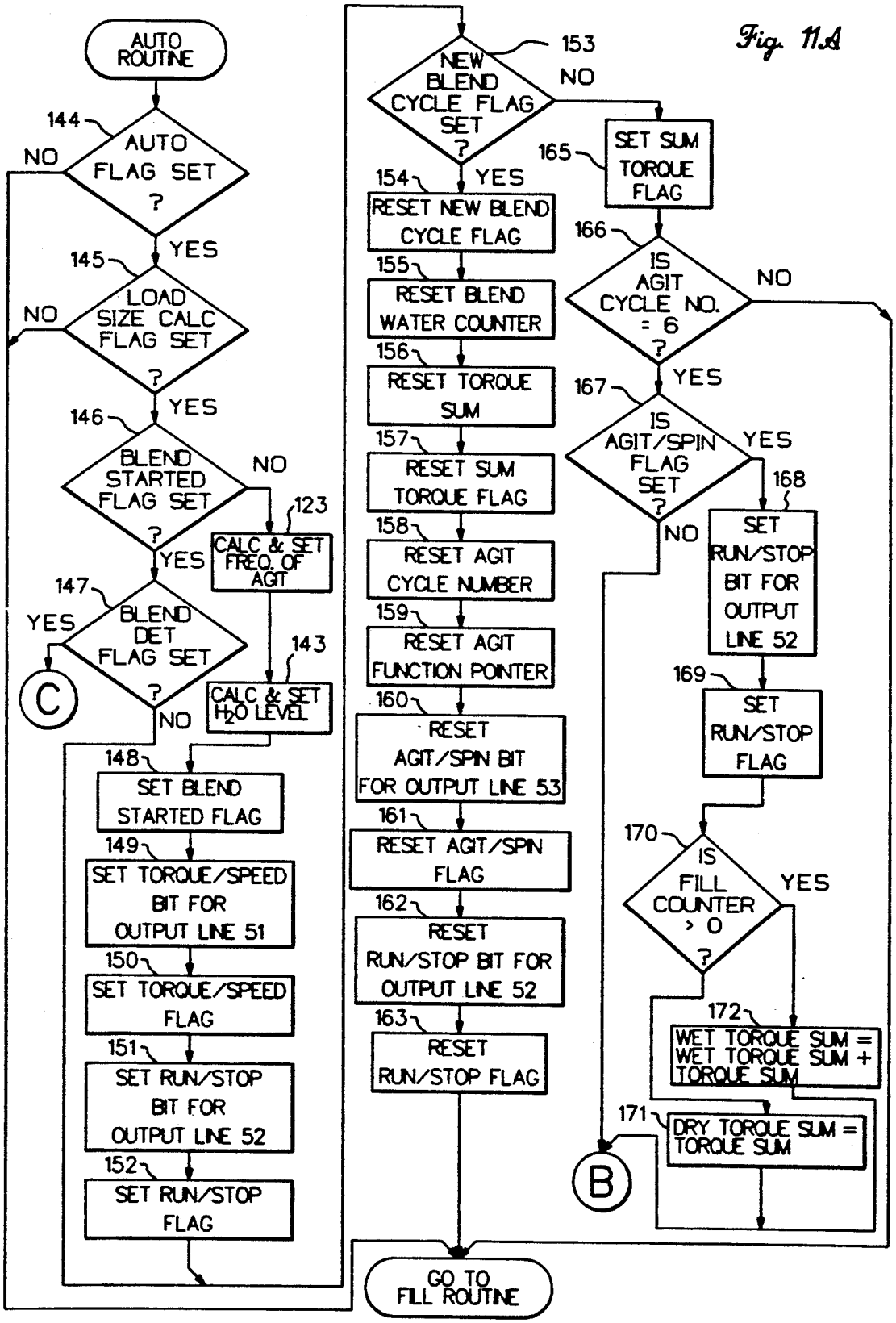

The status of the auto flag is used to determine (inquiry 102) if the control has executed the initialization code for the Auto routine. If the auto flag is set, the control branches to the Auto routine (FIG. 11A). If the auto flag is not set, the control executes the Auto Initialization routine. Block 103 determines if the auto lock out flag is set. This flag prevents the reinitialization and restart of the Auto routine after water has been added to the system. If the auto lock out flag is set, the control branches to the Auto routine. If the auto lock out flag is not set, the control continues the Auto Initialization routine. Block 104 sets the auto flag to indicate Auto Initialization has occurred. (At the subsequent passes through this routine the answer to inquiry 102 will be Yes and the program will branch directly to the Auto routine.) Block 105 resets the loadsize calc flag. The four load size status flags (mini, small, medium and large) are reset at block 106. The torque/speed bit for output line 51 is reset at block 107, and the torque/speed flag is reset at block 108 to enable the motor to function in a torque driven mode as opposed to a speed driven mode. The agit/spin bit for output line 53 is set at block 109 and the agit/spin flag is set at block 110 to enable the control to operate the motor in a spin mode. The load size timer, used in calculating the time required in the load size test, is reset at block 112.

The blend det flag, used to signal the completion of the blend determination process, is reset at block 113. The blend started flag, used to initialize the blend routine after the completion of the load size routine, is reset at block 114. Block 115 resets the blend fill flag, which is used to indicate that the machine is in a fill cycle required by the blend determination routine. The dry torque sum register, used to hold the torque sum resulting from a dry agitation, the wet torque sum register, used to hold the summation of torque sums determined at different water levels, and the norm torque sum, used to normalize the wet torque sum with respect to the dry torque sum, are reset at blocks 116, 117, and 118 respectively. The fill counter, used to maintain a value representative of the volume of water added to the system, is reset at block 119. The new blend cycle flag, used for reinitialization of portions of the blend determination routine between blend cycles, is reset at block 120. A blend cycle differs from an agitation cycle; an agitation cycle is one complete oscillation of the basket assembly, and a blend cycle is comprised of 6 complete agitation cycles. The run/stop bit for output line 52 is reset at block 121 and the run/stop flag is reset at block 122 to enable the control to start the motor. Control then continues with the Auto routine.

Figure 10:
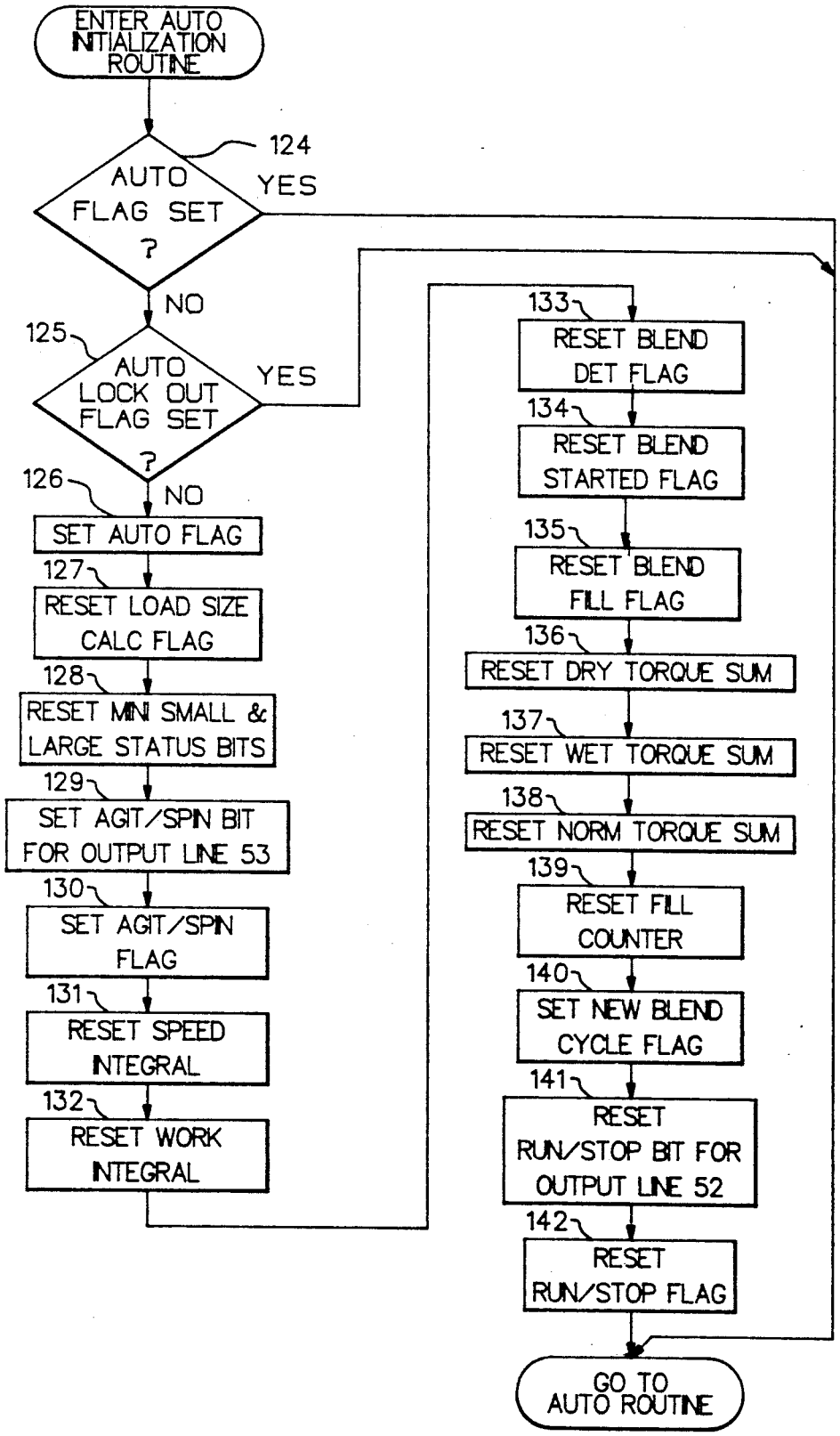
FIG. 10 is a simplified flow diagram of the Auto Key Decode routine for work based load size determination incorporated in the flow diagram of FIG. 8.

If the work based method of load size determination is utilized, then the routine of FIG. 10 is used instead of the routine of FIG. 9 for the Auto Initialization routine. Blocks 124 through 142 of FIG. 10 correspond to blocks 102 through 122 of FIG. 9 for the Auto Initialization routine for velocity based load size determination. The work based load size algorithm utilizes a speed driven action, rather than the torque driven action of the velocity based load size determination. Therefore, FIG. 10 does not include blocks corresponding to blocks 107 and 108 of FIG. 9. The work based load size algorithm utilizes two integrals, the work integral and the speed integral, and does not require the use of a loadsize timer. The two integrals are reset in blocks 131 and 132 and there is no block corresponding to block 112 of FIG. 9.

From the Auto Initialization routine, the program proceeds to the Auto routine as shown in FIGS. 11A–11F. The Auto routine is entered at inquiry 144 which determines if the auto flag is set. If the auto flag is not set, it indicates that the Auto routine has been completed and the control then branches to the Fill routine. If the auto flag is set, inquiry 145 determines if the loadsize calc flag is set. If the loadsize calc flag is not set, the program branches to the Fill routine. If the loadsize calc flag is set, indicating the completion of the loadsize determination algorithm, be it velocity based loadsize or work based loadsize, the status of the blend started flag is checked at inquiry 146. If the blend started flag is not set, the program has not completed the post-loadsize determination initialization for the Blend Determination routine and the program branches to block 123 where the frequency of the agitation waveform is calculated and set. The water level is calculated and set at block 143 and the blend started flag is set at block 148. The torque/speed bit for output line 51 is set at block 149 and the torque/speed flag is set at block 150 to enable the control to run the motor in the speed based mode. The run/stop bit for output line 52 is set at block 151, and the run/stop flag is set at block 152 to enable the control to stop the motor. The program then branches to inquiry 153. Returning to inquiry 146, if it is determined that the blend started flag is set, the program branches to inquiry 147, where the blend det flag is checked. If the blend det flag is set, indicating the completion of the blend determination routine, the control branches to inquiry 196 (FIG. 11C). If the blend det flag is reset, indicating the blend determination has not been completed, the program branches to inquiry 153.

Inquiry 153 determines if reinitialization is needed for a blend determination cycle. If the new blend cycle flag is set, the program branches to block 154 where the new blend cycle flag is reset. Block 155 resets the blend water counter, which accumulates the incremental water levels used for blend determination. The torque sum, a value representative of the average torque required in agitation, is reset at block 156. The sum torque flag, used to enable the torque summation portion of the interrupt routine, is reset at block 157. The sum torque flag is used to prevent the capture of torque data during the first agitation cycle. The agit cycle counter, used to track the required 6 agitation cycles of a single blend determination cycle, is reset at block 158. The agit function pointer is reset at block 159 the agit/spin bit for output line 53 is reset at block 160; and the agit/spin flag is reset at block 161 to enable the control to operate the motor in an agitation mode. The run/stop bit for output line 52 is reset at block 162, and the run/stop flag is reset at block 163 to enable the control to run the motor. The program then branches to the fill routine.

Figure 11B:
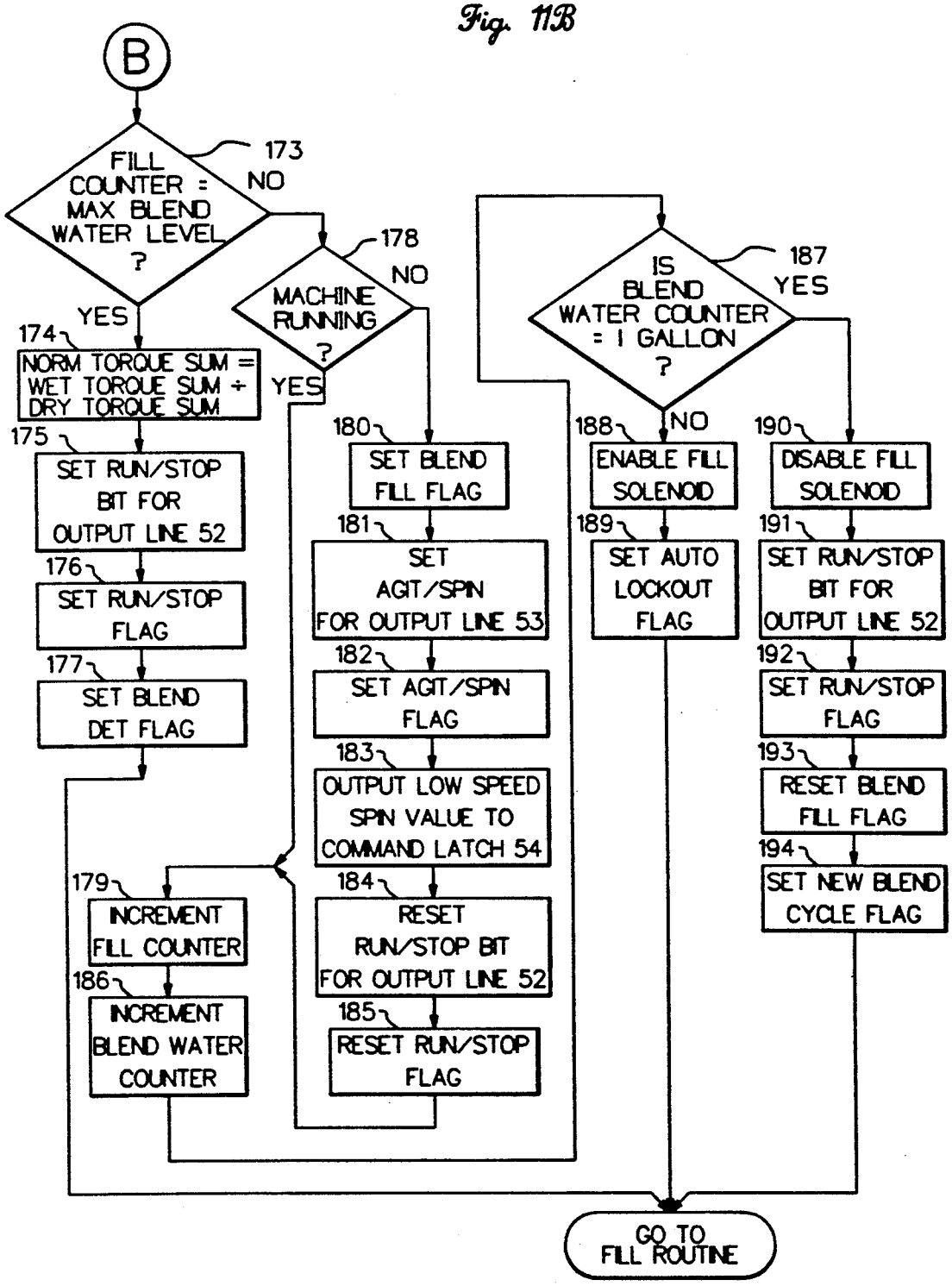

Returning to inquiry 153, if it determines that re-initialization is not needed (new blend cycle flag is not set), the program branches to block 165 where the sum torque flag is set. The program then branches to inquiry 166. The agit cycle number is compared to the value 6 at inquiry 166. If the agit cycle number is not equal to 6, then the program jumps to the Fill routine; otherwise, the program branches to inquiry 167. Inquiry 167 tests the status of the agit/spin flag. If the result of inquiry 167 determines that the agit/spin flag is set, then the control branches to inquiry 173 (FIG. 11B). If the agit/spin flag is not set, then the machine has finished a blend determination cycle. In which event, the run/stop bit for output line 52 is set at block 168, and the run/stop flag is set at block 169 to enable the control to stop the motor. Inquiry 170 compares the value stored in the fill counter against zero. If the fill counter equals 0, indicating that no water has been added to the clothes load, the program branches to block 171. The current value of the torque sum is placed into the dry torque sum register at block 171. If inquiry 170 determines that water has been added to the clothes load, then the value of the torque sum is added to the value of the wet torque sum register at block 172. The program continues with inquiry 173 (FIG. 11B) after both blocks 171 and 172.

Referring to FIG. 11B, inquiry 173 determines whether to add a set amount of water and execute another blend determination cycle or to end the blend determination process. If the fill counter value is equal to the maximum blend water level, the testing has spanned the expected ranges of water levels for the fabric load under test. In that event the control branches to block 174 where the norm torque sum is calculated by dividing the wet torque sum by the dry torque sum, and then the control branches to block 175 where the run/stop bit for output line 52 is set, and then to block 176 where the run/stop flag is set to enable the control to stop the motor. The blend det flag is set at block 177 to signal the completion of the Blend Determination routine, and the control branches to the Fill routine.

If inquiry 173 determines that the fill counter value is less than the max blend water level, the testing has not spanned the expected range of water levels and the control branches to inquiry 178, which determines if the machine is running. If the machine is running, the program branches to block 179. If the machine is not running, the program branches to block 180 where the blend fill flag is set. The agit/spin bit for output line 53 is set at block 181, and the agit spin flag is set at block 182 to enable the control to operate the motor in a spin mode. A low speed spin command is output to the command latch 54 at block 183. The run/stop bit for output line 52 is reset at block 184 and the run/stop flag is reset at block 185. This causes the basket to revolve slowly while water is added; thus assuring that the water is evenly distributed, in the azimuthal plane, throughout the fabric load.

The fill counter is incremented at block 179, and the blend water counter is incremented at block 186. Inquiry 187 determines whether the blend water counter value is equal to the predetermined number of gallons detailed in FIG. 29. If the blend water counter value does not equal the set number of gallons, then the fill solenoid is enabled at block 188, and the auto lockout flag is set at block 189. The program then branches to the Fill routine. If inquiry 187 determines that the blend water counter value equals the set number of gallons, then the fill solenoid is disabled at block 190; the run/stop bit for output line 52 is set at block 191; and the run/stop flag is set at block 192 to enable the control to stop the motor. The blend fill flag is reset at block 193, and the new blend cycle flag is set at block 194. The control then branches to the Fill routine.

The automatic Blend Determination routine as indicated in FIGS. 11A and 11B will be executed a number of times until the blend determination is completed. At the next pass through this routine the blend det flag is set at block 177 (FIG. 11B). In the next pass, inquiry 147 (FIG. 11A), will determine that the blend det flag is set and the control will branch to FIG. 11C.

Figure 11D:
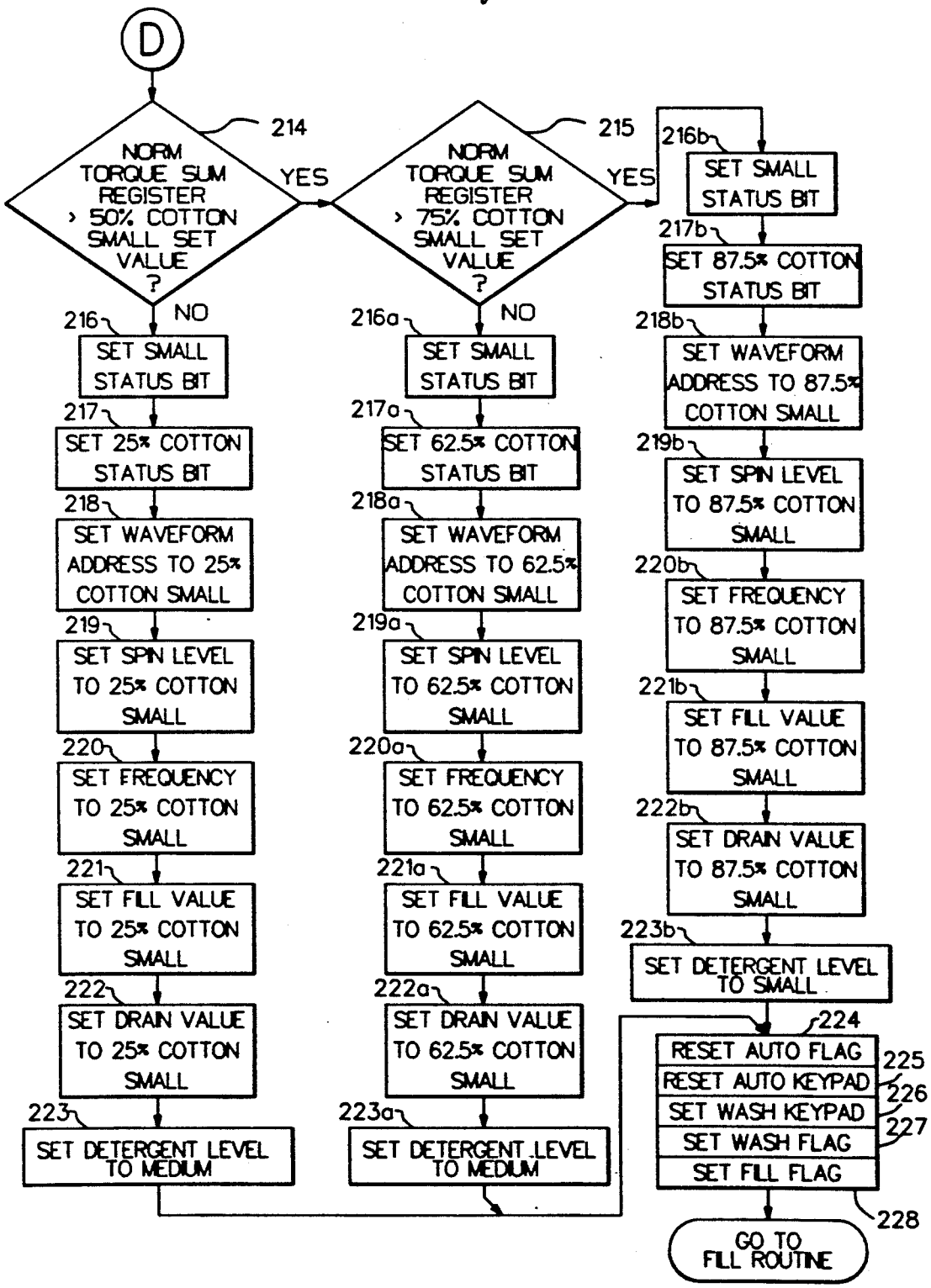

Referring to FIG. 11C, inquiry 196 begins the decision process by which the control is set for the appropriate one of the four load sizes and the appropriate one of the three blend ratios are determined. Inquiry 196 compares the load size value determined by the automatic Load Size Determination routine (FIG. 15, FIG. 16 or FIG. 17) against a low cutoff value. If the load size value is less than the low set value, the load size is mini and the control branches to inquiry 197. If the load size value is not less than the low set value, the control compares the load size value against a medium set value at inquiry 198. If the load size is less than the medium set value, the load size is small and the control branches to inquiry 214 (FIG. 11D). If the load size is greater than the medium set value, inquiry 199 compares the load size value against a high set value. If the load size is less than the high set value, the load size is medium and the control branches to inquiry 230 (FIG. 11E); otherwise, the load size is large and the control branches to inquiry 246 (FIG. 11F).

Assuming that the load size value is in the mini load range, inquiry 197 begins the decision process based on the bland determination data. Specifically, inquiry 197 compares the norm torque sum register value (box 172 of FIG. 11B) against a set value for a 50% cotton mini load. If the torque sum value is less than this value, it means that less than 50% of the fabric content is cotton. In that event, the control branches to block 200 where the mini status bit is set. The 25% cotton status bit is set at block 201. The waveform address is set to 25% cotton mini at block 202, and the spin level is set to the 25% cotton mini at block 203. The frequency is set to 25% cotton mini at block 204. The fill value and the drain value are set to 25% cotton mini values at blocks 205 and 206 respectively. The detergent level is set to medium at block 207. The auto flag is reset at block 208, the auto keypad is reset at block 209, the wash keypad is set at block 210, the wash flag is set at block 211, and the fill flag is set at block 212. This sets the control system to wash a mini size load of less than 50% cotton. The program then branches to the Fill routine.

If inquiry 197 determines that the torque sum value is greater than the set value for 50% cotton, then the torque sum register value is compared against a set value for a 75% cotton mini load at inquiry 213. If the torque sum register value is less than the 75% cotton mini set value, the load is between 50% cotton and 75% cotton, and blocks **200*a*–207*a* and 208–212** are executed. This sequence sets the washer into a 62.5% cotton mini load in a manner substantially like the previous description covering the 25% cotton mini mode.

If inquiry 213 determines that the torque sum register value is greater than the 75% cotton mini set value, then the load is greater than 75% cotton and the washer is set into the mode to wash a 87.5% cotton mini load at blocks **200*b*–207*b* and 208–212**.

Figure 11E:
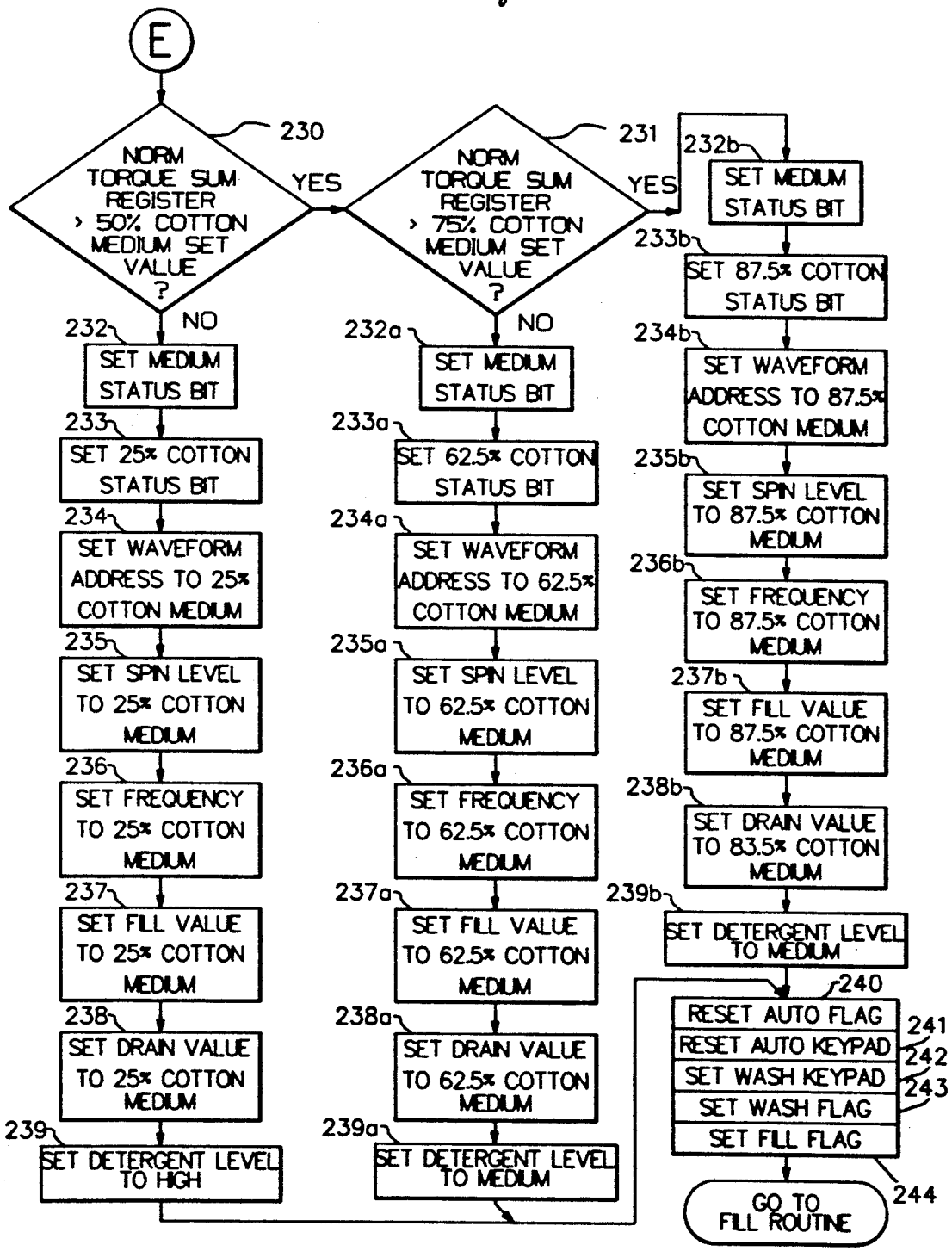

FIG. 11D, that is, inquiry 214 through block 228, illustrates the sub-routine that sets the washer for the appropriate 25% cotton small mode, 62.5% cotton small mode or 87.5% cotton small mode of operation in a manner substantially identical to the one described for the mini load size sub-routine illustrated in FIG. 11C. FIG. 11E, that is, inquiry 230 through block 244, illustrates the sub-routine that sets the washer for the appropriate 25% cotton medium mode, 62.5% cotton medium mode or 87.5% cotton medium mode in a manner substantially identical to the one described for the mini load size sub routine of FIG. 11C. FIG. 11F, that is, inquiry 246 through block 260, illustrates the sub-routine that sets the washer for the appropriate 25% cotton large mode, 62.5% cotton large mode or 87.5% cotton large mode in a manner identical to the one described for the mini load size. Since these sub-routines operate in a like manner to the sub-routine of 197–212 in FIG. 11C, they will not be described in detail.

Figure 31:
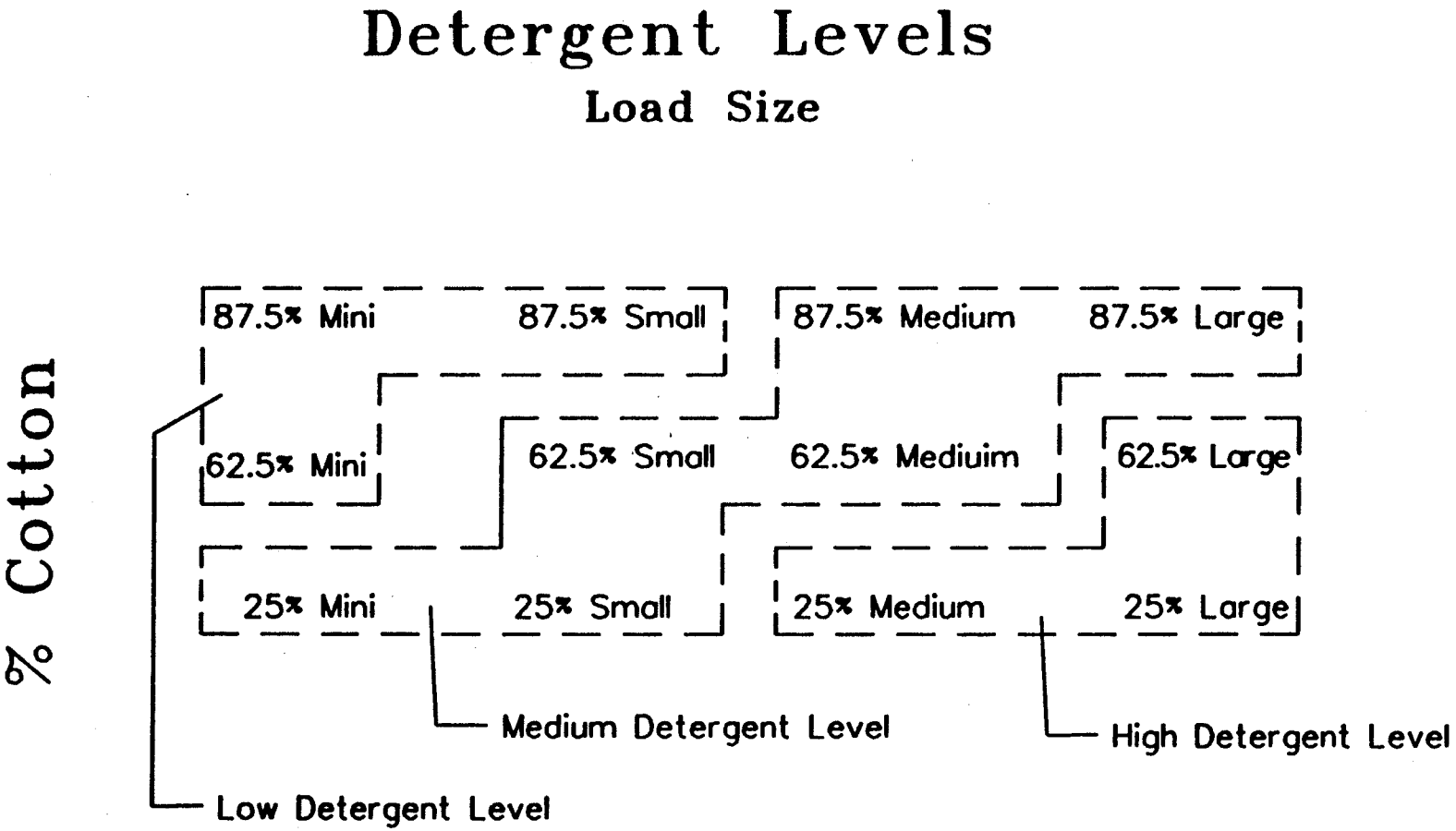
FIG. 31 illustrates a preferred set of load size and blend regions for selected detergent levels.
Figure 31:
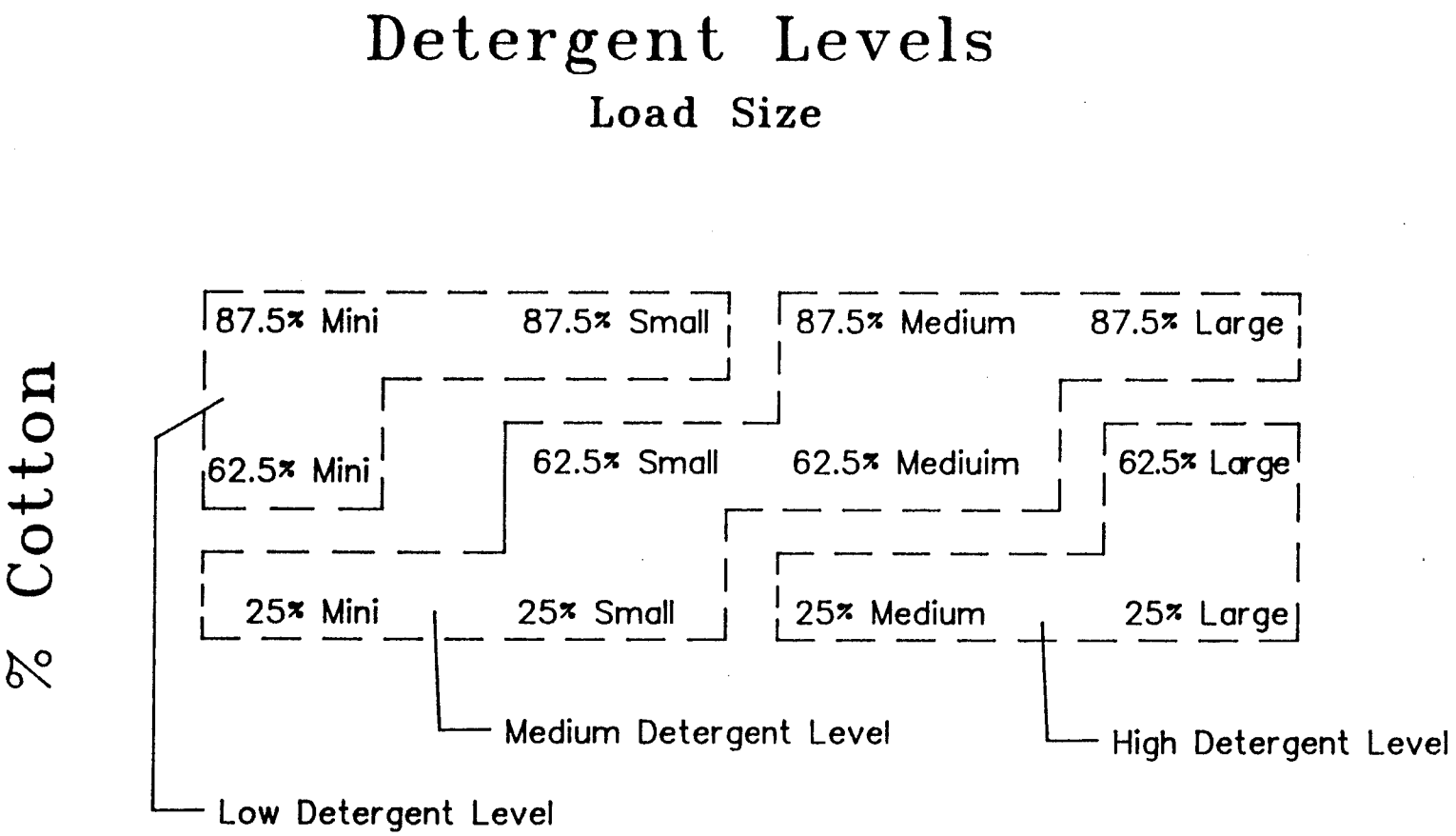

The detergent level indicates to the user the quantity of detergent required by a specific load size and blend type. The detergent level is broken down into three regions as a function of load size and blend type. The partitioning, shown in FIG. 31, was carried out with two criteria in mind. The first is the detergent level should increase as the load size increases. The second is that cotton articles wash with mechanical action and synthetic articles wash with chemical action; as the percentage of cotton decreases, chemical washing becomes predominant. The partitioning is carried out so that 87.5% cotton mini loads, 62.5% cotton mini loads, and 87.5% cotton small loads set the detergent level to low; 25% cotton mini loads, 62.5% cotton small loads, 25% cotton small loads, 87.5% cotton medium loads, 62.5% cotton medium loads, and 87.5% cotton large loads will set the detergent level to medium; while 25% cotton medium loads, 62.5% cotton large loads, and 25% cotton large loads will set the detergent level to high. Some machines are capable of automatically adding detergent. With such machines the detergent level signal may be used to control the automatic dispenser.

An alternative to the sub-routines of FIGS. 11C–11F is to set parameter(s) based upon the load size value received from the load size algorithm and the blend data received from the blend algorithm. Rather than creating four load size regions and three blend regions and utilizing cutoff points to define these regions, waveform parameters for terminal speed, acceleration, deceleration, frequency and symmetry, as well as cycle parameters for water level, wash time, detergent level, spin speed, and spin time may be set directly from the load size and blend data. A common waveform may be stored and the values of the aforementioned parameters may be used to alter the waveform to best fit the detected load size and blend type. The net result is a system that modifies the agitation waveform as a function of detected load size and blend type rather than the determined appropriate load size region and blend type region.

Now that the overall operation has been described, we turn in more detail to various of the functional routines. The Fill routine controls the addition of water to the machine and is illustrated in FIG. 12. It is entered at inquiry 265, which determines whether the wash flag is set. If the wash flag is not set, inquiry 266 determines if the wash pad is set. When the wash flag is not set and the wash pad is not set, the last call for a wash operation has been completed or discontinued and the program proceeds directly to the Update Display routine. When inquiry 266 determines that the wash pad is set, the wash flag is set at block 267; the fill flag is set at block 268; the fill counter is reset at block 269 (that is, the fill counter is adjusted to count a full fill operation) and the auto lock out flag is set at block 270. The program then proceeds to block 271, where the fill counter is incremented one step. Then inquiry 272 determines if the fill counter is greater than the set value. It will be understood that, with the illustrative machine, the flow rate of water is constant so that the proper amount of water for the selected load will enter the machine in a predetermined time period. When inquiry 272 determines that the fill counter is less than the set value more water is needed and the fill solenoid is enabled at block 273. The program then proceeds to the Update Display routine.

When inquiry 272 determines that the fill counter is greater than the set value the processor knows that the fill function has been completed and sufficient water is in the machine. Therefore the fill solenoid is disabled at block 274; the fill flag is reset at block 275; the fill counter is reset at block 276; the agitate flag is set at block 277, the agitate counter is reset at block 278 and inquiry 279 determines whether the machine is running by checking the status of the run/stop flag. If the machine is running, the program proceeds to the Update Display routine. If the machine is not running, the agit/-spin bit for output line 53 is reset at block 280; the agit/-spin flag is reset at block 281 and the control program proceeds to the Update Display routine. (For ease of interfacing the present description with that of U.S. Pat. No. 4,959,596-S. R. McMinn, the protocol for agit/spin bit 53 is "set" equals spin and "reset" equals agit.)

Returning to inquiry 265, when the wash flag is set, the control recognizes that a wash (including rinse) operation is called for. Then inquiry 282 determines whether the fill flag is set. If yes the program proceeds to block 271 and from there as described just above. When inquiry 282 determines that the fill flag is not set, the control recognizes that the fill operation is complete. Then the program goes to the Agitate/Spin routine. For each fill operation, the Fill routine is executed numerous times until the fill counter reaches the predetermined set value (inquiry 272). At that time, block 275 resets the fill flag. In the next pass into the fill routine, inquiry 282 will determine the fill flag is not set (it is reset) and jump to the Agitate/Spin routine.

FIG. 13 illustrates operation of the control to implement the Agitate/Spin routine. Inquiry 284 determines whether the agitate flag is set. If yes, the agitate counter is incremented at block 285 and inquiry 286 determines whether the agitate counter is greater than the set value. It will be understood that the agitation (wash or rinse) operation will go on for an extended period of time with the basket 11 oscillating to impart washing energy to the fabrics and the water/detergent solution in which they are immersed. In a simple machine this period may always be the same value such as 15 minutes for example. In a more fully featured machine the time may vary depending on the load size, in which case the set value of the agitate counter will be determined for the particular load at the appropriate one of the Mini, Small, Medium and Large status bits, blocks **200–200*b*, 216–216*b*, 232–232*b* or 248–248*b* of FIGS. 11C–11F respectively. When inquiry 286 determines that the agitate counter is greater than the set value, agitation is complete and the program proceeds to reset the agitate flag at block 287; reset the agitate counter at block 288; set the drain flag at block 289; reset the drain counter at 290; set the run/stop bit for output line 52 at block 291 and set the run/stop flag at block 292**. This programs the machine for the drain operation and the program then proceeds to the Update Display routine.

On the next pass through the program inquiry 284 determines that the agitate flag is not set (reset), the program proceeds to inquiry 293 and determines whether the drain flag is set. If the drain flag is set it means that a drain operation is in progress and the drain counter is incremented at block 294. Then inquiry 295 determines whether the drain counter is greater than the set value. As with the fill counter and agitate counter, the drain counter may always be set to a particular value, such as six minutes for example, or, if desired, the program may set the drain counter at one of blocks 206–206b (FIG. 11C), 222–222b (FIG. 11D), 238–238b (FIG. 11E), or 254–254b (FIG. 11F) to have a period of time corresponding to the load size and blend and thus corresponding to the amount of water in the machine. When inquiry 295 determines that the drain counter is not greater than the set value it means that the drain operation is called for. The drain solenoid is enabled at block 296 and the program then proceeds to the Update Display routine. When inquiry 295 determines that the drain counter value exceeds the set value, it means that the drain operation is complete. At that time the program disables the drain solenoid at block 297; resets the drain flag block 298; resets the drain counter at block 299; sets the spin flag at 300 and resets the spin counter at block 301. Inquiry 302 then determines whether the machine is running. If yes, the program proceeds to the Update Display routine. If no, the agit/spin bit for output line 53 is set at block 303; the agit/spin flag is set at block 304 (which corresponds to a spin operation) and the program proceeds to the Update Display routine.

Upon the completion of the drain operation the drain flag is reset at block 208. On the next pass through the program inquiry 284 will determine that the agitate flag is not set and inquiry 293 will determine that the drain flag is not set, which means that a spin operation is called for. The program thereupon increments the spin counter at block 305 and then inquiry 306 determines whether the spin counter value is greater than the set value. As with the previously described counters, the spin counter may always be set to a particular value such as five minutes, for example, or set to a value corresponding to the particular load size and blend at the appropriate one of blocks 203–203b (FIG. 11C), 219–219b (FIG. 11D), 235–235b (FIG. 11E), or 251–251b (FIG. 11F).

When either inquiry 286 determines that the agitate counter is not greater than the agitate set value or inquiry 306 determines that the spin counter is not greater than the spin set value, the machine is in an agitation or spin operation and, in either event, the program proceeds to inquiry 307 which determines whether the machine is running. If yes, the program proceeds to the Update Display routine. When inquiry 307 determines that the machine is not running, the function pointers are reset at block 308; the run/stop bit for output line 53 is reset at block 309; the run/stop flag is reset at block 310 to enable the control to restart the motor to provide the appropriate one of wash or spin operation when called for by the microprocessor and the program then proceeds to the Update Display routine.

When inquiry 306 determines that the spin counter value is greater than the set value, it is time to conclude the spin operation. At this time the spin bit is reset at block 311; the spin counter is reset at block 312; the run/stop bit for output line 53 is set at block 313; the run/stop flag is set at block 314; the wash flag is reset at block 315; the auto lock out flag is reset at block 316. This enables the control to stop the machine and the program proceeds to the Update Display routine.

The update display routine (block 67 in FIG. 4)) updates the lights 20 (FIG. 1) by means of updating the VF display module 47 (FIG. 3). Details of this routine have been omitted as there are a number of well known such routines and it forms no part of the present invention.

The overall Operation routine, as generally set forth in FIG. 4, has been described and it will be understood that the most time consuming path through the operation routine takes less than the 8.33 milliseconds between successive zero crossings of the power supply voltage. Thus the program accomplishes a complete pass through the Operation routine of FIGS. 4 and 6–13 and the control then waits for the next zero crossing to repeat the operation. Each fill, agitate, drain and spin operation of the machine continues for several minutes. Thus the routine of FIGS. 4 and 6–13 will be implemented many times during each operation or operational phase of the washing machine operation. During each pass through the program the appropriate components of the machine, such as the motor, the fill solenoid and the drain solenoid for example, are energized and the appropriate ones de-energized and the appropriate counters are incremented once for each pass through the program. When energized, the solenoids maintain their related components energized. For example, the machine will drain continuously during a drain operation even though the laundry control makes repeated passes through the program with pauses between successive passes until the next zero cross. As previously described, when the control senses that the appropriate counter has exceeded its set value, it branches to the next subroutine which is then repeated a number of times until the set value for that routine is exceeded.

A typical operational sequence of an automatic washing machine incorporating a preferred embodiment of the present invention includes determination of the load size, determination of the fiber blend, a first phase of fill, wash agitation, drain and spin followed by a second phase of fill, rinse agitation, drain and spin. The second phase generally repeats the first phase except that no detergent is used and the rinse agitation period may be shorter than the wash agitation period. Thus for the sake of brevity and ease of understanding only the first phase has been described. Also auxiliary operations such as pre-wash and spray rinses have been omitted and they do not form part of the present invention.

As previously described, a number of sets of agitation or wash values are stored in the form of look up tables in the ROM of microprocessor 40 and are called up by the microprocessor so that control 25 operates motor 14 at a speed corresponding to the current or last called up value. As an example, in the machine and control of the illustrative embodiment there are twelve sets of empirically determined values, called 25% cotton mini, 62.5% cotton mini, 87.5% cotton mini; 25% cotton small, 62.5% cotton small, 87.5% cotton small; 25% cotton medium, 62.5% cotton medium, 87.5% cotton medium; 25% cotton large, 62.5% cotton large, and 87.5% cotton large load sizes for reference. Appendix A includes sets of wash values for a mini load; Appendix B includes sets of wash values for a small load; Appendix C includes sets of wash values for a medium load; and Appendix D includes sets of wash values for a large load. Each Appendix includes three separate sets of wash values; for 25%, 62.5% and 87.5% cotton content respectively. Each set of values includes 256 different numbers from 0 to 255 inclusive. In each set of values the number 128 has been chosen to represent zero angular velocity of the motor rotor, the number 0 to represent the maximum angular velocity in one direction and the number 255 to represent the maximum angular velocity in the other direction. It will be understood that the values or numbers 0–255 are stored in the ROM memory in a binary (hexadecimal) form and, when stored, each set of values provides a look up table. When called up from memory by the microprocessor 40 the value is transmitted to the command latch 54 which sends the speed command to the motor control 27. Each of the numbers 0–255 corresponds to a particular 8-bit parallel output from the microprocessor 40 to the command latch 54 For example, the number or value 0 is 0000 0000; the number 128 is 1000 0000 and the number 255 is 1111 1111. The conversion factor built into motor control 27 is such that, for agitation operations, the number 255 corresponds to 150 revolutions per minute counterclockwise and the number 0 corresponds to 150 revolutions per minute clockwise.

The set of values or look-up table for each load size and blend ratio is stored as eight bit bytes in the ROM of microprocessor 40 in 256 separate locations. A pointer for each set incorporated in the microprocessor initially points to the first value of that set. When that value is called up the pointer is incremented to the next value and when the last value is called up the pointer is incremented to the initial value. In this way the values of the selected set of values or look-up table are repeatedly called up in sequence throughout an agitation cycle.

Figure 25:
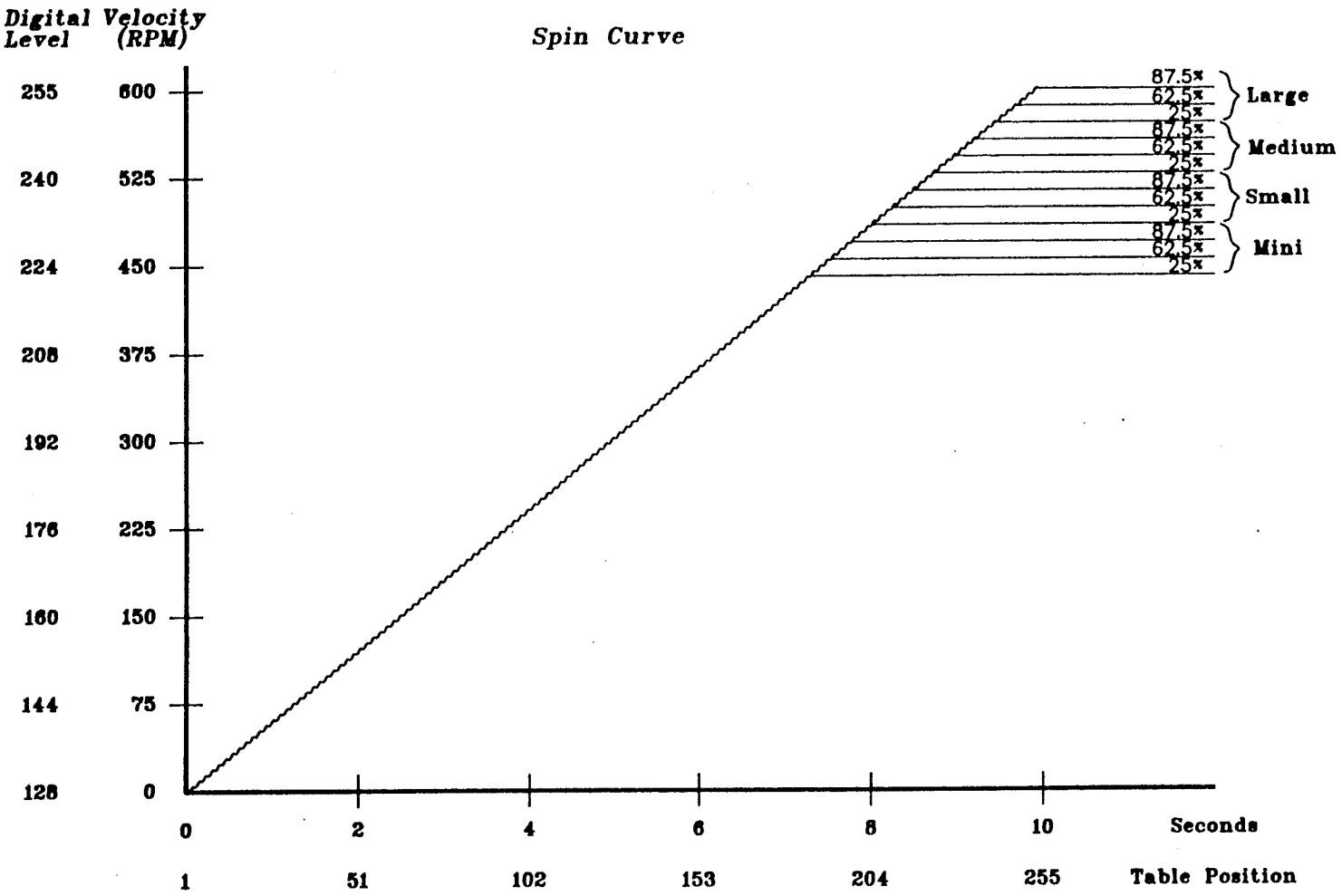
FIG. 25 illustrates exemplification rotor velocity wave shapes for centrifugally extracting fluid from various size clothes loads.

Another set of empirically determined values, conveniently called spin values are stored in the form of a spin look up table in another portion of the ROM are called up by the microprocessor in a predetermined timed sequence and used to control the motor to provide a spin or centrifugal extraction operation in a manner generally as explained for the agitation operation. Appendix E is an exemplary set of spin values. It will be noted from Appendix E and the corresponding speed chart of FIG. 25 that the spin curve accelerates in a number of small steps or increments to a maximum speed which then is held constant. The spin table contains a set of values or numbers that range from 128 to 255, inclusive, and each number represents an 8-bit parallel output from the microprocessor to the command latch, as explained hereabove for the agitation operation. The conversion factor built into the motor control 27 is such that, for the spin operation, the number 128 corresponds zero revolutions per minute and the number 255 corresponds to 600 revolutions per minute of the motor rotor and basket.

In the illustrative embodiment the terminal speed provided by the set of spin values in Appendix E (600 rpm) is used to provide spin for large fabric loads with maximum cotton fiber content. When the control determines that the load is one of any of the mini, small or medium load sizes or a large load with a smaller percentage of cotton fibers, a lower terminal spin level is set into the memory of the microprocessor. As will be explained more fully hereinafter, each time the microprocessor calls up a spin value from the spin table, it then compares the spin value to the terminal spin level set in accordance with the load size and fiber blend and operates the motor at a speed corresponding to the value representative of the lower speed.

In the illustrative embodiments, during the agitation cycle, individual values are called up 256 times during one complete oscillation or agitation stroke of the motor 14 and basket 11. After the subsequent drain operation the spin cycle is implemented and individual values are called up from the spin table to bring the basket up to its terminal velocity.

In spin operation individual values are called up a maximum of 256 times during the acceleration or ramp up phase. After that a constant value is used to provide a constant terminal speed of the basket 11. Terminal speed operation continues until the spin counter times out the spin extraction operation (block 306, FIG. 13). In a basic control the interrupt timer for the spin operation is preset so that the acceleration or ramp up phase of spin operation follows the same slope regardless of load size. In another embodiment the value preset in the interrupt timer is a function of the load size and blend. In that event the ramp up rate for spin is tailored to the load size and fabric mix.

The time period between (or frequency of) successive call ups of agitate or spin values is implemented by an interrupt timer or counter in the microprocessor 40. The interrupt timer causes the microprocessor to interrupt the main Operation routine of FIG. 4 and enter the Interrupt routine of FIG. 5 at predetermined intervals. The illustrative interrupt timer has a predetermined maximum value and an initial value is set by the control depending upon the load size and blend (**204–204*b* of FIG. 11C, 220–220*b* of FIG. 11D, 236–236*b* of FIG. 11E, or 252–252*b* or FIG. 11F**). At a rate set by the internal clock of the microprocessor, the interrupt timer increments from the initial value to the maximum value. When the maximum value is reached, the Operation routine is interrupted and the Interrupt routine is entered. The interrupt timer is repeatedly reloaded with the initial value and times out throughout the automatic, agitation, drain and spin operations. It will be understood that, if desired, the interrupt timer could decrement from an initial value to zero.

Figure 14:
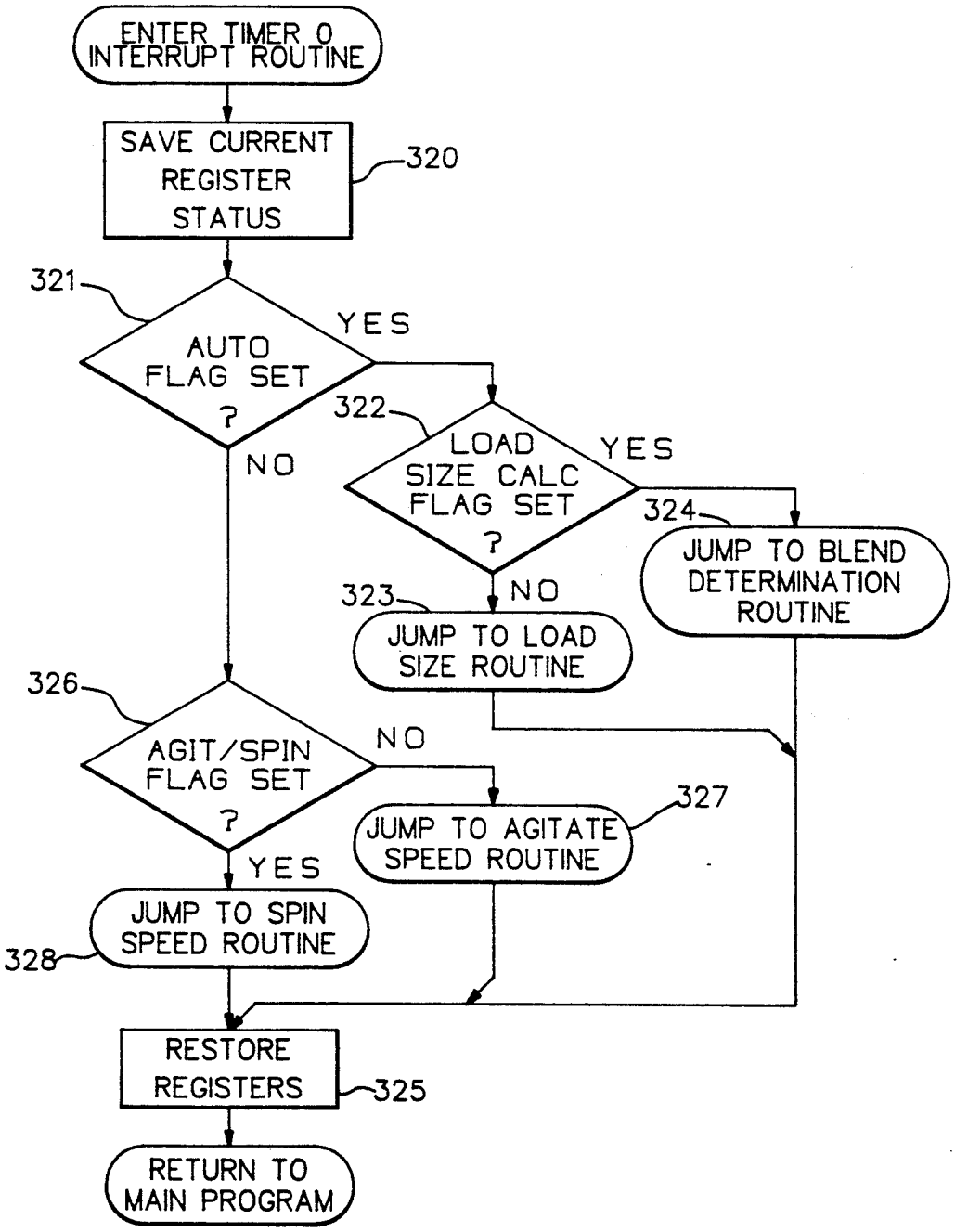
FIG. 14 is a simplified flow diagram of the Timer 0 Interrupt routine for automatic mode, agitate and spin incorporated in the control program of FIG. 4.

A more detailed explanation of the Timer 0 interrupt operation or routine is illustrated beginning with FIG. 14. Referring to FIG. 14, when the Timer 0 Interrupt routine is entered the status of each of the registers in the control as heretofor described is saved at block 320. Inquiry 321 then determines whether the auto flag is set. If the auto flag is set, indicating that the auto mode is active, the control branches to inquiry 322, which tests the load size calc flag. If the load size calc flag is set, indicating a completed load size calculation, the control jumps to the Blend Determination routine (block 324). Otherwise, the control jumps to the load size routine (block 323). At the end of each of these routines the registers are restored at block 325 and the control returns to the main program. If inquire 321 determines that the auto flag is not set, the control knows that the auto mode is not active and the program continues with inquire 326. Inquiry 326 then determines whether the agit/spin flat is set. It will be remembered that the set status of the agit/spin flag equates to a spin operation and the reset status of the agit/spin flag equates to an agitate operation. Thus when inquire 326 determines that the agit/spin flag is reset the program jumps to the Agitate Speed routine as indicated at 327. Upon completion of that routine, all the registers and counters are restored at block 325 and control then returns to the Main operation or routine. When inquiry 326 determines that the agit/spin flag is set, the program jumps to the Spin Speed routine as indicated in 328. When the Spin Speed routine is completed, the registers and counters are restored at block 328 and the control returns to the main program.

Figure 16:
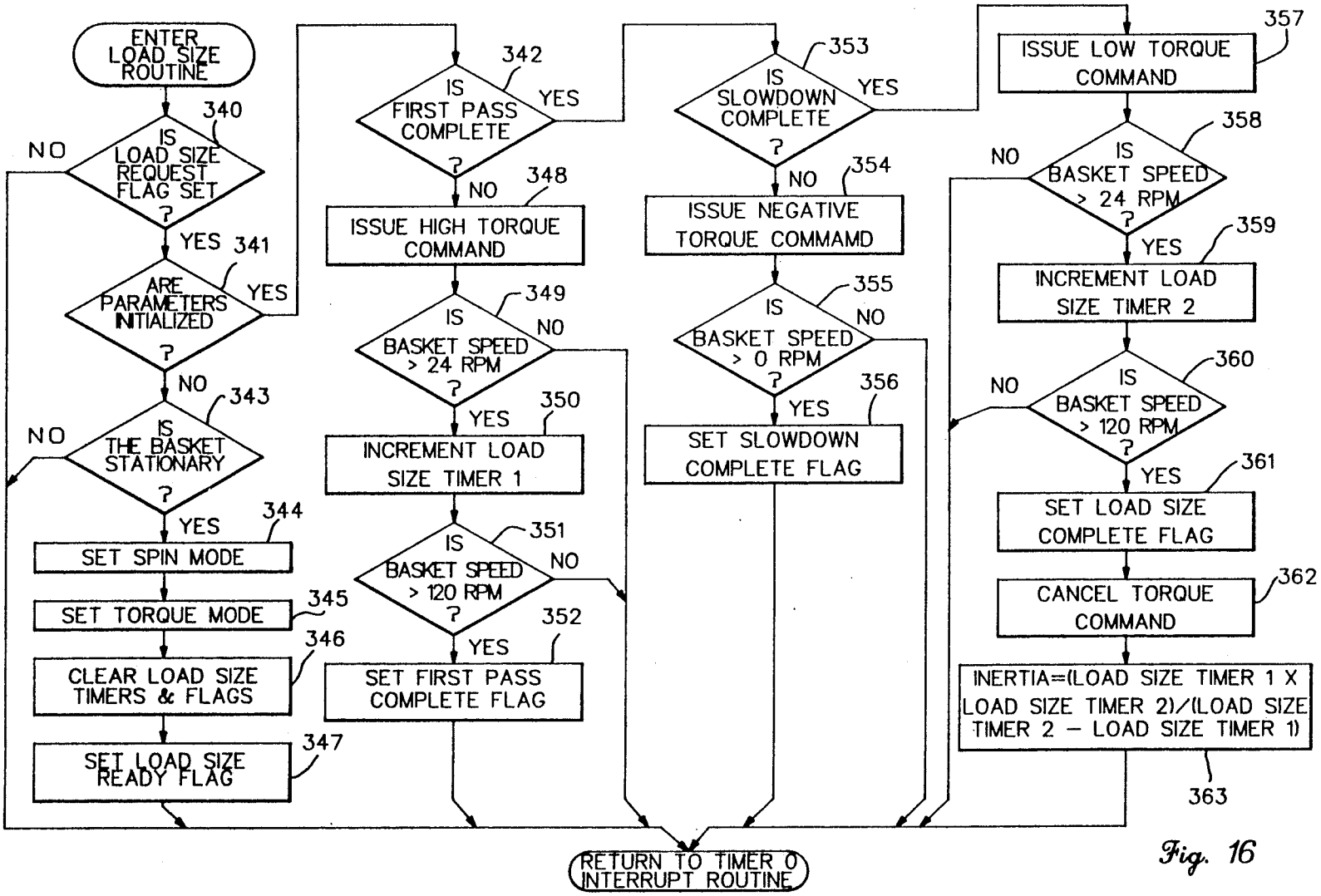
FIG. 16 is a simplified flow diagram of the Velocity Based Load Size Routine with compensation for friction incorporated in the control program of FIG. 4.
Figure 17:
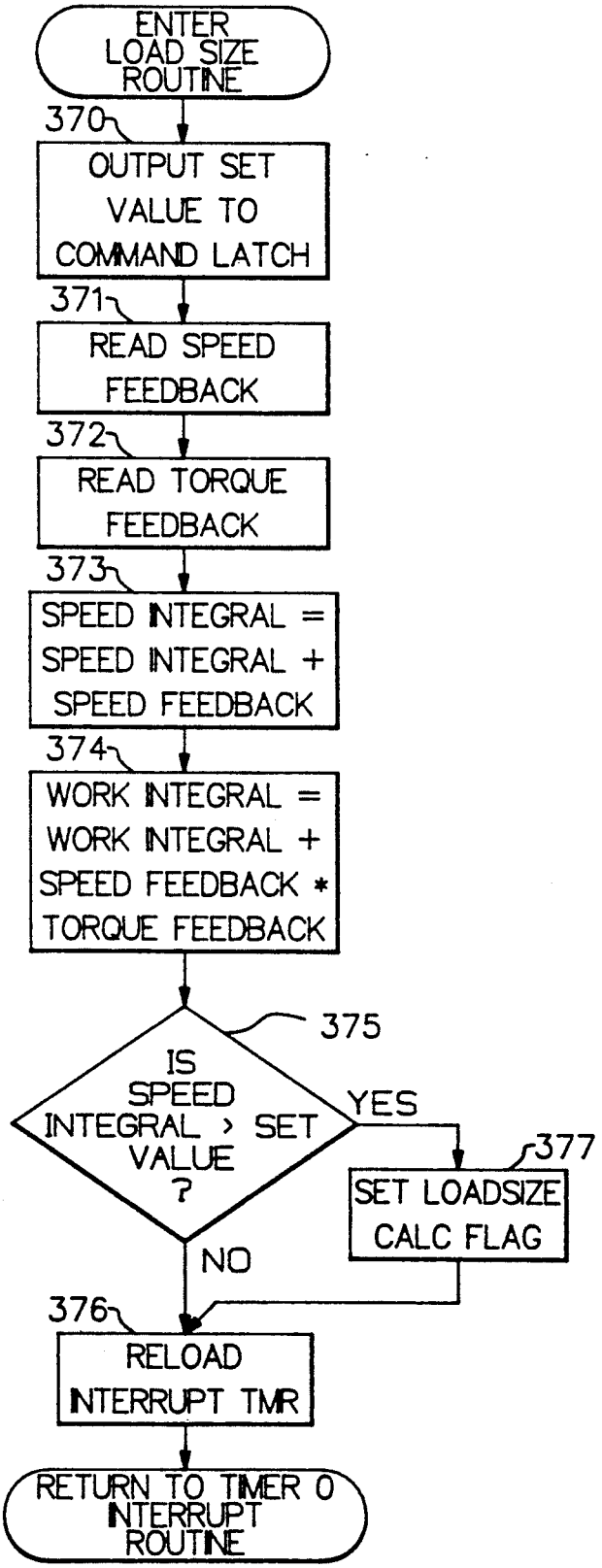
FIG. 17 is a simplified flow diagram of the Work Based Load Size routine incorporated in the control program of FIG. 4.

FIGS. 15, 16 and 17 illustrate three additional Load Size determination routines. As discussed earlier, only one of the Load Size routines will be implemented in a particular machine. A velocity based load size algorithm is detailed in FIG. 15, a velocity based algorithm which compensates for machine friction is illustrated in FIG. 16, and a work based load size algorithm is shown in FIG. 17. Beginning with the illustrative velocity based load size algorithm shown in FIG. 15, block 330 outputs a fixed value to the command latch. Since the control is set into a torque based mode (FIG 9 blocks 107–108), the output of block 330 is a fixed torque command; that is, it will result in motor rotor 14*b* being driven with a constant torque. The speed feedback from the motor control is read at block 331. Inquiry 332 compares the speed feedback against the predetermined terminal speed for velocity based load size determination. The velocity based Load Size determination operation measures the time for the motor 14 and fabric container 11 to accelerate from a first angular or rotational speed, 24 rpm in the illustrative embodiment, to a second higher angular or rotational speed, 120 rpm in this illustration. This measurement is the value last incremented into the Loadsize Timer at block 335. Thus, the Loadsize Timer value is representative of the size (weight or mass) of the fabric load to be washed. Referring to FIG. 11C, the Loadsize Timer value is compared to the set values at 196, 198 and 199 to determine the load size range into which the load fits.

Returning to FIG. 15, when inquiry 332 determines that the speed feedback is less than the terminal velocity, then inquiry 334 compares the speed feedback against the initial velocity required for velocity based load size calculations (24 RPM in the illustrative embodiment). If the velocity has not exceeded the initial velocity, the program branches directly to block 336 where the interrupt timer is reloaded and the program jumps back to the Timer O Interrupt routine. When the velocity has exceeded the initial velocity, the control branches to block 335 where the load size timer is incremented. The program then continues to block 336 and follows the path described above. When inquiry 332 determines that the terminal velocity has been reached, block 333 sets the loadsize calc flag to indicate the completion of the load size calculations. The program then continues to block 336 where the interrupt timer is reloaded and then the program jumps back to the Timer O interrupt routine.

The algorithm for a Friction Compensated Load Determination scheme described in this disclosure is detailed in FIG. 16. Decision block 340 determines if the main program has made a load size request. If decision block 340 is negative, the program returns to the Timer 0 Interrupt routine. When decision block 340 determines that the Load Size Request Flag is set, the program branches to decision block 341 to check the status of the load size parameters. If the parameters have been initialized, the program branches to decision block 342; otherwise, the program continues with decision block 343. If the basket of the washing machine is rotating when decision block 343 is executed, the program returns to the Timer 0 Interrupt routine. If the basket is stationary, the program continues to block 344 where load size parameters are initialized. The machine is placed into spin mode at block 344, and torque mode at block 345. The timers and flags are reset at block 346, and Lsize-Ready flag, indicative of an active load size routine, is set at block 347. The control then returns to the Timer 0 Interrupt routine.

Returning to block 341, when the load size parameters are initialized, the program branches to inquiry 342. If decision block 342 determines that the first phase is not yet complete, the high torque command is issued to the motor controller at block 348. The program continues with block 349, where the basket speed is checked against the lower measurement threshold. If the basket speed is not greater than 24 RPM, the program returns to the Timer 0 Interrupt routine. If the basket speed has reached or exceeded 24 RPM, the Load Size Timer 1 is incremented at block 350 and the program checks the upper speed threshold at decision block 351. If the basket speed is not greater than 120 RPM, the program returns to the Timer 0 Interrupt routine. If the basket speed has reached or exceeded the upper speed threshold, the First Pass Complete Flag is set at block 352, and the program returns to the Timer 0 Interrupt routine.

When decision block 342 determines that the first phase of the algorithm is complete, the program branches to decision block 353. Decision block 353 determines if the slowdown phase between the two measurement phases is complete. If the slowdown is not complete, the program issues a negative torque command to the motor controller at block 354. The basket speed is checked again at block 355, and if the speed is greater than 0 RPM, the program returns to the Timer 0 Interrupt routine. If the basket speed is equal to or less than 0 RPM (negative RPM is defined as rotation in the direction opposite of the direction used for testing), the program sets the slowdown complete flag at block 356 and returns to the Timer 0 Interrupt routine.

The affirmative branch of decision block 353 branches to block 357 which issues the low torque command needed for the second measurement phase of the load size algorithm. Decision block 358 determines if the basket speed has reached the low speed threshold of 24 RPM, if the basket speed is below 24 RPM, the program returns to the Timer 0 Interrupt routine. If the speed has exceeded or is greater than 24 RPM, the affirmative branch of decision block is taken to block 359 where the Load Size Timer 2 is incremented. The program continues to decision block 360 where the basket speed is compared against the upper threshold speed. If the basket has not yet reached the upper threshold speed, the program returns to the Timer 0 Interrupt routine. Once the basket has attained a speed of at least 120 RPM, the affirmative branch is taken from decision block 360 to block 361. The Load Size Complete flag, used to indicate the completion of all three phases of the load size algorithm, is set at block 361, and the torque command to the motor controller is cancelled at decision block 362. Block 363 calculates a quantity proportional to the moment of inertia as described earlier.

Referring to FIG. 11C, the Inertia value is compared to the set values at 196, 198, and 199 to determine the load size range into which the load fits.

FIG. 17 illustrates a work based load size routine. Block 370 outputs a fixed value to the command latch. Since the control was set into a speed based mode, the output of block 370 is a fixed speed command, that is, rotor 14*b* will be operated at a constant speed. The speed feedback from the motor control is read at block 371. The torque feedback is read at block 372. The speed integral, which is representative of the total angular distance traveled during the test, is updated at block 373. Block 374 updates the summation used to approximate the work integral. Inquiry 375 determines if the basket has traveled the fixed distance required by the test. If the basket has not traveled the fixed distance, the program continues to block 376 where the interrupt timer is reloaded so that it may continue its sequence of periodic interrupts. Then the program returns to the Timer 0 Interrupt routine. If the basket has traveled the required distance, block 377 sets the loadsize calc flag to indicate that the pertinent data has been collected. The program then continues to block 376 and proceeds as previously described.

The work integral value (block 374) corresponds in function to the Loadsize Timer value; that is, it is representative of the size or weight of the fabric load. In a machine programmed to use the work based load determination, the terminal value of the work integral (block 374) is compared to predetermined values at inquiries 196, 198 and 199 of FIG. 11C to determine the load size range into which the load fits.

Figure 18:
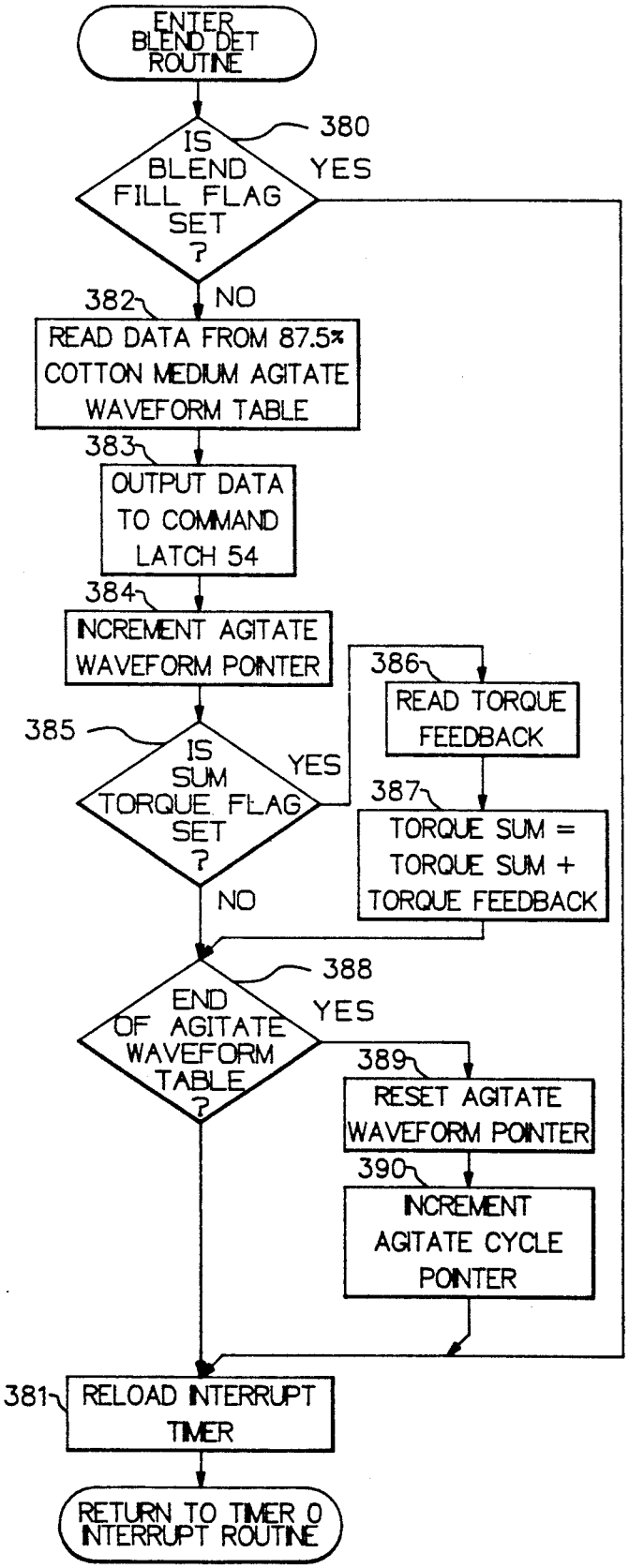
FIG. 18 is a simplified flow diagram of the Blend Determination routine incorporated in the control program of FIG. 4.

FIG. 18 illustrates the blend determination routine. Inquiry 380 determines if the machine is in the blend fill mode; if yes, the program branches to block 381 where the interrupt timer is reloaded, and then the program jumps back to the Timer 0 Interrupt routine. If the answer to inquiry 380 is No, it means that the incremental fill operation for the next blend agitation step is complete. At this time the data pointed to by the agitate waveform pointer in the 87.5% cotton medium size load agitate waveform table is read at block 382. This data is output to the command latch 54 at block 383. This sets the control to oscillate the motor rotor and fabric container in accordance with the set of values or look up table for medium size load with 87.5% cotton fibers. This is generally a middle or average input and provides an appropriate standard agitation for blend determination. The agitate waveform pointer is incremented at block 384. Inquiry 385 checks the status of the sum torque flag. If the sum torque flag is set, then the torque feedback is read at block 386, and is added to the torque sum at block 387. The program then continues with inquiry 388. If the sum torque flag is not set at inquiry 385, the program continues directly to inquiry 388. If inquiry 388 determines that the end of the agitate waveform has been reached, the agitate waveform pointer is reset at block 389, and the agit cycle counter is incremented at block 390. The control then exits the blend determination routine through block 381 as described above. If inquiry 388 shows that the agitate and waveform has not been completed, then the program proceeds directly to block 381 where the Interrupt Timer is reloaded.

Figure 19:
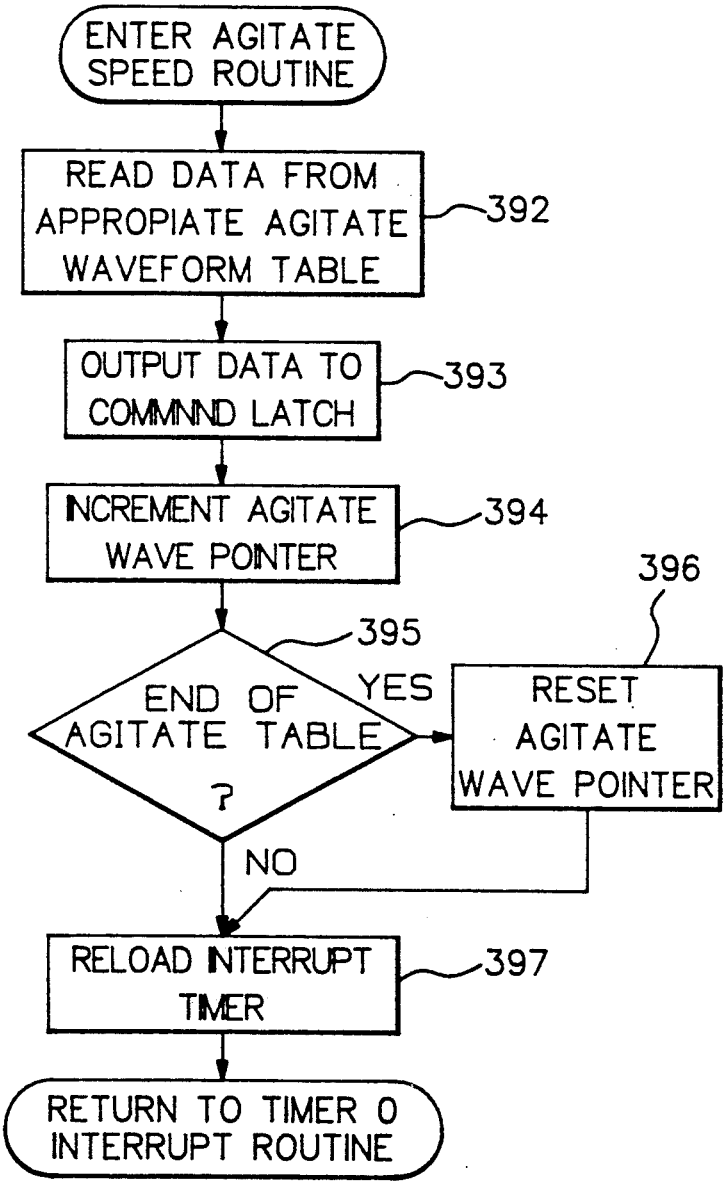
FIG. 19 is a simplified flow diagram of the Agitate Speed routine incorporated in the control program of FIG. 4.

FIG. 19 illustrates the Agitate Speed routine. The data from the waveform table selected at the appropriate one of blocks 202–202*b* (FIG. 11C), 218–218*b* (FIG. 11D), 234–234*b* (FIG. 11E), or 250–250*b* (FIG. 11F) is read at block 392. The data is outputted to command latch 54 at block 393; the agitate wave form pointer is incremented at block 394 and inquiry 395 determines whether the end of the agitate wave form table has been reached. If yes, the agitate wave form pointer is reset to the beginning of the table at block 396, the initial value is reloaded into the interrupt timer at block 397 and the program returns to the Timer 0 Interrupt routine at block 325 (FIG. 14). If the end of the agitate wave form table has not been reached, the initial value is reloaded into the interrupt timer at 397 and the program returns to the Timer 0 Interrupt routine.

Figure 20:
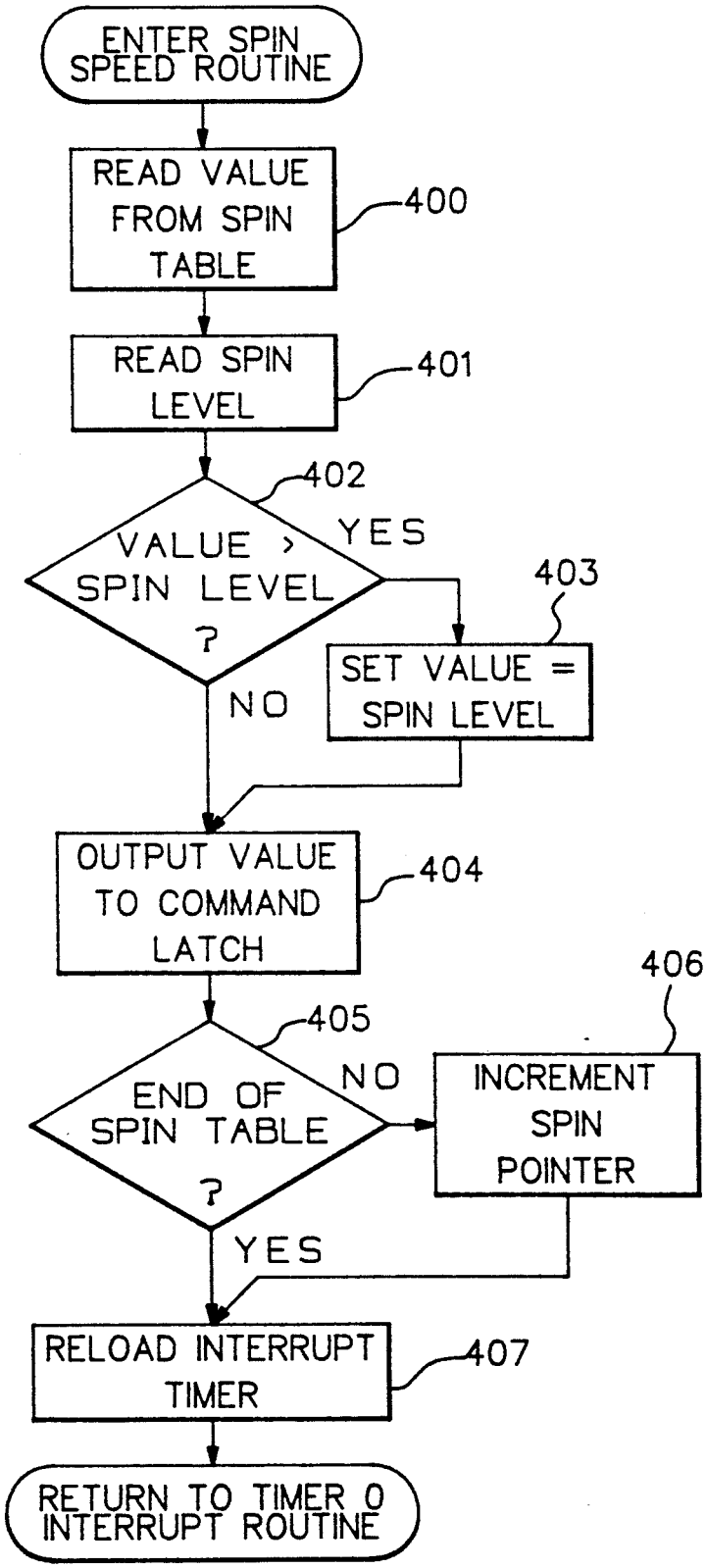
FIG. 20 is a simplified flow diagram of the Spin Speed routine incorporated in the control program of FIG. 4.

When the Spin Speed routine illustrated in FIG. 20 is entered, the next value from the spin table is read at block 400 and the control determined maximum spin level is read at block 401. (The maximum spin level conforms to the load size and blend as determined at the appropriate one of box 203–203*b* (FIG. 11C), 219–219*b* (FIG. 11D), 235–235*b* (FIG. 11E) or 251–251*b* (FIG. 11F)). Inquiry 402 determines whether the value read from the spin table at block 400 is greater than the spin level read at block 401. If yes the spin value is set to equal the spin level at block 403 and this value is outputted to the command latch at block 404. If inquiry 402 determines that the value from block 400 is not greater than the spin level from block 401 the spin value, without change, is outputted to the command latch. This assures that the actual spin speed does not exceed the predetermined maximum level. Output of the spin value at block 404 provides a speed control signal to the motor to provide a spin or centrifugal extraction operation. Inquiry 405 determines whether the end of the spin table has been reached. If yes, the initial value is reloaded into the interrupt timer at block 407 and the program returns to the Timer 0 Interrupt routine at block 325 in FIG. 14. If the end of the spin table has not been reached, then the spin pointer is incremented at block 406; the initial value is reloaded into the interrupt timer at block 407 and the program then returns to the Timer 0 Interrupt routine. The dual path from inquiry 402 to block 404 provides a control in which the motor and basket are accelerated up essentially the same curve regardless of the load size or fabric blend but the constant terminal speed varies depending upon the desired speed selected by the user or the automatic routine. In the illustrative example this terminal speed is tied to the load size and blend type decision made by the machine when in automatic mode. It will be noted from FIG. 25 that the 25% cotton mini load size terminal speed is the lowest and the 87.5% cotton large load size terminal speed is the highest. In fact, the 87.5% cotton large load terminal speed conveniently can be the default terminal speed of the table of predetermined spin values (Appendix E) stored in the microprocessor ROM.

Figure 21:
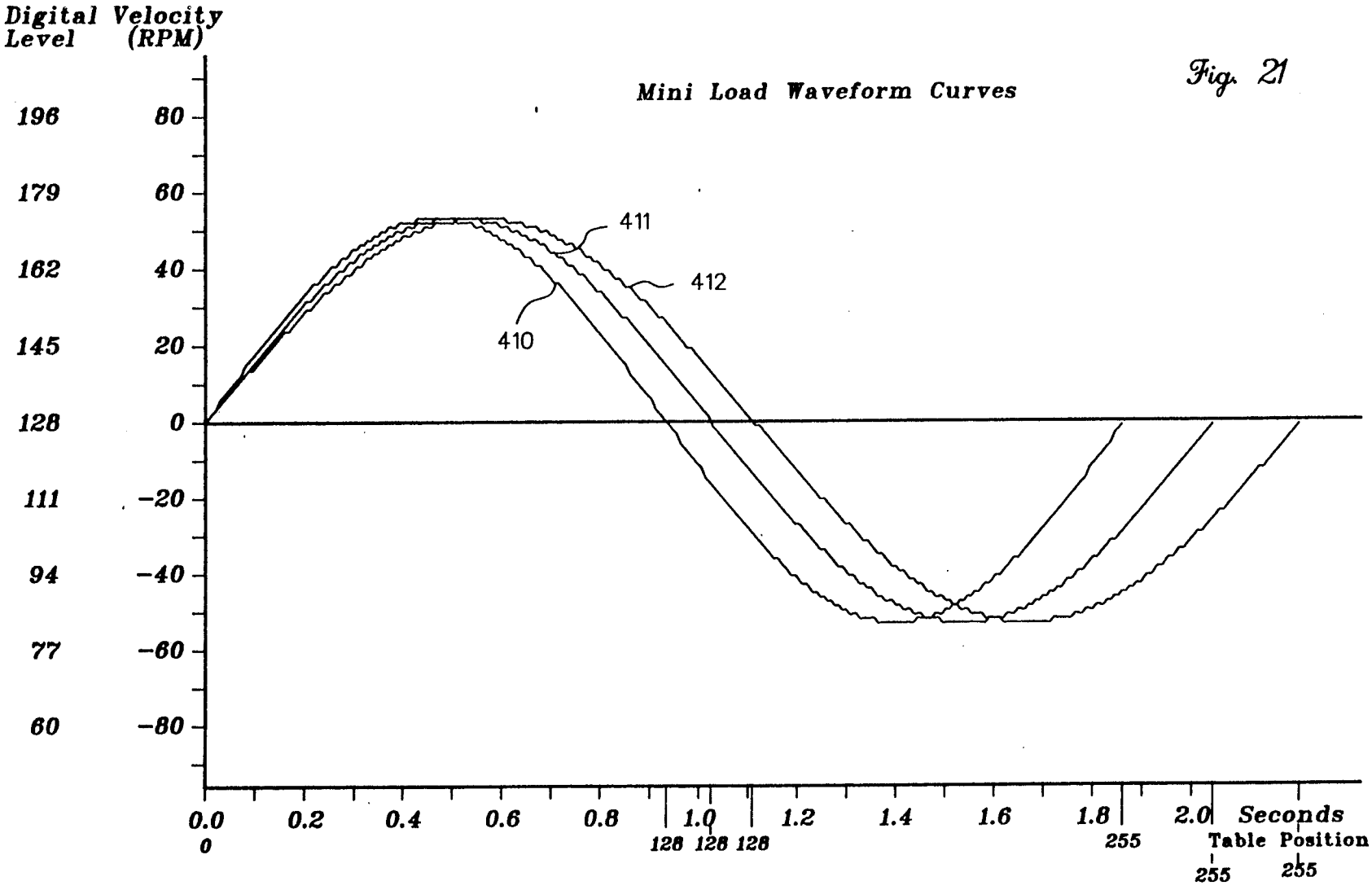
FIG. 21 illustrates an exemplification rotor wave shapes for agitation of a mini clothes load.

Referring now to the washer agitate tables, Appendices A–D, inclusive, and to FIGS. 21–24, several aspects of the present invention will become more apparent. FIGS. 21–24 illustrate rotor and basket or container angular velocities corresponding to the value sets or look up tables of Appendices A–D respectively. In each of FIGS. 21–24 the horizontal axis represents time and the memory look-up table position of particular values. The vertical axis is the velocity in rpm and the direction, with +values corresponding to clockwise and −values corresponding to counterclockwise movement. In addition, the equivalent digital values of the 8 bit bytes stored in the look-up tables and corresponding to velocities are indicated on the vertical axis. Referring particularly to FIG. 21, where velocity curve 412 corresponds to the 25% cotton mini load, velocity curve 411 corresponds to the 62.5% cotton mini load, and velocity curve 410 corresponds to the 87.5% cotton load. The velocity curve 412 is essentially sinusoidal, although the curve consists of a discrete number (256) of steps corresponding to the values sequentially called up from the look-up table. In just under half a second the motor and basket reach a peak speed of about 55 rpm in a first, or clockwise, direction. At just over 0.9 seconds the motor and basket decelerate to zero speed. At just under 1.4 seconds the motor and basket accelerate to a peak speed of about 55 rpm in the other, or counterclockwise, direction and at just under 1.9 seconds the motor and basket decelerate to zero angular velocity, finishing one complete stroke.

Figure 22:
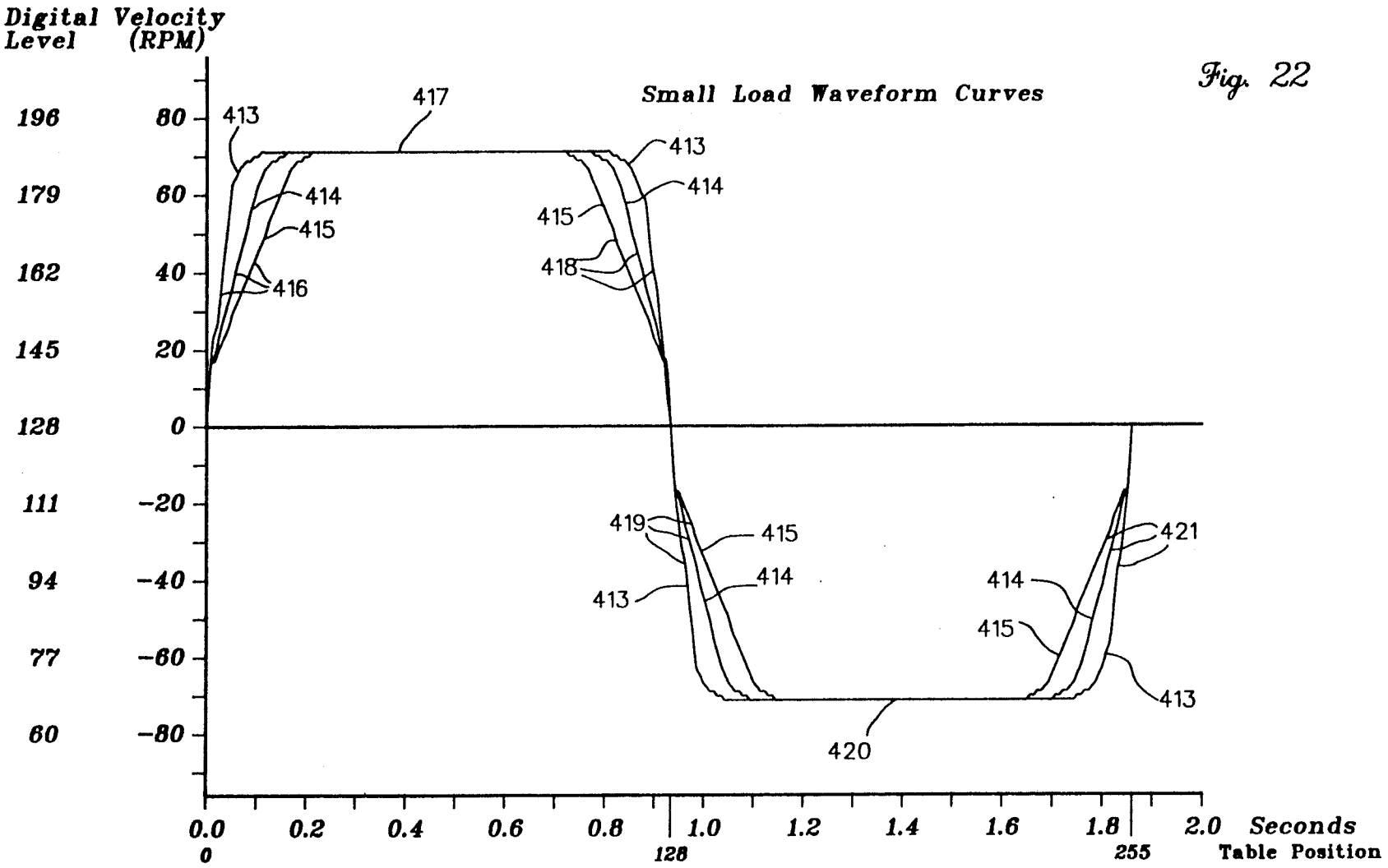
FIG. 22 illustrates an exemplification rotor velocity wave shapes for agitation of a small clothes load.

By contrast the exemplification small load wash stroke illustrated in FIG. 22, where velocity curve 415 corresponds to 25% cotton small load, velocity curve 414 corresponds to the 62.5% cotton small load, and velocity curve 413 corresponds to the 87.5% cotton load. These curves include an acceleration in the first direction phase 416; constant speed in the first direction phase 417; deceleration in the first direction phase 418; acceleration in the other direction phase 419; constant speed in the other direction phase 420 and deceleration in the other or second direction phase 421.

Figure 23:
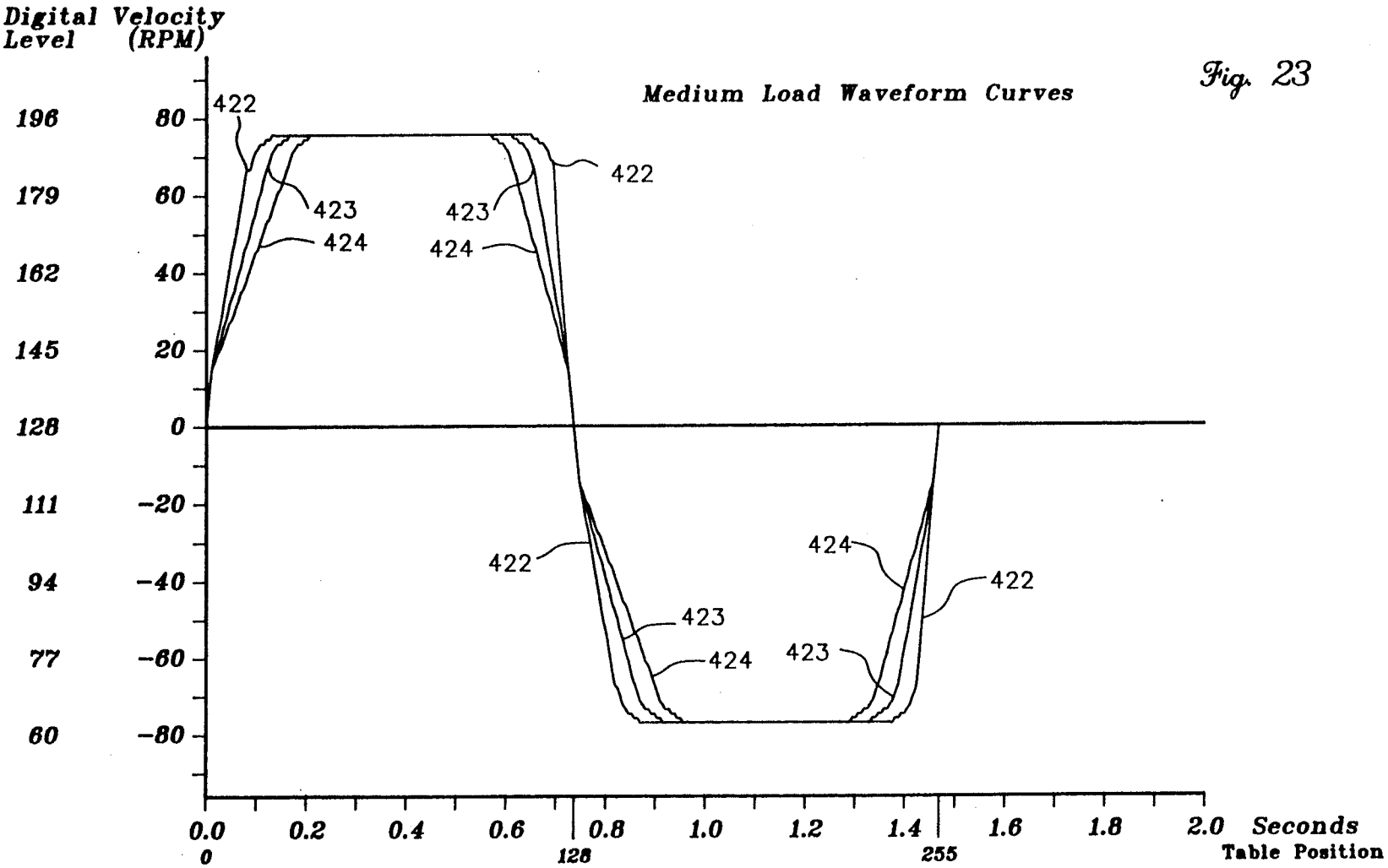
FIG. 23 illustrates an exemplification rotor velocity wave shapes for agitation of a medium clothes load.

Corresponding phases of the velocity curves for medium loads of various blends are detailed in FIG. 23, where velocity curve 424 corresponds to the 25% cotton medium load, velocity curve 423 corresponds to the 62.5% cotton medium load, and velocity curve 422 corresponds to the 87.5% cotton medium load. Corresponding phases of the velocity curves for large loads are detailed in FIG. 24, where velocity curve 427 corresponds to the 25% cotton large load, velocity curve 426 corresponds to the 62.5% cotton large load, and velocity curve 425 corresponds to the 87.5% cotton large load.

Mechanical washing action of fabrics occurs when there is relative velocity between the fabrics and basket, or between the fabrics and water (and to the extent there is relative motion between adjacent fabrics). When the basket begins to accelerate, the water and fabrics initially remain stationary. As the basket continues to accelerate, the water and fabrics accelerate, with the water velocity lagging the basket velocity and the fabric velocity slightly lagging the water velocity. The water velocity equals the basket velocity a short time after the basket reaches its steady state velocity and the fabric velocity equals the basket velocity after an additional short time. Once the water and fabrics reach the velocity of the basket, minimal mechanical washing of the fabrics occurs so long as the velocity of the basket, water and fabrics remain constant.

During deceleration mechanical washing action takes place in the same manner as in acceleration; that is, as a result of relative motion between the fabrics on the one hand and the basket and water on the other hand. Deceleration uses the energy stored in the system in the form of the steady state velocity of the basket, water and fabrics and therefore there is no need to add energy to the system. In fact, the motor 14 acts as a generator and generates electrical energy which is returned to the power supply system or dissipated as heat. Taking advantage of this fact, in each of the exemplary wash cycles of FIGS. 22–24 the deceleration rate is greater than the corresponding acceleration rate. This causes greater relative motion and greater mechanical washing. This is accomplished with minimum stress on the drive system of the washing machine as it does not have to input energy (torque) to the basket. It will be understood that a lower deceleration rate would result in less relative motion and mechanical washing action even though the same amount of energy is dissipated in going from the steady state velocity to zero velocity.

Mechanical washing action is one major contributor to effectively washing modern fabrics. Another major factor is the chemical action of detergents. The effectiveness of each of these factors varies depending on the types of fabric involved. For example, with an effective minimal detergent concentration, the wash effectiveness (washability) of cotton fabrics varies appreciably with the amount of the mechanical wash action applied. That is, increasing the mechanical action increases washability. However, increasing the detergent concentration does not appreciably increase the washability. On the other hand, with effective minimal mechanical wash action, the washability of synthetic fabrics varies appreciably with the detergent concentration and with time. However, increased mechanical action does not appreciably increase the washability.

A typical load of fabrics currently washed in an automatic washing machine is mixed; that is, it may include some cotton fabrics, some synthetic fabrics and some fabrics which are blends of cotton and synthetic fabrics. Thus, wash cycles need to take into account the varying make-up of the loads that will be washed.

Figure 24:
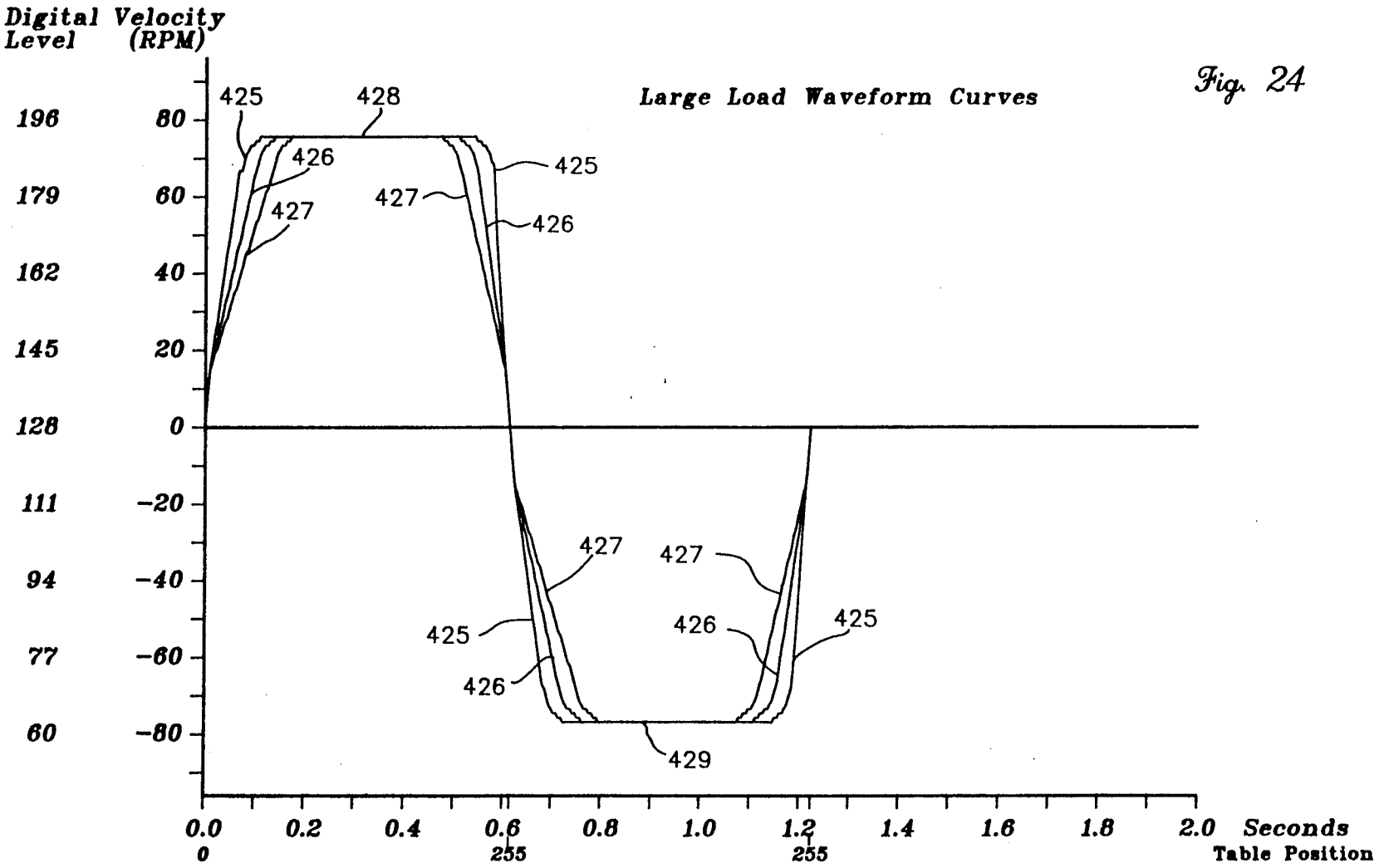
FIG. 24 illustrates an exemplification rotor velocity wave shapes for agitation of a large clothes load.

Comparing FIGS. 22, 23 and 24, it will be noted that the acceleration rates, deceleration rates and steady-state velocities are all different depending on the load size and type. The acceleration rate is highest for small loads, next highest for medium loads and lowest for large loads. With a small load, the water and fabric velocities most quickly catch up with the basket velocity. The acceleration rates for the lower percentage cotton loads for each size are lower than the high percentage cotton loads. Consequently, a higher acceleration rate assures adequate continuing mechanical wash action. As the load size increases, continuing mechanical wash action can be assured with a lower acceleration rate. Since energy input is not required for deceleration, it has been maximized for all three exemplification strokes of FIGS. 22–24.

It will be further noted that the steady state velocity is lowest for the small load, higher for the medium load, and highest for the large load. When the maximum velocity is higher, the time of acceleration and deceleration are longer, which results in more mechanical wash action.

The curves of FIGS. 22–24 plot the velocity of the motor rotor and thus the basket. They do not plot the velocities of the water and fabrics. As previously noted, the larger the load the greater the delay in the water and fabrics reaching the steady state velocity of the basket. Consequently, the basket (motor) steady state phases (428 and 429 in FIG. 25) for a large load should be long enough for the water and fabric velocities to reach the basket steady state velocity before motor deceleration begins.

At least from a mechanical washing action standpoint the steady state velocity phases (417 and 420 in FIG. 22) for a small load can be shorter than the steady state velocity phases for a medium load and the steady state velocity phases for a medium load can be shorter than for a large load. However, it will be noted that, in the exemplification strokes of FIGS. 22–24, the reverse relationship is illustrated; that is, the steady state velocity phases for a small load are the longest. This provides sufficient time for appropriate chemical action and takes into account the currently commercially preferred practice of having the wash cycle be of a uniform length regardless of the load size.

Assuming that the wash cycle has a uniform length, for example fifteen minutes, the number of small load strokes (FIG. 22) will be fewest and the number of large load strokes (FIG. 24) will be greatest. Since there is minimal mechanical wash action at steady state velocity, the long steady state velocity phases (417 and 420 in FIG. 22) for the small load do not provide unneeded mechanical washing at the price of unnecessary wear of the fabrics.

Of course, if it is desired to have the length of the wash cycle vary with the load size, then the steady state velocity phases can be shortened as the load size decreases. In that case, for best results the water and fabric velocities should reach the basket steady state velocity before deceleration begins and sufficient time should be allotted to the wash cycle for each load size to provide appropriate mechanical and chemical wash action.

It will be noted from Appendices A–D that one stroke for each load size uses 256 (0–255) table positions or call ups of individual values. However, one stroke for the 87.5% cotton small load requires almost 1.9 seconds, one stroke for the 87.5% cotton medium load requires just under 1.5 seconds and one stroke for the 87.5% cotton large load requires just over 1.2 seconds. Thus it is clear that the periods between call ups or the frequency of call up varies from load size to load size. While the acceleration and deceleration phases look somewhat similar in the drawings, the slopes are considerably different. A comparison of the load tables of Appendices B, C and D show that they are independent and, in many ways, asymmetric. For example, comparing the initial portions of the value tables, in the 87.5% cotton small load table there are 11 values between the initial 128 and the maximum speed value of 187; there are 107 repetitions of the value 187 and there are 9 values between the last 187 and the next 128. In the 87.5% cotton medium load curve there are 18 values between the first 128 and the maximum speed value of 192; there are 99 repeats of the value 192 and there are 9 values between the last 192 and the next value 128. In the 87.5% cotton large load curve there are 35 values between the initial 128 and the maximum velocity value 195; there are 77 repeats of the value 195 and there are 14 values between the last 195 and the next 128 value. In summary, the stroke curves have a different number of values in the acceleration phase (11, 18 and 35 respectively); a different number of repeats of the maximum speed value (107, 99, 77 respectively) and a different number of values in the deceleration phase (9, 9, and 14 respectively). Also the maximum velocity value varies with load size, with the small load value being lowest (187), the medium load value being next (192) and the large load value being highest (195). A comparison of the load tables will show that the incremental changes in speed in the acceleration phases or in the deceleration phases of strokes for different load sizes as well as between the acceleration and deceleration phases of the same stroke are asymmetric.

Two portions of the velocity profiles of the illustrative strokes of FIGS. 22–24 are optimized for reliability of the electronic control. Acceleration is decreased in steps as the steady state velocity is approached rather than abruptly shifting from acceleration to steady state operation. Second, the velocity profile very rapidly transitions from deceleration to acceleration. That is, it passes through the zero motor speed value of 128 with a very high rate of change.

The illustrative embodiments of this invention illustrated and described herein incorporate a control which operates the machine to automatically determine the size or weight of a load of fabrics and to automatically determine the blend or mix of fibers of the fabric load in the automatic washer. The illustrative washing machine includes a basket or container which is directly driven by a SRM for oscillation and unidirectional rotation. However, it will be apparent that various aspects of this invention have broader application. For example certain aspects of the invention are applicable to washing machines having other motors, particularly other types of electronically commutated motors. Also various aspects of this invention are applicable to washing machines which have separate agitators or means other than an oscillating basket to impart agitation motion and energy to the fabrics and fluid. In addition, each of the load size and blend determination aspects of this invention can be implemented independent of the other aspect. It will be apparent to those skilled in the art that, while I have described what I presently consider to be the preferred embodiments of my invention in accordance with the patent statutes, changes may be made in the disclosed embodiments without departing from the true spirit and scope of the invention.

APPENDIX A

25% COTTON MINI LOAD DIGITAL WAVEFORM

| | | | | | | | | | | | | | | | |
|---|---|---|---|---|---|---|---|---|---|---|---|---|---|---|---|
| 128 | 129 | 130 | 131 | 133 | 134 | 135 | 136 | 137 | 138 | 139 | 141 | 142 | 143 | 144 | 145 |
| 146 | 147 | 148 | 149 | 150 | 151 | 152 | 153 | 154 | 155 | 156 | 157 | 158 | 159 | 160 | 160 |
| 161 | 162 | 163 | 164 | 164 | 165 | 166 | 166 | 167 | 168 | 168 | 169 | 169 | 170 | 170 | 171 |
| 171 | 172 | 172 | 173 | 173 | 173 | 174 | 174 | 174 | 174 | 174 | 175 | 175 | 175 | 175 | 175 |
| 175 | 175 | 175 | 175 | 175 | 175 | 174 | 174 | 174 | 174 | 174 | 173 | 173 | 173 | 172 | 172 |
| 171 | 171 | 170 | 170 | 169 | 169 | 168 | 168 | 167 | 166 | 166 | 165 | 164 | 164 | 163 | 162 |
| 161 | 160 | 160 | 159 | 158 | 157 | 156 | 155 | 154 | 153 | 152 | 151 | 150 | 149 | 148 | 147 |
| 146 | 145 | 144 | 143 | 142 | 141 | 139 | 138 | 137 | 136 | 135 | 134 | 133 | 131 | 130 | 129 |
| 128 | 127 | 126 | 125 | 123 | 122 | 121 | 120 | 119 | 118 | 117 | 115 | 114 | 113 | 112 | 111 |
| 110 | 109 | 108 | 107 | 106 | 105 | 104 | 103 | 102 | 101 | 100 | 99 | 98 | 97 | 96 | 96 |
| 95 | 94 | 93 | 92 | 92 | 91 | 90 | 90 | 89 | 88 | 88 | 87 | 87 | 86 | 86 | 85 |
| 85 | 84 | 84 | 83 | 83 | 83 | 82 | 82 | 82 | 82 | 82 | 81 | 81 | 81 | 81 | 81 |
| 81 | 81 | 81 | 81 | 81 | 81 | 82 | 82 | 82 | 82 | 82 | 83 | 83 | 83 | 84 | 84 |
| 85 | 85 | 86 | 86 | 87 | 87 | 88 | 88 | 89 | 90 | 90 | 91 | 92 | 92 | 93 | 94 |
| 95 | 96 | 96 | 97 | 98 | 99 | 100 | 101 | 102 | 103 | 104 | 105 | 106 | 107 | 108 | 109 |
| 110 | 111 | 112 | 113 | 114 | 115 | 117 | 118 | 119 | 120 | 121 | 122 | 123 | 125 | 126 | 127 |

62.5% COTTON MINI LOAD DIGITAL WAVEFORM

| | | | | | | | | | | | | | | | |
|---|---|---|---|---|---|---|---|---|---|---|---|---|---|---|---|
| 128 | 129 | 130 | 131 | 133 | 134 | 135 | 136 | 137 | 138 | 139 | 141 | 142 | 143 | 144 | 145 |
| 146 | 147 | 148 | 149 | 150 | 151 | 152 | 153 | 154 | 155 | 156 | 157 | 158 | 159 | 160 | 160 |
| 161 | 162 | 163 | 164 | 164 | 165 | 166 | 166 | 167 | 168 | 168 | 169 | 169 | 170 | 170 | 171 |
| 171 | 172 | 172 | 173 | 173 | 173 | 174 | 174 | 174 | 174 | 174 | 175 | 175 | 175 | 175 | 175 |
| 175 | 175 | 175 | 175 | 175 | 175 | 174 | 174 | 174 | 174 | 174 | 173 | 173 | 173 | 172 | 172 |
| 171 | 171 | 170 | 170 | 169 | 169 | 168 | 168 | 167 | 166 | 166 | 165 | 164 | 164 | 163 | 162 |
| 161 | 160 | 160 | 159 | 158 | 157 | 156 | 155 | 154 | 153 | 152 | 151 | 150 | 149 | 148 | 147 |
| 146 | 145 | 144 | 143 | 142 | 141 | 139 | 138 | 137 | 136 | 135 | 134 | 133 | 131 | 130 | 129 |

APPENDIX A-continued

| | | | | | | | | | | | | | | | |
|---|---|---|---|---|---|---|---|---|---|---|---|---|---|---|---|
| 128 | 127 | 126 | 125 | 123 | 122 | 121 | 120 | 119 | 118 | 117 | 115 | 114 | 113 | 112 | 111 |
| 110 | 109 | 108 | 107 | 106 | 105 | 104 | 103 | 102 | 101 | 100 | 99 | 98 | 97 | 96 | 96 |
| 95 | 94 | 93 | 92 | 92 | 91 | 90 | 90 | 89 | 88 | 88 | 87 | 87 | 86 | 86 | 85 |
| 85 | 84 | 84 | 83 | 83 | 83 | 82 | 82 | 82 | 82 | 82 | 81 | 81 | 81 | 81 | 81 |
| 81 | 81 | 81 | 81 | 81 | 81 | 82 | 82 | 82 | 82 | 82 | 83 | 83 | 83 | 84 | 84 |
| 85 | 85 | 86 | 86 | 87 | 87 | 88 | 88 | 89 | 90 | 90 | 91 | 92 | 92 | 93 | 94 |
| 95 | 96 | 96 | 97 | 98 | 99 | 100 | 101 | 102 | 103 | 104 | 105 | 106 | 107 | 108 | 109 |
| 110 | 111 | 112 | 113 | 114 | 115 | 117 | 118 | 119 | 120 | 121 | 122 | 123 | 125 | 126 | 127 |

87.5% COTTON MINI LOAD DIGITAL WAVEFORM

| | | | | | | | | | | | | | | | |
|---|---|---|---|---|---|---|---|---|---|---|---|---|---|---|---|
| 128 | 129 | 130 | 131 | 133 | 134 | 135 | 136 | 137 | 138 | 139 | 141 | 142 | 143 | 144 | 145 |
| 146 | 147 | 148 | 149 | 150 | 151 | 152 | 153 | 154 | 155 | 156 | 157 | 158 | 159 | 160 | 160 |
| 161 | 162 | 163 | 164 | 164 | 165 | 166 | 166 | 167 | 168 | 168 | 169 | 169 | 170 | 170 | 171 |
| 171 | 172 | 172 | 173 | 173 | 173 | 174 | 174 | 174 | 174 | 174 | 175 | 175 | 175 | 175 | 175 |
| 175 | 175 | 175 | 175 | 175 | 175 | 174 | 174 | 174 | 174 | 174 | 173 | 173 | 173 | 172 | 172 |
| 171 | 171 | 170 | 170 | 169 | 169 | 168 | 168 | 167 | 166 | 166 | 165 | 164 | 164 | 163 | 162 |
| 161 | 160 | 160 | 159 | 158 | 157 | 156 | 155 | 154 | 153 | 152 | 151 | 150 | 149 | 148 | 147 |
| 146 | 145 | 144 | 143 | 142 | 141 | 139 | 138 | 137 | 136 | 135 | 134 | 133 | 131 | 130 | 129 |
| 128 | 127 | 126 | 125 | 123 | 122 | 121 | 120 | 119 | 118 | 117 | 115 | 114 | 113 | 112 | 111 |
| 110 | 109 | 108 | 107 | 106 | 105 | 104 | 103 | 102 | 101 | 100 | 99 | 98 | 97 | 96 | 96 |
| 95 | 94 | 93 | 92 | 92 | 91 | 90 | 90 | 89 | 88 | 88 | 87 | 87 | 86 | 86 | 85 |
| 85 | 84 | 84 | 83 | 83 | 83 | 82 | 82 | 82 | 82 | 82 | 81 | 81 | 81 | 81 | 81 |
| 81 | 81 | 81 | 81 | 81 | 81 | 82 | 82 | 82 | 82 | 82 | 83 | 83 | 83 | 84 | 84 |
| 85 | 85 | 86 | 86 | 87 | 87 | 88 | 88 | 89 | 90 | 90 | 91 | 92 | 92 | 93 | 94 |
| 95 | 96 | 96 | 97 | 98 | 99 | 100 | 101 | 102 | 103 | 104 | 105 | 106 | 107 | 108 | 109 |
| 110 | 111 | 112 | 113 | 114 | 115 | 117 | 118 | 119 | 120 | 121 | 122 | 123 | 125 | 126 | 127 |

APPENDIX B

25% COTTON SMALL LOAD DIGITAL WAVEFORM

| | | | | | | | | | | | | | | | |
|---|---|---|---|---|---|---|---|---|---|---|---|---|---|---|---|
| 128 | 141 | 143 | 145 | 147 | 149 | 151 | 154 | 156 | 158 | 160 | 162 | 164 | 166 | 168 | 170 |
| 172 | 175 | 177 | 179 | 181 | 183 | 185 | 187 | 188 | 189 | 189 | 190 | 190 | 191 | 191 | 191 |
| 191 | 191 | 191 | 191 | 191 | 191 | 191 | 191 | 191 | 191 | 191 | 191 | 191 | 191 | 191 | 191 |
| 191 | 191 | 191 | 191 | 191 | 191 | 191 | 191 | 191 | 191 | 191 | 191 | 191 | 191 | 191 | 191 |
| 191 | 191 | 191 | 191 | 191 | 191 | 191 | 191 | 191 | 191 | 191 | 191 | 191 | 191 | 191 | 191 |
| 191 | 191 | 191 | 191 | 191 | 191 | 191 | 191 | 191 | 191 | 191 | 191 | 191 | 191 | 191 | 191 |
| 191 | 191 | 191 | 191 | 190 | 190 | 189 | 189 | 188 | 187 | 185 | 183 | 181 | 179 | 177 | 175 |
| 173 | 170 | 168 | 166 | 164 | 162 | 160 | 158 | 156 | 154 | 152 | 149 | 147 | 145 | 143 | 141 |
| 128 | 115 | 113 | 111 | 109 | 107 | 105 | 102 | 100 | 98 | 96 | 94 | 92 | 90 | 88 | 86 |
| 84 | 81 | 79 | 77 | 75 | 73 | 71 | 69 | 68 | 67 | 67 | 66 | 66 | 65 | 65 | 65 |
| 65 | 65 | 65 | 65 | 65 | 65 | 65 | 65 | 65 | 65 | 65 | 65 | 65 | 65 | 65 | 65 |
| 65 | 65 | 65 | 65 | 65 | 65 | 65 | 65 | 65 | 65 | 65 | 65 | 65 | 65 | 65 | 65 |
| 65 | 65 | 65 | 65 | 65 | 65 | 65 | 65 | 65 | 65 | 65 | 65 | 65 | 65 | 65 | 65 |
| 65 | 65 | 65 | 65 | 65 | 65 | 65 | 65 | 65 | 65 | 65 | 65 | 65 | 65 | 65 | 65 |
| 65 | 65 | 65 | 66 | 66 | 67 | 67 | 68 | 69 | 71 | 73 | 75 | 77 | 79 | 81 | 83 |
| 86 | 88 | 90 | 92 | 94 | 96 | 98 | 100 | 102 | 104 | 107 | 109 | 111 | 113 | 115 | 128 |

62.5% COTTON SMALL LOAD DIGITAL WAVEFORM

| | | | | | | | | | | | | | | | |
|---|---|---|---|---|---|---|---|---|---|---|---|---|---|---|---|
| 128 | 141 | 144 | 147 | 151 | 154 | 157 | 160 | 164 | 167 | 170 | 173 | 177 | 180 | 183 | 185 |
| 187 | 188 | 189 | 189 | 190 | 190 | 191 | 191 | 191 | 191 | 191 | 191 | 191 | 191 | 191 | 191 |
| 191 | 191 | 191 | 191 | 191 | 191 | 191 | 191 | 191 | 191 | 191 | 191 | 191 | 191 | 191 | 191 |
| 191 | 191 | 191 | 191 | 191 | 191 | 191 | 191 | 191 | 191 | 191 | 191 | 191 | 191 | 191 | 191 |
| 191 | 191 | 191 | 191 | 191 | 191 | 191 | 191 | 191 | 191 | 191 | 191 | 191 | 191 | 191 | 191 |
| 191 | 191 | 191 | 191 | 191 | 191 | 191 | 191 | 191 | 191 | 191 | 191 | 191 | 191 | 191 | 191 |
| 191 | 191 | 191 | 191 | 191 | 191 | 191 | 191 | 191 | 191 | 191 | 190 | 190 | 189 | 189 | 188 |
| 187 | 185 | 183 | 180 | 177 | 173 | 170 | 167 | 164 | 160 | 157 | 154 | 151 | 147 | 144 | 141 |
| 128 | 115 | 112 | 109 | 105 | 102 | 99 | 96 | 92 | 89 | 86 | 83 | 79 | 76 | 73 | 71 |
| 69 | 68 | 67 | 67 | 66 | 66 | 65 | 65 | 65 | 65 | 65 | 65 | 65 | 65 | 65 | 65 |
| 65 | 65 | 65 | 65 | 65 | 65 | 65 | 65 | 65 | 65 | 65 | 65 | 65 | 65 | 65 | 65 |
| 65 | 65 | 65 | 65 | 65 | 65 | 65 | 65 | 65 | 65 | 65 | 65 | 65 | 65 | 65 | 65 |
| 65 | 65 | 65 | 65 | 65 | 65 | 65 | 65 | 65 | 65 | 65 | 65 | 65 | 65 | 65 | 65 |
| 65 | 65 | 65 | 65 | 65 | 65 | 65 | 65 | 65 | 65 | 65 | 65 | 65 | 65 | 65 | 65 |
| 65 | 65 | 65 | 65 | 65 | 65 | 65 | 65 | 65 | 65 | 66 | 66 | 67 | 67 | 68 | 69 |
| 71 | 73 | 76 | 79 | 83 | 86 | 89 | 92 | 96 | 99 | 102 | 105 | 109 | 112 | 115 | 128 |

87.5% COTTON SMALL LOAD DIGITAL WAVEFORM

| | | | | | | | | | | | | | | | |
|---|---|---|---|---|---|---|---|---|---|---|---|---|---|---|---|
| 128 | 141 | 149 | 152 | 160 | 168 | 175 | 183 | 185 | 187 | 188 | 189 | 189 | 190 | 190 | 191 |
| 191 | 191 | 191 | 191 | 191 | 191 | 191 | 191 | 191 | 191 | 191 | 191 | 191 | 191 | 191 | 191 |
| 191 | 191 | 191 | 191 | 191 | 191 | 191 | 191 | 191 | 191 | 191 | 191 | 191 | 191 | 191 | 191 |
| 191 | 191 | 191 | 191 | 191 | 191 | 191 | 191 | 191 | 191 | 191 | 191 | 191 | 191 | 191 | 191 |
| 191 | 191 | 191 | 191 | 191 | 191 | 191 | 191 | 191 | 191 | 191 | 191 | 191 | 191 | 191 | 191 |
| 191 | 191 | 191 | 191 | 191 | 191 | 191 | 191 | 191 | 191 | 191 | 191 | 191 | 191 | 191 | 191 |
| 191 | 191 | 191 | 191 | 191 | 191 | 191 | 191 | 191 | 191 | 191 | 191 | 191 | 191 | 191 | 191 |
| 190 | 190 | 189 | 189 | 188 | 187 | 185 | 183 | 181 | 179 | 171 | 164 | 160 | 152 | 145 | 135 |
| 128 | 115 | 107 | 100 | 96 | 88 | 81 | 73 | 71 | 69 | 68 | 67 | 67 | 66 | 66 | 65 |
| 65 | 65 | 65 | 65 | 65 | 65 | 65 | 65 | 65 | 65 | 65 | 65 | 65 | 65 | 65 | 65 |
| 65 | 65 | 65 | 65 | 65 | 65 | 65 | 65 | 65 | 65 | 65 | 65 | 65 | 65 | 65 | 65 |
| 65 | 65 | 65 | 65 | 65 | 65 | 65 | 65 | 65 | 65 | 65 | 65 | 65 | 65 | 65 | 65 |
| 65 | 65 | 65 | 65 | 65 | 65 | 65 | 65 | 65 | 65 | 65 | 65 | 65 | 65 | 65 | 65 |
| 65 | 65 | 65 | 65 | 65 | 65 | 65 | 65 | 65 | 65 | 65 | 65 | 65 | 65 | 65 | 65 |
| 65 | 65 | 65 | 65 | 65 | 65 | 65 | 65 | 65 | 65 | 65 | 65 | 65 | 65 | 65 | 65 |

APPENDIX B-continued

| | | | | | | | | | | | | | | | |
|---|---|---|---|---|---|---|---|---|---|---|---|---|---|---|---|
| 66 | 66 | 67 | 67 | 68 | 69 | 71 | 73 | 76 | 79 | 87 | 95 | 99 | 107 | 115 | 128 |

APPENDIX C

25% COTTON MEDIUM LOAD DIGITAL WAVEFORM

| | | | | | | | | | | | | | | | |
|---|---|---|---|---|---|---|---|---|---|---|---|---|---|---|---|
| 128 | 135 | 141 | 143 | 145 | 146 | 148 | 150 | 152 | 153 | 155 | 157 | 159 | 160 | 162 | 164 |
| 166 | 168 | 169 | 171 | 173 | 175 | 176 | 178 | 180 | 182 | 183 | 185 | 187 | 189 | 191 | 192 |
| 193 | 193 | 194 | 194 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 194 | 194 | 193 | 193 | 192 | 191 | 189 | 187 | 185 | 182 | 180 | 177 |
| 175 | 172 | 170 | 168 | 165 | 163 | 160 | 158 | 156 | 153 | 151 | 148 | 146 | 143 | 141 | 135 |
| 128 | 121 | 115 | 113 | 111 | 110 | 108 | 106 | 104 | 103 | 101 | 99 | 97 | 96 | 94 | 92 |
| 90 | 88 | 87 | 85 | 83 | 81 | 80 | 78 | 76 | 74 | 73 | 71 | 69 | 67 | 65 | 64 |
| 63 | 63 | 62 | 62 | 61 | 61 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 61 | 61 | 62 | 62 | 63 | 63 | 64 | 65 | 67 | 69 | 71 | 74 | 76 | 79 | 81 |
| 84 | 86 | 88 | 91 | 93 | 96 | 98 | 100 | 103 | 105 | 108 | 110 | 113 | 115 | 121 | 128 |

62.5% COTTON MEDIUM LOAD DIGITAL WAVEFORM

| | | | | | | | | | | | | | | | |
|---|---|---|---|---|---|---|---|---|---|---|---|---|---|---|---|
| 128 | 135 | 141 | 143 | 146 | 148 | 151 | 153 | 156 | 158 | 160 | 163 | 165 | 168 | 170 | 172 |
| 175 | 177 | 180 | 182 | 185 | 187 | 189 | 191 | 192 | 193 | 193 | 194 | 194 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 194 | 194 | 193 | 193 | 192 |
| 191 | 189 | 187 | 183 | 179 | 176 | 172 | 168 | 164 | 160 | 156 | 153 | 149 | 145 | 141 | 135 |
| 128 | 121 | 115 | 113 | 110 | 108 | 105 | 103 | 100 | 98 | 96 | 93 | 91 | 88 | 86 | 84 |
| 81 | 79 | 76 | 74 | 71 | 69 | 67 | 65 | 64 | 63 | 63 | 62 | 62 | 61 | 61 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 61 | 61 | 62 | 62 | 63 | 63 | 64 | 65 |
| 67 | 69 | 73 | 77 | 80 | 84 | 88 | 92 | 96 | 100 | 103 | 107 | 111 | 115 | 121 | 128 |

87.5% COTTON MEDIUM LOAD DIGITAL WAVEFORM

| | | | | | | | | | | | | | | | |
|---|---|---|---|---|---|---|---|---|---|---|---|---|---|---|---|
| 128 | 135 | 141 | 145 | 149 | 152 | 156 | 160 | 164 | 168 | 171 | 175 | 179 | 183 | 187 | 187 |
| 189 | 191 | 192 | 193 | 193 | 194 | 194 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 194 | 194 | 193 | 193 | 192 | 191 | 189 | 187 | 174 | 165 | 157 | 149 | 141 | 135 |
| 128 | 121 | 115 | 111 | 107 | 104 | 100 | 96 | 92 | 88 | 84 | 81 | 77 | 73 | 69 | 68 |
| 66 | 64 | 63 | 62 | 62 | 61 | 61 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 61 | 61 | 62 | 62 | 63 | 64 | 66 | 68 | 74 | 82 | 90 | 99 | 107 | 115 | 121 | 128 |

APPENDIX D

25% COTTON LARGE LOAD DIGITAL WAVEFORM

| | | | | | | | | | | | | | | | |
|---|---|---|---|---|---|---|---|---|---|---|---|---|---|---|---|
| 128 | 135 | 141 | 143 | 145 | 146 | 148 | 150 | 152 | 153 | 155 | 157 | 159 | 160 | 162 | 164 |
| 166 | 168 | 169 | 171 | 173 | 175 | 176 | 178 | 180 | 182 | 183 | 185 | 187 | 189 | 191 | 192 |
| 193 | 193 | 194 | 194 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 194 | 194 | 193 | 193 | 192 | 191 | 189 | 187 | 185 | 182 | 180 | 177 |
| 175 | 172 | 170 | 168 | 165 | 163 | 160 | 158 | 156 | 153 | 151 | 148 | 146 | 143 | 141 | 135 |
| 128 | 121 | 115 | 113 | 111 | 110 | 108 | 106 | 104 | 103 | 101 | 99 | 97 | 96 | 94 | 92 |
| 90 | 88 | 87 | 85 | 83 | 81 | 80 | 78 | 76 | 74 | 73 | 71 | 69 | 67 | 65 | 64 |
| 63 | 63 | 62 | 62 | 61 | 61 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 61 | 61 | 62 | 62 | 63 | 63 | 64 | 65 | 67 | 69 | 71 | 74 | 76 | 79 | 81 |
| 84 | 86 | 88 | 91 | 93 | 96 | 98 | 100 | 103 | 105 | 108 | 110 | 113 | 115 | 121 | 128 |

62.5% COTTON LARGE LOAD DIGITAL WAVEFORM

APPENDIX D-continued

| | | | | | | | | | | | | | | | |
|---|---|---|---|---|---|---|---|---|---|---|---|---|---|---|---|
| 128 | 135 | 141 | 143 | 146 | 148 | 151 | 153 | 156 | 158 | 160 | 163 | 165 | 168 | 170 | 172 |
| 175 | 177 | 180 | 182 | 185 | 187 | 189 | 191 | 192 | 193 | 193 | 194 | 194 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 194 | 194 | 193 | 193 | 192 |
| 191 | 189 | 187 | 183 | 179 | 176 | 172 | 168 | 164 | 160 | 156 | 153 | 149 | 145 | 141 | 135 |
| 128 | 121 | 115 | 113 | 110 | 108 | 105 | 103 | 100 | 98 | 96 | 93 | 91 | 88 | 86 | 84 |
| 81 | 79 | 76 | 74 | 71 | 69 | 67 | 65 | 64 | 63 | 63 | 62 | 62 | 61 | 61 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 61 | 61 | 62 | 62 | 63 | 63 | 64 | 65 |
| 67 | 69 | 73 | 77 | 80 | 84 | 88 | 92 | 96 | 100 | 103 | 107 | 111 | 115 | 121 | 128 |

87.5% COTTON LARGE LOAD DIGITAL WAVEFORM

| | | | | | | | | | | | | | | | |
|---|---|---|---|---|---|---|---|---|---|---|---|---|---|---|---|
| 128 | 135 | 141 | 145 | 149 | 152 | 156 | 160 | 164 | 168 | 171 | 175 | 179 | 183 | 187 | 187 |
| 189 | 191 | 192 | 193 | 193 | 194 | 194 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 195 | 195 | 195 | 195 | 195 | 195 | 195 | 195 | 195 | 195 | 195 | 195 | 195 | 195 |
| 195 | 195 | 194 | 194 | 193 | 193 | 192 | 191 | 189 | 187 | 174 | 165 | 157 | 149 | 141 | 135 |
| 128 | 121 | 115 | 111 | 107 | 104 | 100 | 96 | 92 | 88 | 84 | 81 | 77 | 73 | 69 | 68 |
| 66 | 64 | 63 | 62 | 62 | 61 | 61 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 60 | 60 | 60 | 60 | 60 | 60 | 60 | 60 | 60 | 60 | 60 | 60 | 60 | 60 | 60 | 60 |
| 61 | 61 | 62 | 62 | 63 | 64 | 66 | 68 | 74 | 82 | 90 | 99 | 107 | 115 | 121 | 128 |

APPENDIX E

SPIN TABLE

| | | | | | | | | | | | | | | | |
|---|---|---|---|---|---|---|---|---|---|---|---|---|---|---|---|
| 128 | 128 | 129 | 129 | 130 | 130 | 131 | 131 | 132 | 132 | 133 | 133 | 134 | 134 | 135 | 135 |
| 136 | 136 | 137 | 137 | 138 | 138 | 139 | 139 | 140 | 140 | 141 | 141 | 142 | 142 | 143 | 143 |
| 144 | 144 | 145 | 145 | 146 | 146 | 147 | 147 | 148 | 148 | 149 | 149 | 150 | 150 | 151 | 151 |
| 152 | 152 | 153 | 153 | 154 | 154 | 155 | 155 | 156 | 156 | 157 | 157 | 158 | 158 | 159 | 159 |
| 160 | 160 | 161 | 161 | 162 | 162 | 163 | 163 | 164 | 164 | 165 | 165 | 166 | 166 | 167 | 167 |
| 168 | 168 | 169 | 169 | 170 | 170 | 171 | 171 | 172 | 172 | 173 | 173 | 174 | 174 | 175 | 175 |
| 176 | 176 | 177 | 177 | 178 | 178 | 179 | 179 | 180 | 180 | 181 | 181 | 182 | 182 | 183 | 183 |
| 184 | 184 | 185 | 185 | 186 | 186 | 187 | 187 | 188 | 188 | 189 | 189 | 190 | 190 | 191 | 191 |
| 192 | 192 | 193 | 193 | 194 | 194 | 195 | 195 | 196 | 196 | 197 | 197 | 198 | 198 | 199 | 199 |
| 200 | 200 | 201 | 201 | 202 | 202 | 203 | 203 | 204 | 204 | 205 | 205 | 206 | 206 | 207 | 207 |
| 208 | 208 | 209 | 209 | 210 | 210 | 211 | 211 | 212 | 212 | 213 | 213 | 214 | 214 | 215 | 215 |
| 216 | 216 | 217 | 217 | 218 | 218 | 219 | 219 | 220 | 220 | 221 | 221 | 222 | 222 | 223 | 223 |
| 224 | 224 | 225 | 225 | 226 | 226 | 227 | 227 | 228 | 228 | 229 | 229 | 230 | 230 | 231 | 231 |
| 232 | 232 | 233 | 233 | 234 | 234 | 235 | 235 | 236 | 236 | 237 | 237 | 238 | 238 | 239 | 239 |
| 240 | 240 | 241 | 241 | 242 | 242 | 243 | 243 | 244 | 244 | 245 | 245 | 246 | 246 | 247 | 247 |
| 248 | 248 | 249 | 249 | 250 | 250 | 251 | 251 | 252 | 252 | 253 | 253 | 254 | 254 | 255 | 255 |

What is claimed is:

1. A fabric washing machine comprising:

a rotatable container to receive fabrics to be washed;

an electrically energized motor, means operatively connecting said motor to said container to rotate said container with said motor; and control means connected to said motor and effective to cause said motor to rotate said container having a load of fabrics therein with a first predetermined constant torque and to measure the time required for said motor to accelerate said container from a first predetermined velocity to a second higher predetermined velocity; to cause said motor to rotate said container with a second predetermined torque and to measure the time required for said motor to accelerate said container from the first predetermined velocity to the second predetermined velocity; and to generate a signal based upon the measured times so that the signal is representative of the mass of the load of fabrics and independent of friction of said washing machine.

2. A washing machine as set forth in claim 1, wherein:

said control means is effective to generate a first signal representative of the first measured time, a second signal representative of the second measured time and then a third signal representative of a calculation comprising the product of first signal multiplied by the second signal divided by the difference between the first and second signals, so that the third signal is representative of the mass of fabrics in said container.

3. A washing machine as set forth in claim 2, further comprising:

memory means storing predetermined values representative of fabric loads of predetermined known masses and defining predetermined ranges of fabric mass; and wherein said control means is effective to compare the third signal with the stored values and determine the range of fabric mass appropriate for the load of fabrics in said container.

4. A washing machine as set forth in claim 3, wherein:

said memory means stores a plurality of sets of empirically determined values representative of machine operation appropriate for corresponding ranges of fabric mass; and said control means is effective to cause operation of said machine in accordance with the set of values appropriate for the range of fabric mass appropriate for the load of fabrics in said container.

5. A washing machine comprising:

a rotatable container to receive fabrics to be washed;

an electrically energized motor, means operatively connecting said motor to said container to rotate said container;

control means connected to said motor and effective to cause said motor to rotate said container with at least one constant torque and to generate a signal representative of the time required for said motor to accelerate said container from a first predetermined speed to a second higher predetermined speed, during such at least one constant torque operation the signal thereby being representative of the mass of the load of fabrics in said container; and memory means storing a plurality of values representative of fabric loads of predetermined masses and defining ranges of fabric load mass; and wherein said control means is effective to compare the generated signal with the stored values and determine the range of fabric load mass appropriate for the load of fabrics in said container.

6. A washing machine as set forth in claim 5, wherein:

said memory means stores a plurality of sets of empirically determined values representative of machine operation appropriate for corresponding fabric mass ranges; and said control means is effective to cause operation of said machine in accordance with the set of empirically determined values corresponding to the mass range appropriate for the load of fabrics in said container.

7. A fabric washing machine comprising:

a rotatable container to receive fluid and fabrics to be washed in the fluid;

agitation means adapted to contact the fabrics to be washed and oscillatable in forward and reverse directions to agitate the fabrics;

an electrically energized motor, means operatively connecting said motor to said container and said agitation means to selectively rotate said container and oscillate said agitation means;

control means connected to said motor and effective to cause said motor to rotate said container with a constant torque and to generate a signal representative of the time required for said motor to accelerate said container from a first predetermined speed to a second higher predetermined speed;

memory means storing a plurality of load values representative of the corresponding acceleration times of fabric loads of predetermined masses and defining ranges of fabric load mass;

said control means is effective to compare the generated signal with the stored load values and determine the range of fabric mass appropriate for the fabrics in said container;

said memory means storing a plurality of sets of empirically determined agitation values representative of instantaneous angular motor velocities defining wash stroke oscillations of said agitation means corresponding to respective ones of the fabric load mass ranges; and said control means is effective to call up individual values from the set of values corresponding to the range of fabric mass appropriate for the load of fabrics in the container in a predetermined timed sequence and to cause said motor to operate in accordance with the then called up value to provide wash stroke oscillations appropriate for the fabric load in said container.

8. A washing machine as set forth in claim 7, wherein;

said memory means stores a set of empirically determined spin values representative of instantaneous motor velocities defining a centrifugal extraction rotation of said container including a maximum motor velocity and stores at least one spin value representative of a maximum motor velocity less than the maximum velocity provided by the stored set of spin values, the maximum spin values corresponding to respective ones of the load mass ranges; and said control means is effective to call up values from the set of spin values in a predetermined timed sequence, to compare the called up value with the maximum value for the mass range appropriate for the load of fabrics in said container and to operate said motor in accordance with the compared value representing the lower velocity to provide a spin operation of the container appropriate for the load of fabrics in the container.

9. A fabric washing machine comprising;

a rotatable container to receive fluid and fabrics to be washed in the fluid;

agitation means to contact the fabrics to be washed and oscillatable to agitate the fabrics;

an electrically energized motor, means operatively connecting said motor to said container and said agitation means to selectively rotate said container and oscillate said agitation means;

control means connected to said motor and effective to cause said motor to rotate said container and a load of fabrics therein, to measure a characteristic of the rotation which is independent of friction of said machine and is dependent upon the mass of fabrics in said container and to generate a signal representative of the measured characteristic;

memory means storing predetermined values representative of fabric loads of known masses and defining predetermined ranges of fabric load mass; and said control means is effective to compare the generated signal with the stored values and thereby determine the range of fabric mass appropriate for the load of fabrics in the container.

10. A washing machine as set forth in claim 9, wherein:

said memory means stores a plurality of sets of empirically determined values representative of machine operations appropriate for corresponding fabric mass ranges; and said control means is effective to cause operation of said machine in accordance with the set of values corresponding to the mass range appropriate for the load of fabrics in said container.

11. A washing machine as set forth in claim 10, wherein:

said memory stores a plurality of sets of empirically determined agitation values representative of instantaneous angular motor velocities defining wash stroke oscillations of said agitation means corresponding to respective ones of the fabric load mass ranges; and said control means is effective to call up individual values from the set of values corresponding to the mass range appropriate for the load of fabrics in the container in a predetermined timed sequence and to cause said motor to operate in accordance with the then called up value to provide wash stroke oscillations corresponding to the mass of the fabric load in said container.

12. A washing machine as set forth in claim 11, wherein;

said memory stores a set of empirically determined spin values representative of desired instantaneous motor velocities defining a centrifugal extraction rotation of said container including a maximum motor velocity and stores at least one spin value representative of a maximum motor velocity less than the maximum velocity provided by the stored set of spin values, the maximum spin values corresponding to respective ones of the load mass ranges; and said control means is effective to call up values from the set of spin values in a predetermined timed sequence, to compare the called up value with the maximum value for the mass range appropriate for the load of fabrics in said container and to operate said motor in accordance with the compared value representing the lower velocity to provide a spin operation of the container appropriate for the load of fabrics in said container.

13. A fabric washing machine, comprising:

a container to receive fabrics to be washed;

an electrically energized motor, means operatively connecting said motor to said container to selectively rotate said container with said motor;

control means connected to said motor and effective to cause said motor to rotate said container; said control means also being effective to repeatedly measure a signal representative of the instantaneous torque of said motor and a signal representative of the corresponding speed of said motor as said motor rotates said container through a predetermined angular distance; said control also being effective to multiply each torque signal and corresponding speed signal to provide a signal representative of the differential work of said motor and to sum the differential work signals to provide a signal representative of the total work of said motor; whereby the total work signal is representative of the mass of the load of fabrics in said container.

14. A fabric washing machine, comprising:

a rotatable container to receive fabrics to be washed;

agitation means to contact the fabrics to be washed and oscillatable to agitate the fabrics:

an electrically energized motor, means operatively connecting said motor to said container and said agitation means to selectively rotate said container and to oscillate said agitation means; and control means connected to said motor and effective to cause said motor to rotate said container with a constant speed input signal; to repeatedly measure a signal representative of the instantaneous torque output of said motor and a signal representative of the instantaneous angular speed of the motor; to multiply the torque signal and the speed signal and thereby provide a signal representative of the differential work of the motor; to sum the differential work signals to provide a signal representative of the total work; to sum the instantaneous speed signals to provide a signal representative of the angular distance traveled by the motor; and to terminate the measurements and summations upon the signal representative of the angular distance reaching a predetermined total whereby the signal representative of the total work is representative of the work required for said motor to rotate the fabrics in said container a predetermined angular distance.

15. A washing machine as set forth in claim 14, further comprising:

memory means storing a plurality of values representative of the work required for the motor to rotate fabric loads of predetermined masses through the predetermined angular distance and defining ranges of fabric load mass; and wherein said control means is effective to compare the generated signal with the stored values and determine the mass range appropriate for the load of fabrics in said container.

16. A washing machine as set forth in claim 15, wherein:

said memory means stores a plurality of sets of empirically determined values representative of machine operation appropriate for corresponding mass ranges of fabric loads;

said control means is effective to cause operation of said machine in accordance with the set of values appropriate for the mass range of the load of fabrics in said container.

17. A fabric washing machine as set forth in claim 15, wherein:

said memory means stores a plurality of sets of empirically determined agitation values representative of instantaneous angular motor velocities defining wash stroke oscillations of said agitation means corresponding to respective ones of the fabric load mass ranges; and said control means is effective to call up individual values from the set of values corresponding to the mass range appropriate for the load of fabrics in the container in a predetermined timed sequence and to cause said motor to operate in accordance with the then called up value to provide wash stroke oscillations appropriate for the mass of the fabric load in said container.

18. A washing machine as set forth in claim 17, wherein;

said memory means stores a set of empirically determined spin values representative of instantaneous motor velocities defining a centrifugal extraction rotation of said container including a maximum motor velocity and stores at least one spin value representative of a maximum motor velocity less than the maximum velocity provided by the stored set of spin values, the maximum spin values corresponding to respective ones of the fabric load mass ranges; and said control means is effective to call up values from the set of spin values in a predetermined timed sequence, to compare the called up value with the maximum value for the mass range appropriate for the load of fabrics in said container and to operate said motor in accordance with the compared value representing the lower velocity to provide a spin operation of the container appropriate for the load of fabrics in said container.

19. A washing machine comprising;

a rotatable container to receive fluid and fabrics to be washed in the fluid;

an electrically energized motor, means operatively connecting said motor to said container to selectively rotate said container;

control means operatively connected to said motor and including memory means storing a plurality of sets of predetermined operation values, each set of values providing a different wash cycle of operation of said washing machine;

said memory means also storing a plurality of predetermined size values representative of a characteristic of rotation of said container with corresponding predetermined weights of fabrics therein;

said control means is effective to cause said motor to rotate said container and a load of fabrics, to determine the value of the corresponding characteristic of rotation, to compare the determined value with the stored size values and to select the stored size value most nearly representative of the weight of the load of fabrics in said container;

said control means also is effective to select one of the sets of operation values based upon the selected size value.

20. A washing machine as set forth in claim 19, wherein:

said control means is effective to cause said motor to rotate said container with a constant torque and to generate a signal representative of the time required for the container to accelerate from a first predetermined speed to a second higher predetermined speed, the signal being the value of the corresponding characteristic of rotation.

21. A washing machine as set forth in claim 19, wherein;

said control means is effective to cause said motor to rotate said container and fabrics with a first predetermined constant torque, to measure the time required for said motor to accelerate said container from a first predetermined velocity to a second, higher predetermined velocity, to cause said motor to rotate said container and fabrics with a second predetermined torque and to measure the time required for said motor to accelerate said container from the first predetermined velocity to the second predetermined velocity; and said control means also is effective to generate a first signal representative of the first measured time, a second signal representative of the second measured time and then a third signal representative of a calculation comprising the product of first signal multiplied by the second signal divided by the difference between the first and second signals, so that the third signal is the determined value of the corresponding characteristic of rotation.

22. A washing machine as set forth in claim 19, wherein:

said control means is effective to cause said motor to rotate said container with a constant speed input signal; to repeatedly measure a signal representative of the instantaneous torque output of said motor and a signal representative of the instantaneous angular speed of the motor; to multiply the torque signal and the speed signal and thereby provide a signal representative of the differential work of the motor; to sum the differential work signals to provide a signal representative of the total work; to sum the instantaneous speed signals to provide a signal representative of the angular distance traveled by the motor; and to terminate the measurement and summation upon the signal representative of the angular distance reaching a predetermined total whereby the signal representative of the total work is the determined value of the corresponding characteristic of rotation.

23. A washing machine as set forth in claim 19, wherein;

said sets of predetermined operation values include a plurality of sets of empirically determined agitation values representative of instantaneous angular motor velocities defining washing cycles corresponding to the stored size values; and said control means is effective to call up individual values from the set of agitation values corresponding to the selected size value in a predetermined timed sequence and to cause said motor to operate in accordance with the then called up value to provide a wash cycle reflecting the mass of the load of fabrics in said container.

24. A washing machine as set forth in claim 19, wherein:

said sets of predetermined operation values include a set of empirically determined spin values representative of instantaneous motor velocities defining a centrifugal extraction rotation of said container including a maximum motor velocity and stores at least one spin value representative of a maximum motor velocity less than the maximum velocity provided by the stored set of spin values, the maximum spin values corresponding to a respective ones of the stored size values; and said control means is effective to call up values from the set of spin values in a predetermined timed sequence, to compare the called up value with the maximum value for the selected size value and to operate said motor in accordance with the compared value representing the lower velocity to provide a spin operation of the container reflecting the mass of the load of fabric in said container.

25. A fabric washing machine comprising;

a container to receive fluid and fabrics to be washed;

agitation means to agitate the fluid and fabrics;

an electrically energized motor, means operatively connecting said motor to said container and said agitation means to selectively rotate said container and oscillate said agitation means;

control means operatively connected to said motor and effective to selectively cause said motor to rotate said container and oscillate said agitation means;

said control means including memory means storing a plurality of sets of predetermined operation values, each set of values providing a different wash cycle of operation of said washing machine;

said memory also storing a plurality of predetermined mix values, each of the mix values being representative of an operational characteristic of said machine with a load of fabrics of a particular mix of materials; and said control means is effective to measure the operational characteristic of the machine representative of the material mix of the load of fabrics then in said container, to compare the measured characteristic with the stored mix values and select the stored mix value most representative of the measured characteristic.

26. A washing machine as set forth in claim 25, wherein;

said sets of predetermined operation values include a plurality of sets of empirically determined agitation values representative of instantaneous angular motor velocities defining washing action corresponding to the stored mix values; and said control means is effective to call up individual values from the set of agitation values corresponding to the selected mix value in a predetermined timed sequence and to cause said motor to operate in accordance with the then called up agitation value to provide a wash action reflecting the mix of the fabric load in said container.

27. A fabric washing machine as set forth in claim 25, wherein:

said sets of predetermined operation values include a set of empirically determined spin values representative of instantaneous motor velocities defining a centrifugal extraction rotation of said container including a maximum motor velocity and stores at least one spin value representative of a maximum motor velocity less than the maximum velocity provided by the stored set of spin values, the maximum spin values corresponding to respective ones of the stored mix values; and said control means is effective to call up values from the set of spin values in a predetermined timed sequence, to compare the called up value with the maximum value for the selected mix value and to operate said motor in accordance with the compared value representing the lower velocity to provide a spin operation of the container reflecting the material mix of the load of fabrics in said container.

28. A washing machine comprising;

a rotatable container to receive fluid and fabrics to be washed in the fluid;

agitation means to agitate the fluid and fabrics;

an electrically energized motor, means operatively connecting said motor to said container and said agitation means to selectively rotate said container and oscillate said agitation means;

control means operatively connected to said motor and including memory means storing a plurality of sets of predetermined operation values, each set of values providing a different operation of said washing machine;

said memory means also storing a plurality of predetermined size values representative of a particular characteristic of rotation of said container with corresponding predetermined weights of fabrics therein;

said control means is effective to cause said motor to rotate said container and a load of fabrics therein, top determine the value of the particular characteristic of rotation, to compare the determined value with the stored size values and to select the stored size value most nearly representative of the weight of that load of fabrics;

said memory also storing a plurality of sets of predetermined mix values, each set of mix values corresponding to a particular load size value and each of the mix values in a set being representative of a particular operational characteristic of said machine with a load of fabrics of a particular mix of materials; and said control means is effective to determine the particular operational characteristic of the machine representative of the material mix of the load of fabrics then in the container, to compare the determined characteristic with the stored mix values of the set of mix values corresponding to the selected size value and select the stored mix value most representative of the determined characteristic, said control also is effective to operate said machine in accord with the set of predetermined operation values appropriate for the selected mix value.

29. A washing machine as set forth in claim 28, wherein;

said sets of predetermined operation values include a plurality of sets of empirically determined agitation values representative of instantaneous angular motor velocities defining washing cycles corresponding to the stored mix values; and said control means is effective to call up individual values from the set of agitation values corresponding to the selected mix value in a predetermined timed sequence and to cause said motor to operate in accordance with the then called up agitation value to provide a wash action reflecting the mix of the fabric load in said container.

30. A washing machine as set forth in claim 28, wherein:

the sets of predetermined operation values include a set of empirically determined spin values representative of instantaneous motor velocities defining a centrifugal extraction rotation of said container and said control stores at least one spin value representative of a maximum motor velocity less than the maximum velocity provided by the stored set of spin values, the maximum spin values corresponding to respective ones of the stored mix values; and said control means is effective to call up values from the set of spin values in a predetermined timed sequence, to compare the called up value with the maximum value for the selected mix value and to operate said motor in accordance with the compared value representing the lower velocity to provide a spin operation of the container reflecting the material mix of the load of fabrics in the container.

31. A fabric washing machine comprising:

a container to receive fluid and fabrics to be washed in the fluid;

agitation means to agitate the fluid and fabrics;

fluid supply means for supplying fluid to said container;

an electrically energized motor, means operatively connecting said motor to said agitation means to oscillate said agitation means;

control means operatively connected to said motor and to said fluid supply means, said control means including means for providing a signal representative of the weight of the load of fabrics in said container;

said control means being effective to cause said fluid supply means to provide at least one predetermined amount of fluid to said container according to the signal representative of the weight of fabrics in said container, to cause said motor to oscillate said agitation means a predetermined number of strokes, to generate a signal representative of at least a predetermined portion of the electric current drawn by said motor during such oscillations; and memory means storing a plurality of empirically determined values representative of fabric loads of predetermined materials mixes and defining ranges of fabric material mixes;

said control means being effective to compare the generated signal with the stored values and determine the material mix range appropriate for the load of fabrics in said container.

32. A fabric washing machine as set forth in claim 31 wherein: said control means is effective to cause said fluid supply means to repeatedly provide predetermined amounts of fluid to said container, to cause said motor to oscillate said agitation means a predetermined number of strokes after each addition of fluid, to generate a signal representative of at least a predetermined portion of the total electric current drawn by said motor during all the oscillation of said agitation means.

33. A fabric washing machine comprising:

a container to receive fluid and fabrics to be washed in the fluid;

agitation means to agitate the fluid and fabrics;

fluid supply means for supplying fluid to said container;

an electrically energized motor, means operatively connecting said motor to said container and said agitation means to selectively operate said container and to oscillate said agitation means;

memory means storing a plurality of size values representative of a characteristic of operation of said container with corresponding predetermined weights of fabrics therein;

control means operatively connected to said motor and to said fluid supply means; said control being effective to cause said motor to operate said container, to determine the value of the corresponding operating characteristic of said container to compare the determined value with the stored size values and to select the stored size value representative of the weight of fabrics in that load;

said memory means also storing a plurality of sets of predetermined mix values, each of said sets of mix values corresponding to a particular load size value and each of the mix values in a set being representative of an oscillation characteristic of said agitation means with a load of fabrics of a particular mix of materials; and said control means is effective to cause said fluid supply means to provide at least one predetermined amount of fluid to said container, to cause said motor to oscillate said agitation means a predetermined number of strokes, to generate a signal representative of at least a predetermined portion of the electric current drawn by said motor during such oscillation, to compare the generated signal with the stored mix values corresponding to the selected size value and select the stored mix value representative of the material mix range appropriate for the load of fabrics in said container.

34. A fabric washing machine comprising:

a container to receive fluid and fabrics to be washed in the fluid;

fluid supply means for supplying fluid to said container;

agitation means to agitate the fluid and fabrics;

an electrically energized motor, means operatively connecting said motor to said agitation means to oscillate said agitation means; and control means operatively connected to said motor and to said fluid supply means, said control means including means for providing a signal representative of the mass of fabrics in said container;

said control means being effective to cause said fluid supply means to repeatedly provide predetermined incremental amounts of fluid to said container according to the signal representative of the mass of fabrics in said container, to cause said motor to provide an oscillation operation of a predetermined number of strokes of said agitation means after each fluid addition, to provide a current signal representative of at least a portion of the electric current drawn by said motor during the oscillation operations and provide a mix signal based upon the total current drawn; and memory means storing a set of predetermined mix values representative of predetermined material mixes of fabrics in a load corresponding to the predetermined mass of fabrics; said control being effective to compare the mix signal with the set of mix values and select the stored mix value appropriate for the material mix of the fabrics in said container.

35. A fabric washing machine as set forth in claim 34, wherein: said control is effective to cause said motor to provide at least one oscillation operation of said agitation means before fluid is added to the container and to provide a plurality of oscillation operations of said agitation means after addition of fluid to said container.

36. A washing machine as set forth in claim 35, wherein: said control sums the current signals for the oscillation operations after addition of fluid to said container and divides the sum by the current signal for the oscillation operation before the addition of water to provide the mix signal.

37. A washing machine as set forth in claim 34, wherein: said control provides a cumulative amount of fluid to said container for each oscillation operation based upon the mass of fabrics in said container.

38. A washing machine as set forth in claim 34, wherein: said control provides a number of oscillation strokes for each oscillation operation based upon the mass of fabrics in said container.

39. A washing machine as set forth in claim 34, wherein the predetermined mix values are representative of fabric loads of predetermined known material mixes and define predetermined ranges of fabric material mix; and the mix signal provided by said control means is representative of the mix of material of the load of fabrics in said container and said control means is effective to compare the mix signal with the stored mix values and thereby determine the appropriate material mix range for the load of fabrics in said container.

40. A washing machine as set forth in claim 39, wherein:

said memory means stores a plurality of sets of empirically determined values representative of machine operation appropriate for corresponding material mix ranges; and said control means is effective to cause operation of said machine in accordance with the set of values corresponding to the material mix range appropriate for the load of fabrics in said container.

41. A fabric washing machine as set forth in claim 34, wherein: said memory means stores a plurality of sets of empirically determined agitation values representative of instantaneous angular motor velocities defining wash stroke oscillations of said agitation means corresponding to respective ones of the material mix ranges; and said control means is effective to call up individual values from the set of agitation values corresponding to the material mix range appropriate for the load of fabrics in said container in a predetermined timed sequence and to cause said motor to operate in accordance with the then called up value to provide a wash action appropriate for the material mix of the fabric load in said container.

42. A washing machine as set forth in claim 41, wherein;

said memory means also stores a set of empirically determined spin values representative of instantaneous motor velocities defining a centrifugal extraction rotation of said container including a maximum motor velocity and stores at least one spin value representative of a maximum motor velocity less than the maximum velocity provided by the stored set of spin values, the maximum spin values corresponding to respective ones of the material mix ranges; and said control means is effective to call up values from the set of spin values in a predetermined timed sequence, to compare the called up value with the maximum value for the material mix range of the load of fabrics in said container and to operate said motor in accordance with the compared value representing the lower velocity to provide a spin operation of the container appropriate for the material mix of the load of fabrics in said container.

43. A fabric washing machine comprising:

a container to receive fluid and fabrics to be washed in the fluid;

fluid supply means for supplying fluid to said container;

agitation means to agitate the fluid and fabrics;

an electrically energized motor; means operatively connecting said motor to said agitation means to oscillate said agitation means;

means for providing a signal representative of the mass of the load of fabrics in said container; and control means operatively connected to said motor and to said fluid supply means, said control means being effective to cause said motor to provide an oscillation operation of said agitation means with no addition of fluid to said container, to cause said fluid supply means to repeatedly provide fluid to said container in incremental cumulative volumes according to the signal representative of the mass of the load of fabrics in said container, to provide an oscillation operation of said agitation means with each incremental volume of fluid, to provide a motor signal representative of the torque output of said motor during each of the oscillation operations and provide a mix signal based upon the motor signals.

44. A washing machine as set forth in claim 43, wherein: said control sums the motor signals for the oscillation operations after addition of fluid to said container and divides the sum by the motor signal for the oscillation operation before the addition of water to provide the mix signal.

45. A washing machine as set forth in claim 43, wherein: said control provides a number of oscillation strokes for each oscillation operation based upon the mass of fabrics in said container.

46. A washing machine as set forth in claim 45, wherein: the number of oscillations in each oscillation operation is greater for a large mass load than for a small mass load.

47. A washing machine as set forth in claim 43, wherein: said control causes said fluid supply means to provide an initial volume of fluid to said container based upon the mass of the fabric load and thereafter to provide predetermined addition incremental volumes.

48. A washing machine as set forth in claim 43, further including: memory means storing a set of predetermined mix values representative of predetermined material mixes of fabrics in a load corresponding to the predetermined mass of fabrics; said control being effective to compare the mix signal with the set of mix values and select the stored mix value appropriate for the material mix of the fabrics in said container.

49. A washing machine as set forth in claim 48, wherein the predetermined mix values are representative of fabric loads of predetermined known material mixes and define predetermined ranges of fabric material mix; the mix signal provided by said control means is representative of the mix of material of the load of fabrics in said container and said control means is effective to compare the mix signal with the stored mix values and thereby determine the appropriate material mix range for the load of fabrics in said container.

50. A washing machine as set forth in claim 48, wherein:

said memory means stores a plurality of sets of empirically determined values representative of machine operation appropriate for corresponding material mix ranges; and said control means is effective to cause operation of said machine in accordance with the set of values corresponding to the material mix range appropriate for the load of fabrics in said container.

51. A fabric washing machine as set forth in claim 48, wherein: said memory means stores a plurality of sets of empirically determined agitation values representative of instantaneous angular motor velocities defining wash stroke oscillations of said agitation means corresponding to respective ones of the material mix ranges; and said control means is effective to call up individual values from the set of agitation values corresponding to the material mix range appropriate for the load of fabrics in said container in a predetermined timed sequence and to cause said motor to operate in accordance with the then called up value to provide a wash action appropriate for the material mix of the fabric load in said container.

52. A washing machine as set forth in claim 48, wherein;

said memory means also stores a set of empirically determined spin values representative of instantaneous motor velocities defining a centrifugal extraction rotation of said container including a maximum motor velocity and stores at least one spin value representative of a maximum motor velocity less than the maximum velocity provided by the stored set of spin values, the maximum spin values corresponding to respective ones of the material mix ranges; and said control means is effective to call up values from the set of spin values in a predetermined timed sequence, to compare the called up value with the maximum value for the material mix range of the load of fabrics in said container and to operate said motor in accordance with the compared value representing the lower velocity to provide a spin operation of the container appropriate for the material mix of the load of fabrics in said container.

53. A fabric washing machine comprising:

a container to receive fluid and fabrics to be washed in the fluid;

fluid supply means for supplying fluid to said container;

agitation means to agitate the fluid and fabrics;

an electronically commutated motor; means operatively connecting said motor to said container and said agitation means to selectively rotate said container and to oscillate said agitation means; and control means operatively connected to said motor and to said fluid supply means; said control means including memory means storing a plurality of sets of operation values, each set of operation values providing a different wash cycle of operation of said washing machine;

said memory means also storing a plurality of size values, each of said size values being representative of an operating characteristic of said motor when rotating said container with a different predetermined weight of fabrics in said container;

said control means being effective to cause said motor to rotate said container with a load of fabrics therein to provide a motor feedback signal representative of the operating characteristic of said motor with that load of fabrics in said container, to compare the motor feedback signal with the stored size values and thereafter to operate said washing machine in accordance with the stored value appropriate for the load of fabrics in said container.

54. A washing machine as set forth in claim 53, wherein:

said control is effective to sense motor control commutation signals, to measure the time between successive signals and to count the number of signals;

said control is effective to cause said motor to rotate said container with at least a first constant torque, to count the number of signals beginning when the time between successive signals is a first predetermined length and to terminate the counting operation when the time between successive signals is a second, shorter predetermined length, the number of signals counted then being representative of the weight of the load of fabrics in the container.

55. A washing machine as set forth in claim 54 wherein:

said control is effective to cause said motor to operate with a first predetermined constant torque and to count the number of resultant communication signals; to cause said motor to operate with a second predetermined torque and to count the number of resultant communication signals; and said control means also is effective to generate a first size signal representative of the first count, a second size signal representative of the second count and a third size signal representative of a calculation comprising the product of first signal multiplied by the second signal divided by the difference between the first and second signals, the third signal being representative of the weight of the load of fabrics in said container.

56. A washing machine as set forth in claim 54, wherein:

said control is effective to sense motor control communication signals, to measure the time between successive signals and to measure a predetermined percentage of the instantaneous input current;

said control means is effective to cause said motor to operate with a constant speed input signal; to repeatedly measure the time between successive communication signals and a predetermined percentage of the corresponding instantaneous input current; to multiply the time signal and the current signal and thereby provide a signal representative of the differential work of the motor; to sum the differential work signals to provide a signal representative of the total work; to sum the individual time signals to provide a signal representative of the angular distance traveled by the motor; and to terminate the measurement and summation upon the cumulative total of the time signals reaching a predetermined level, the cumulative work signals then being representative of the size of the load of fabrics in said container.

57. A washing machine as set forth in claim 53, wherein;

said control is effective to cause said fluid supply means to repeatedly provide predetermined incremental amounts of fluid to said container and to cause said motor to operate said agitation means through a predetermined number of oscillations after each fluid addition;

said control is effective to measure a predetermined portion of the instantaneous motor input current at predetermined intervals during each period of oscillation and to total the current measurements for each period of oscillation; to generate a signal representative of the at least predetermined portion of the total motor input currentm during all the oscillations of said agitation means.

58. A washing machine as set forth in claim 57, wherein said memory means stores a plurality of mix values representative of fabric loads of predetermined material mixes and defining ranges of fabric material mixes, and said control means is effective to compare the generated signal with the stored mix values and determine the mix range appropriate for the load of fabrics in the container.

59. A washing machine as set forth in claim 57, wherein memory means also stores a plurality of predetermined material mix values representative of predetermined material mixes of fabric loads;

said control means being effective to compare the generated signal with the stored mix values and to select the stored mix value most nearly representative of the material mix of the load of fabrics in said container.

* * * * *